US008692740B2

(12) United States Patent
Yoshida et al.

(10) Patent No.: US 8,692,740 B2
(45) Date of Patent: Apr. 8, 2014

(54) DISPLAY DEVICE AND DRIVING METHOD THEREOF

(75) Inventors: Yasunori Yoshida, Kanagawa (JP); Hajime Kimura, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 961 days.

(21) Appl. No.: 11/427,242

(22) Filed: Jun. 28, 2006

(65) Prior Publication Data

US 2007/0001945 A1 Jan. 4, 2007

(30) Foreign Application Priority Data

Jul. 4, 2005 (JP) ..... 2005-194600

(51) Int. Cl.
*G09G 3/30* (2006.01)

(52) U.S. Cl.
USPC ..... 345/76; 345/77

(58) Field of Classification Search
USPC ..... 345/76–83; 315/169.3
See application file for complete search history.

(56) References Cited

U.S. PATENT DOCUMENTS 5,929,845 A * 7/1999 Wei et al. ..... 345/156
6,320,325 B1 * 11/2001 Cok et al. ..... 315/169.3
6,476,563 B2 11/2002 Silvestre
6,528,951 B2 3/2003 Yamazaki et al.
6,661,397 B2 12/2003 Mikami et al.
6,828,950 B2 12/2004 Koyama
7,034,787 B2 * 4/2006 Date et al. ..... 345/89
7,123,277 B2 * 10/2006 Brown Elliott et al. ..... 345/690
7,129,938 B2 * 10/2006 Naugler, Jr. ..... 345/207
7,248,255 B2 7/2007 Yoshida
7,268,760 B2 9/2007 Mikami et al.

(Continued)

FOREIGN PATENT DOCUMENTS

CN 1358298 A 7/2002
CN 1588517 3/2005

(Continued)

OTHER PUBLICATIONS

The Patent Office of the People's Republic of China, Notification of the First Office Action, Application No. 200610106206.8, Jun. 5, 2009, with full translation.

(Continued)

*Primary Examiner* — Alexander Eisen
*Assistant Examiner* — Nelson Lam
(74) *Attorney, Agent, or Firm* — Fish & Richardson P.C.

(57) ABSTRACT

In an EL display device which performs area grayscale display, image quality is improved and stabilized. A plurality of subpixels each having light emitting elements which emit light of approximately the same color and a plurality of monitor pixels each having the same number of subpixels as the pixel are provided. The light emitting element in the monitor pixel is manufactured at the same time as the light emitting element in the pixel, and the electrode of the light emitting element in the monitor pixel is connected to a different constant current source in each subpixel. A circuit for changing a potential of the electrode of the light emitting element in the pixel for each subpixel in accordance with a potential change of the electrode of the light emitting element of the monitor pixel, thereby the aforementioned purposes are achieved.

16 Claims, 33 Drawing Sheets

(56) References Cited

U.S. PATENT DOCUMENTS

| | | | | |
|---|---|---|---|---|
| 7,397,448 | B2 * | 7/2008 | Stevenson et al. | 345/76 |
| 7,923,937 | B2 | 4/2011 | Osame et al. | |
| 8,354,794 | B2 | 1/2013 | Osame et al. | |
| 2001/0033252 | A1 | 10/2001 | Yamazaki et al. | |
| 2002/0017643 | A1 | 2/2002 | Koyama | |
| 2002/0140364 | A1 | 10/2002 | Inukai | |
| 2003/0189410 | A1 | 10/2003 | Yamazaki et al. | |
| 2004/0070558 | A1 * | 4/2004 | Cok et al. | 345/76 |
| 2004/0222954 | A1 * | 11/2004 | Lueder | 345/87 |
| 2005/0012731 | A1 | 1/2005 | Yamazaki et al. | |
| 2005/0017933 | A1 | 1/2005 | Koyama | |
| 2005/0017963 | A1 | 1/2005 | Yamazaki et al. | |
| 2005/0017964 | A1 | 1/2005 | Yamazaki et al. | |
| 2005/0018110 | A1 * | 1/2005 | Liu | 349/106 |
| 2005/0024303 | A1 | 2/2005 | Kimura et al. | |
| 2005/0030268 | A1 | 2/2005 | Zhang et al. | |
| 2005/0083270 | A1 | 4/2005 | Miyazawa | |
| 2005/0110719 | A1 * | 5/2005 | Satoh et al. | 345/76 |
| 2005/0122349 | A1 | 6/2005 | Yamazaki et al. | |
| 2005/0128193 | A1 * | 6/2005 | Lueder | 345/207 |
| 2005/0212730 | A1 * | 9/2005 | Sato et al. | 345/76 |
| 2005/0248515 | A1 * | 11/2005 | Naugler et al. | 345/77 |
| 2005/0264495 | A1 * | 12/2005 | Shin | 345/76 |
| 2005/0285822 | A1 * | 12/2005 | Reddy et al. | 345/76 |
| 2005/0285823 | A1 | 12/2005 | Kimura et al. | |
| 2006/0038804 | A1 | 2/2006 | Hayakawa et al. | |
| 2007/0001941 | A1 | 1/2007 | Umezaki et al. | |
| 2007/0001954 | A1 | 1/2007 | Shishido et al. | |
| 2009/0224676 | A1 | 9/2009 | Osame et al. | |
| 2011/0018855 | A1 | 1/2011 | Miyazawa | |

FOREIGN PATENT DOCUMENTS

| | | | |
|---|---|---|---|
| EP | 1246157 | A2 | 10/2002 |
| EP | 1450345 | A2 | 8/2004 |
| EP | 1 517 290 | A2 | 3/2005 |
| JP | 02-287492 | | 11/1990 |
| JP | 2001-184015 | | 7/2001 |
| JP | 2002-123219 | | 4/2002 |
| JP | 2002297095 | A | 10/2002 |
| JP | 2003/288055 | | 10/2003 |
| JP | 2004252036 | A | 9/2004 |
| JP | 4974492 | B2 | 7/2012 |
| KR | 2004-0004843 | A | 1/2004 |
| KR | 2004-0074607 | A | 8/2004 |
| KR | 2005-0021960 | A | 3/2005 |
| WO | WO0156000 | A2 | 8/2001 |
| WO | 2004/021327 | | 3/2004 |
| WO | 2006/016706 | A1 | 2/2006 |

OTHER PUBLICATIONS

Chinese Application No. 200610106206.8; Office action dated Nov. 13, 2009, with full translation.

Korean Office Action (KR Application No. 2006-0058448) dated Aug. 10, 2012 with English translation.

* cited by examiner

DISPLAY DEVICE AND DRIVING METHOD THEREOF

BACKGROUND OF THE INVENTION

1. Field of the Invention

The invention relates to a display device having a pixel including a light emitting element and a driving method thereof.

2. Description of the Related Art

A flat type display device having a pixel including an electroluminescence element (hereinafter also referred to as "a light emitting element") has been developed. This display device is said to have a wider viewing angle than a liquid crystal display device as a light emitting element in a pixel emits light by itself despite that a screen has a flat shape. Further, an advantage of this display device in that it can be thinner and lighter than a liquid crystal display device is attracting attentions.

In the case where a pixel is formed of a light emitting element, an analog grayscale method to control a current value or a voltage level supplied to the light emitting element is known as a method for controlling the luminance of the pixel (for example, see Patent Document 1). Moreover, a time grayscale method to control light emission time of a light emitting element is known (for example, see Patent Document 2). Besides, an area grayscale method to divide one pixel into a plurality of regions and control a light emission state of each divided pixel is known (for example, see Patent Document 3).

[Patent Document 1]

Japanese Patent Laid-Open No. 2003-288055

[Patent Document 2]

Japanese Patent Laid-Open No. 2002-123219

[Patent Document 3]

Japanese Patent Laid-Open No. 2001-184015

SUMMARY OF THE INVENTION

However, a light emitting element has a problem in that its luminance changes by a temperature change or passage of light emission time. Such deterioration of luminance is considered an issue to be solved since it appears notably as deterioration of image quality in a display device which employs an area grayscale method.

In view of this, the invention improves and stabilizes image quality of a display device which performs area grayscale display by using a light emitting element.

The point of the invention is that a portion of a display device having a pixel including a light emitting element is provided with a light emitting element having the same configuration as the pixel so as to function as a monitor light emitting element, thereby a voltage or a current supplied to the light emitting element is corrected in consideration of a change of the monitor light emitting element.

The invention provides a display device including a plurality of monitor light emitting elements, a monitor line for monitoring a change in potential of an electrode included in the plurality of monitor light emitting elements, and a unit for electrically blocking a current supply to a shorted monitor light emitting element through the monitor line when any of the plurality of monitor light emitting elements is shorted.

The invention provides a display device having a display pixel including a plurality of subpixels including light emitting elements with approximately the same light emission color, and a monitor pixel with the same configuration as the display pixel. It is preferable that a light emitting element provided in this pixel and a light emitting element provided in the monitor pixel be formed simultaneously in a manufacturing step and have the same configurations. The light emitting element of each of the subpixels in the monitor pixel is connected to different constant current sources. The display device includes a differential amplifier circuit which changes a potential applied to the light emitting element in the display pixel for each subpixel in accordance with a potential change of the light emitting element in the monitor pixel for each subpixel.

By providing a monitor light emitting element with the same configuration as a light emitting element provided in a pixel, luminance variations caused by a change in an environmental temperature or deterioration with time can be suppressed. As a result, image quality can be improved or stabilized.

DETAILED DESCRIPTION OF THE INVENTION

Figure 1:
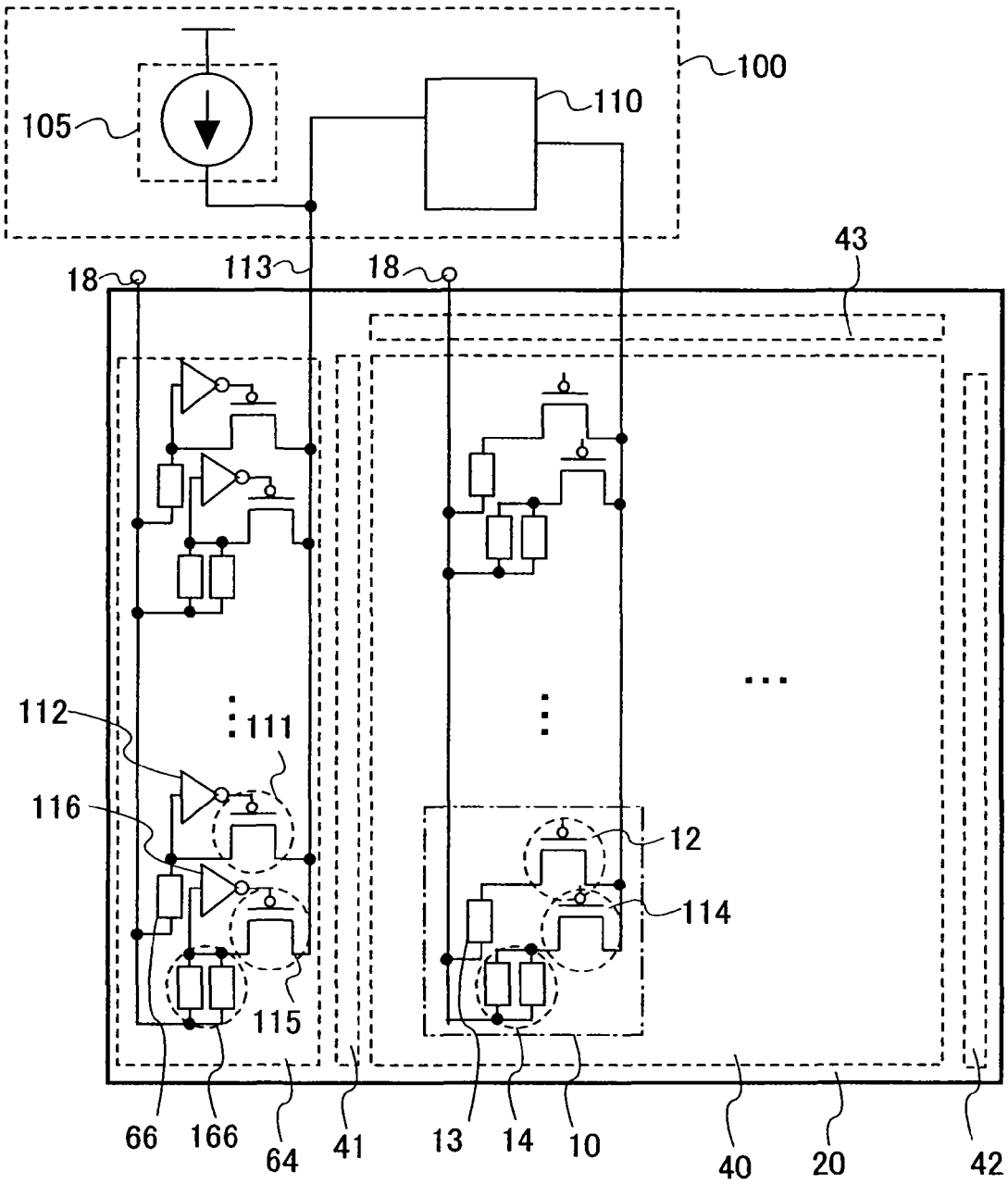
FIG. 1 is a diagram showing a display device of the invention.

Although the present invention will be fully described by way of embodiment modes with reference to the accompanying drawings, it is to be understood that various changes and modifications will be apparent to those skilled in the art. Therefore, unless such changes and modifications depart from the scope of the invention, they should be construed as being included therein. Note that identical portions in embodiment modes are denoted by the same reference numerals and detailed descriptions thereof are omitted.

It is to be noted in the specification that connected elements are electrically connected. Therefore, connected elements may have a semiconductor element, a switching element, or the like between them.

In this specification, a source electrode and a drain electrode of a transistor are thus called for convenience in order to distinguish electrodes other than a gate electrode in the configuration of the transistor. In the invention, in the case where the conductivity of a transistor is not limited, the source electrode and the drain electrode are changed in name depending on the conductivity of the transistor. Therefore, a source electrode or a drain electrode is described as one electrode or the other electrode in some cases.

Embodiment Mode 1

In this embodiment mode, a configuration of a panel including a monitor light emitting element is described with reference to the drawings.

FIG. 1 shows a configuration of a panel including a pixel portion 40, a signal line driver circuit 43, a first scan line driver circuit 41, a second scan line driver circuit 42, and a monitor circuit 64. This panel is formed using an insulating substrate 20.

The pixel portion 40 includes a plurality of pixels 10. Each pixel includes a first light emitting element 13 and a first driving transistor 12 which is connected to the first light emitting element 13 and has a function to control a current supply. The first light emitting element 13 is connected to a power source 18. Moreover, each pixel may include a second driving transistor 114 and a second light emitting element 14 which are connected in the same way as the first driving transistor 12 and the first light emitting element 13. The second driving transistor 114 and the second light emitting element 14 may be connected in parallel to the first driving transistor 12 and the first light emitting element 13 with a common power source. Here, the second light emitting element 14 may have a configuration in which two light emitting elements with equivalent or almost equivalent functions to the first light emitting element are connected in parallel as shown in FIG. 1. However, the invention is not limited to this and one light emitting element may be provided such as the first light emitting element 13. Further, a plurality of light emitting elements of three or more may be connected in parallel or the functions of the plurality of light emitting elements may not be equivalent to one another. For example, the light emitting element as the second light emitting element 14 may have a different light emission area from that of the first light emitting element 13. That is to say, it is required in one pixel that the second driving transistor 114 and the second light emitting element 14 are connected in parallel to the first driving transistor 12 and the first light emitting element 13. It is to be noted that a more specific configuration of the pixel 10 is described in the following embodiment mode as an example.

The monitor circuit 64 includes a first monitor light emitting element 66, a first monitor controlling transistor 111 connected to the first monitor light emitting element 66, and a first inverter 112. The first inverter 112 has an output terminal connected to a gate electrode of the first monitor controlling transistor 111. An input terminal of the first inverter 112 is connected to one of a source electrode and a drain electrode of the first monitor controlling transistor 111 and to the first monitor light emitting element 66. A constant current source 105 is connected to the first monitor controlling transistor 111 through a power supply line 113. Other monitor controlling transistors in the monitor circuit 64 each has a function to control a current supply from the power supply line 113 to each of a plurality of monitor light emitting elements. The power supply line 113 which is connected to electrodes of the plurality of monitor light emitting elements can have a function to monitor a change in potential of the electrodes. Moreover, the constant current source 105 is only required to have a function to supply a constant current to the power supply line 113. Further, the monitor circuit 64 may have a second monitor controlling transistor 115, a second monitor light emitting element 166 and a second inverter 116 which are connected in parallel to the first monitor controlling transistor 111, the first monitor light emitting element 66 and the first inverter 112, with a common power source similarly to the pixel 10.

The first monitor light emitting element 66 is formed in the same step with the same conditions so as to have the same configuration as the first light emitting element 13. Therefore, the first monitor light emitting element 66 and the first light emitting element 13 have the same or almost the same characteristics against a change in an environmental temperature and deterioration with time. The first monitor light emitting element 66 is connected to the power source 18. Here, the power source connected to the first light emitting element 13 and the power source connected to the first monitor light emitting element 66 have the same potentials; therefore, they are expressed as the power source 18 with the same reference numeral. It is to be noted in this embodiment mode that the first monitor controlling transistor 111 has p-channel conductivity, however, the invention is not limited to this and the first monitor controlling transistor 111 may have an n-channel conductivity as well. In that case, a circuit configuration in the periphery is appropriately changed.

The second monitor light emitting element 166, the second monitor controlling transistor 115, and the second inverter 116 are similar to the aforementioned. The second monitor light emitting element 166 is formed in the same step with the same conditions so as to have the same configuration as the second light emitting element 14. Therefore, the second monitor light emitting element 166 and the second light emitting element 14 have the same or almost the same characteristics against a change in an environmental temperature and deterioration with time. The second monitor light emitting element 166 is connected to the power source 18. Here, the power source connected to the second light emitting element 14 and the power source connected to the second monitor light emitting element 166 have the same potentials; therefore, they are expressed as the power source 18 with the same reference numeral. It is to be noted in this embodiment mode that the second monitor controlling transistor 115 has p-channel conductivity, however, the invention is not limited to this and the second monitor controlling transistor 115 may have an n-channel conductivity as well. In that case, a circuit configuration in the periphery is appropriately changed.

A position to provide the monitor circuit 64 is not limited, and it may be provided between the signal line driver circuit 43 and the pixel portion 40 or between the first or the second scan line driver circuit 41 or 42 and the pixel portion 40.

A buffer amplifier circuit 110 is provided between the monitor circuit 64 and the pixel portion 40. The buffer amplifier circuit has such features that an input and an output have the same potentials, with high input impedance and high output current capacitance. Therefore, a circuit configuration can be appropriately determined as long as the circuit has such features.

In such a configuration, the buffer amplifier circuit has a function to change a voltage applied to the first light emitting element 13 and the second light emitting element 14 included in the pixel portion 40 in accordance with a change in potential of one electrode of each of the first monitor light emitting element 66 and the second monitor light emitting element 166.

In such a configuration, the constant current source 105 and the buffer amplifier circuit 110 in a control circuit 100 may be provided over the same insulating substrate 20 or different substrates.

In the aforementioned configuration, a constant current is supplied from the constant current source 105 to the first monitor light emitting element 66 and the second monitor light emitting element 166. When an environmental temperature changes or deterioration with time occurs in such a state, the resistance of the first monitor light emitting element 66 and the second monitor light emitting element 166 change. For example, when deterioration with time occurs, the resistance of the first monitor light emitting element 66 and the second monitor light emitting element 166 increase. As a result, potential differences between opposite ends of the first monitor light emitting element 66 and the second monitor light emitting element 166 change since current values supplied to the first monitor light emitting element 66 and the second monitor light emitting element 166 are constant. In specific, potential differences between opposite electrodes of the first monitor light emitting element 66 and the second monitor light emitting element 166 change. At this time, a potential of the electrode connected to the power source 18 is fixed, therefore, a potential of an electrode connected to the constant current source 105 changes. This change in potential of the electrode is supplied to the buffer amplifier circuit 110 through the power supply line 113.

In other words, a change in potential of the aforementioned electrode is inputted to the input terminal of the buffer amplifier circuit 110. Moreover, a potential outputted from the output terminal of the buffer amplifier circuit 110 is supplied to the first light emitting element 13 and the second light emitting element 14 through the first driving transistor 12 and the second driving transistor 114. In specific, the outputted potential is given as a potential of one electrode of the first light emitting element 13 and the second light emitting element 14.

In this manner, changes of the first monitor light emitting element 66 and the second monitor light emitting element 166 caused by an environmental temperature change and deterioration with time are fed back to the first light emitting element 13 and the second light emitting element 14. As a result, the first light emitting element 13 and the second light emitting element 14 can emit light at luminance in accordance with the environmental temperature change and deterioration with time. Therefore, a display device which can perform display independent of an environmental temperature change and deterioration with time can be provided.

Further, as a plurality of the first monitor light emitting elements 66 and the second monitor light emitting elements 166 are provided, these potential changes can be averaged and supplied to the first light emitting element 13 and the second light emitting element 14. That is, in the invention, it is preferable to provide a plurality of the first monitor light emitting elements 66 and the second monitor light emitting elements 166 since potential changes can be averaged. Further, by providing a plurality of the first monitor light emitting elements 66 and the second monitor light emitting elements 166, one monitor light emitting element can be a substitute for a shorted monitor light emitting element.

It is preferable to provide the first inverter 112 and the second inverter 116 in addition to the first monitor controlling transistor 111 and the second monitor controlling transistor 115 connected to the first monitor light emitting element 66 and the second monitor light emitting element 166 respectively. These inverters are provided in consideration of an operation defect of the monitor circuit 64 caused by a defect (including an initial defect or a defect occurring with time) of the first monitor light emitting element 66 and the second monitor light emitting element 166. For example, in the case where the constant current source 105 and the first monitor controlling transistor 111 and the second monitor controlling transistor 115 are connected without any other transistors or the like, an anode and a cathode of a certain first monitor light emitting element 66 and a certain second monitor light emitting element 166 are shorted (short-circuit) among a plurality of monitor light emitting elements due to a defect in a manufacturing step or the like. Then, a current supplied from the constant current source 105 is supplied more to the shorted first monitor light emitting element 66 and the shorted second monitor light emitting element 166 through the power supply line 113. As the plurality of monitor light emitting elements are connected in parallel, if more current is supplied to the shorted first monitor light emitting element 66 and the shorted second monitor light emitting element 166, a predetermined constant current is not supplied to the other monitor light emitting elements. As a result, an appropriate potential change of the first monitor light emitting element 66 and the second monitor light emitting element 166 cannot be supplied to the first light emitting element 13 and the second light emitting element 14.

A short-circuit of the monitor light emitting element means that an anode and a cathode of the monitor light emitting element have the same potentials. For example, a short-circuit could occur due to a dust or the like between an anode and a cathode in the manufacturing step. Moreover, in addition to the short-circuit between the anode and the cathode, the monitor light emitting element could be shorted due to a short-circuit between a scan line and an anode, or the like.

In view of this, in this embodiment mode, the first inverter 112 and the second inverter 116 are provided in addition to the first monitor controlling transistor 111 and the second monitor controlling transistor 115. The first monitor controlling transistor 111 and the second monitor controlling transistor 115 block a current supply to the first monitor light emitting element 66 and the second monitor light emitting element 166 in order to prevent a large amount of current supply due to a short-circuit or the like of the first monitor light emitting element 66 and the second monitor light emitting element 166 as described above. That is, a shorted monitor light emitting element and a monitor line are electrically cut off.

The first inverter 112 and the second inverter 116 have a function to output a potential to turn off a monitor controlling transistor when any of the plurality of monitor light emitting elements is shorted. In addition, the first inverter 112 and the second inverter 116 have a function to turn on the monitor controlling transistor when none of the plurality of monitor light emitting elements is shorted.

Figure 6A:
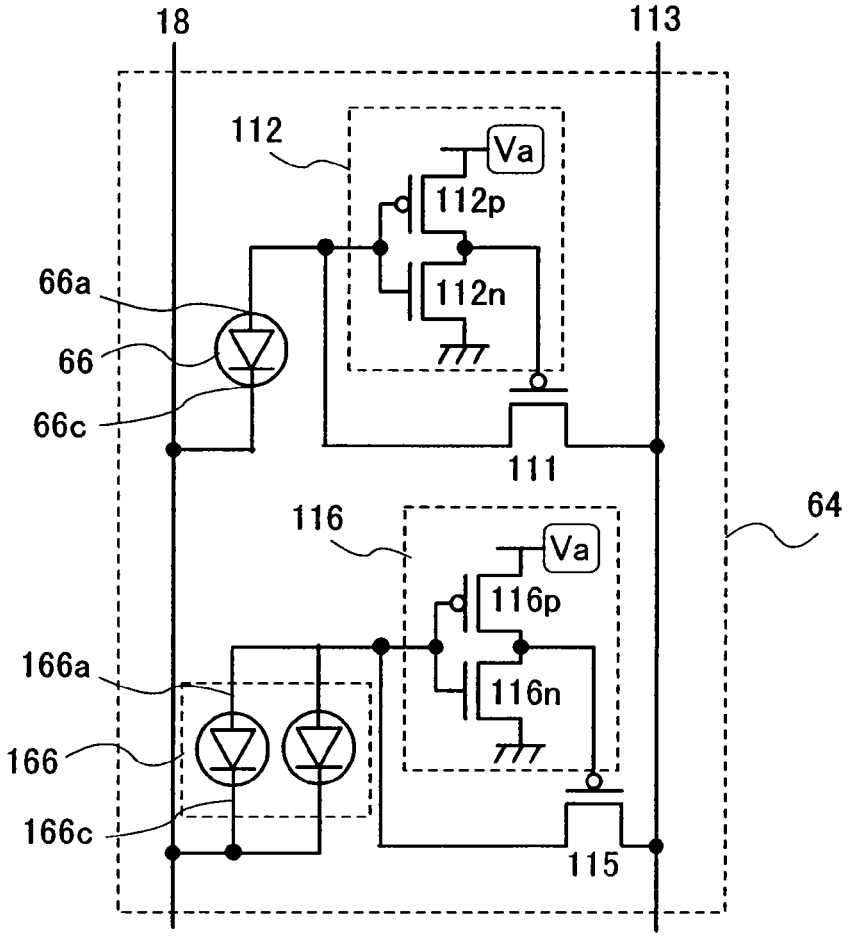
FIGS. 6A and 6B are views showing a monitor circuit of the invention.
Figure 6B:
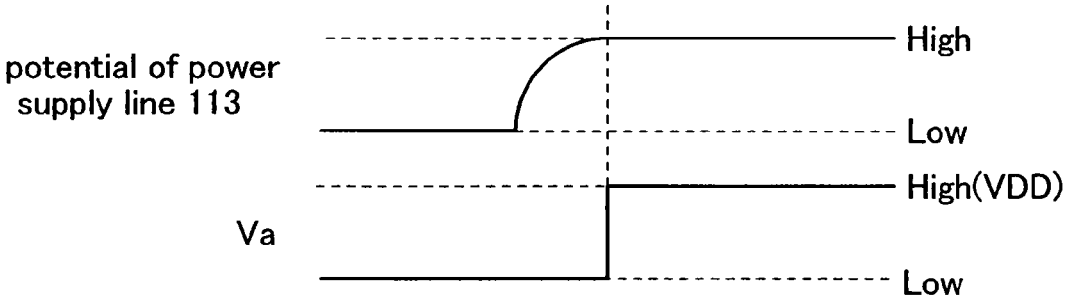

A specific operation of the monitor circuit 64 is described with reference to FIGS. 6A and 6B. As shown in FIG. 6A, when an electrode on a high potential side of the first monitor light emitting element 66 is an anode electrode 66*a* and an electrode on a low potential side is a cathode electrode 66*c*, the anode electrode 66*a* is connected to an input terminal of the first inverter 112 and the cathode electrode 66*c* is connected to the power source 18 and has a fixed potential. Therefore, when an anode and a cathode of the first monitor light emitting element 66 are shorted, a potential of the anode electrode 66*a* becomes close to that of the cathode electrode 66*c*. As a result, a low potential close to the potential of the cathode electrode 66*c* is supplied to the first inverter 112, therefore, a p-channel transistor 112*p* included in the first inverter 112 is turned on. Then, a potential (Va) on a high potential side is outputted from the first inverter 112 and applied as a gate potential of the first monitor controlling transistor 111. That is, the potential inputted to the gate of the first monitor controlling transistor 111 becomes Va and the first monitor controlling transistor 111 is turned off.

Similarly, when an electrode on a high potential side of the second monitor light emitting element 166 is an anode electrode 166*a* and an electrode on a low potential side is a cathode electrode 166*c*, the anode electrode 166*a* is connected to an input terminal of the second inverter 116 and the cathode electrode 166*c* is connected to the power source 18 and has a fixed potential. Therefore, when an anode and a cathode of the second monitor light emitting element 166 are shorted, a potential of the anode electrode 166*a* becomes close to that of the cathode electrode 166*c*. As a result, a low potential close to the potential of the cathode electrode 166*c* is supplied to the second inverter 116, therefore, a p-channel transistor 116*p* included in the second inverter 116 is turned on. Then, a potential (Va) on a high potential side is outputted from the second inverter 116 and applied as a gate potential of the second monitor controlling transistor 115. That is, the potential inputted to the gate of the second monitor controlling transistor 115 becomes Va and the second monitor controlling transistor 115 is turned off.

It is to be noted that VDD to be a high potential (High) is set equal to or higher than an anode potential. Moreover, a low potential (Low) of the first inverter 112 and the second inverter 116, a potential of the power source 18, a potential on a low side of the power supply line 113, and a potential on a low side applied to Va can be all set equal. In general, the low side potential is set at ground. However, the invention is not limited to this and the low side potential may be determined so as to have a predetermined potential difference from a high side potential. The predetermined potential difference may be determined depending on a current, a voltage, luminance characteristics of a light emission material or the specifications of a device.

Here, an order to supply a constant current to the first monitor light emitting element 66 and the second monitor light emitting element 166 is required to be paid attention to. A constant current is required to start to be supplied to the power supply line 113 when the first monitor controlling transistor 111 and the second monitor controlling transistor 115 are on. In this embodiment mode, as shown in FIG. 6B, a current starts to be supplied to the power supply line 113 with Va remaining Low. After the potential of the power supply line 113 is saturated, Va is set to be VDD. As a result, a capacitor and parasitic capacitance attached to the power supply line 113 can be charged even when the first monitor controlling transistor 111 and the second monitor controlling transistor 115 are on.

Meanwhile, in the case where the first monitor light emitting element 66 and the second monitor light emitting element 166 are not shorted, potentials of the anode electrode 66*a* and the anode electrode 166*a* are supplied to the first inverter 112 and the second inverter 116. Therefore, n-channel transistors 112*n* and 116*n* are turned on. As a result, a potential on a low potential side is outputted from the first inverter 112 and the second inverter 116, thereby the first monitor controlling transistor 111 and the second monitor controlling transistor 115 are turned on.

In this manner, a current supply from the constant current source 105 to a shorted monitor light emitting element can be blocked. Therefore, when a monitor light emitting element is shorted in the case where there are a plurality of monitor light emitting elements, by blocking a current supply to the shorted monitor light emitting element, a potential change of the power supply line 113 can be suppressed to be the least. As a result, an appropriate potential change of the first monitor light emitting element 66 and the second monitor light emitting element 166 can be supplied to the first light emitting element 13 and the second light emitting element 14.

It is to be noted in this embodiment mode that the constant current source 105 is only required to be a circuit which can supply a constant current. For example, the constant current source 105 can be formed of a transistor. In this embodiment mode, a monitor circuit 64 includes a plurality of monitor light emitting elements, monitor controlling transistors, and inverters; however, the invention is not limited to this. For example, the inverter may be any circuit which has a function to block a current supply to a shorted monitor light emitting element through a monitor line when detecting a short-circuit of the monitor light emitting element. In specific, a function to turn off the monitor controlling transistor for blocking a current supply to the shorted monitor light emitting element is only required.

Further, in this embodiment mode, a plurality of monitor light emitting elements are used. In this case, even when one of the monitor elements generates an operation defect, other operating monitor elements can monitor characteristics change of light emitting elements due to an environmental temperature change and deterioration with time; thereby the luminance of the light emitting element in the pixel 10 can be corrected.

In this embodiment mode, the buffer amplifier circuit 110 is provided for preventing a potential change. Therefore, another circuit capable of preventing a potential change may be used instead of the buffer amplifier circuit 110. That is, in the case of providing a circuit for preventing a potential change between the first monitor light emitting element 66 and the second monitor light emitting element 166, and the first light emitting element 13 and the second light emitting element 14 when applying the potential of one electrode of the first monitor light emitting element 66 and the second monitor light emitting element 166 to the first light emitting element 13 and the second light emitting element 14 respectively, such a circuit is not limited to the buffer amplifier circuit 110 and a circuit with any configuration such as an operational amplifier circuit may be used.

Figure 2:
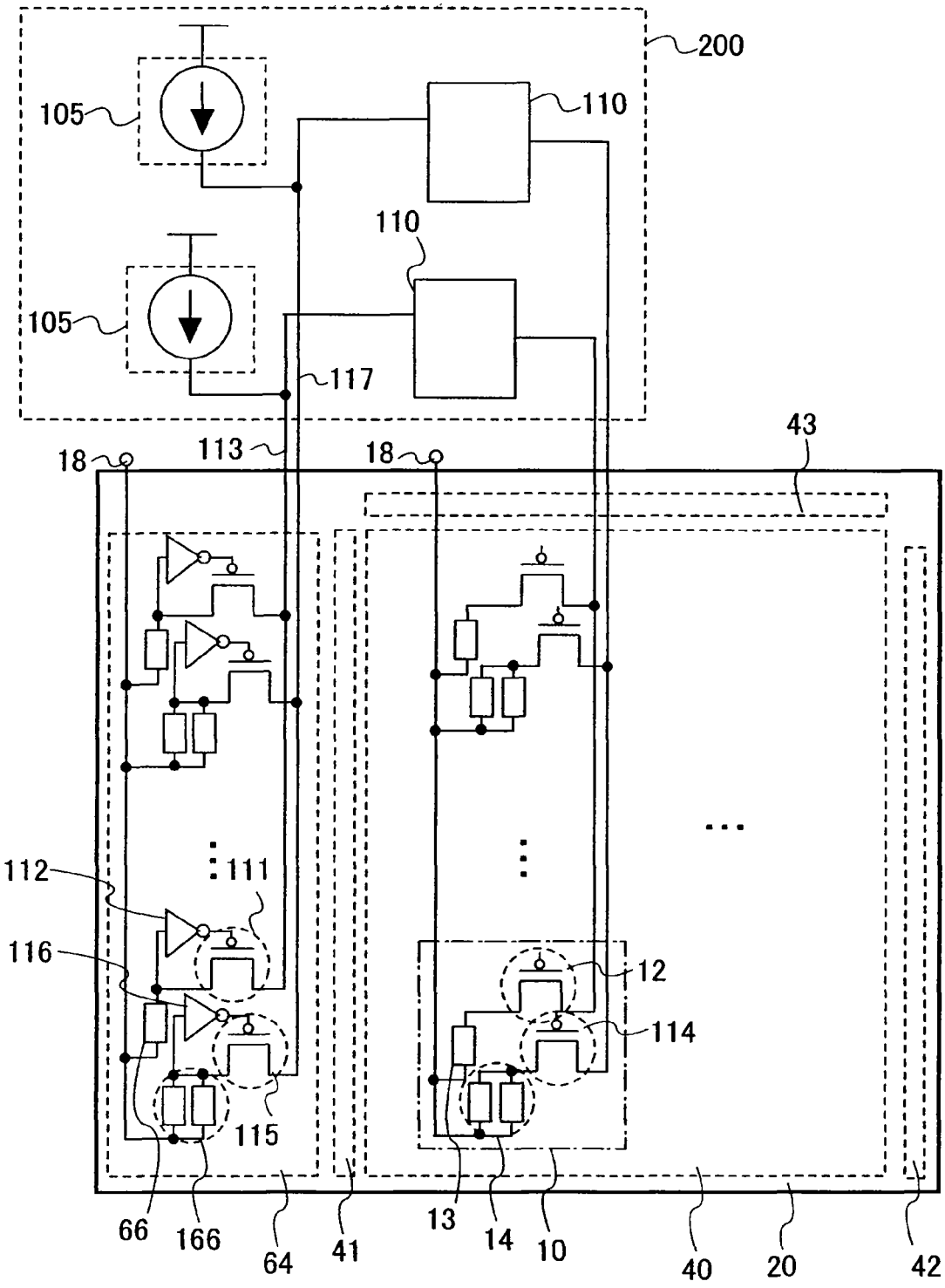
FIG. 2 is a diagram showing a display device of the invention.

Here, in this embodiment mode, other circuit configurations are described with reference to FIG. 2. A circuit configuration shown in FIG. 2 has the same arrangement of elements in each of the pixels 10 and the monitor circuit 64 as that in FIG. 1, however, a power source is connected differently from FIG. 1. That is, a power supply line 117 is provided in addition to the power supply line 113 which is used in common in FIG. 1 so that each subpixel can be driven with an independent power source. In this manner, in this embodiment mode, a power supply line may be independently connected for each subpixel. In that case, each power source may independently have the constant current source 105 and the buffer amplifier circuit 110.

In this manner, providing a power supply line, and the constant current source 105 and the buffer amplifier circuit 110 in a control circuit 200, which are connected to the power supply line in each subpixel is advantageous in that a current value supplied to the monitor element can be set for each subpixel, thereby the precision of correction can be improved. In the case of performing an area grayscale display by using a subpixel as described in this embodiment mode, characteristics of the first light emitting element 13 and the second light emitting element 14 can be set different. For example, when the luminance of a light emitting element of one subpixel becomes twice as high as the other subpixel in the case where the same voltage is applied to the both subpixels, four grayscales with a luminance ratio of 0, 1, 2, and 3 can be displayed without changing a driving voltage or a light emission duty. In this manner, when the characteristics of the light emitting element in each subpixel are different, the characteristics do not always change in the same way by deterioration and temperature. Therefore, the change in characteristics of a combination of elements with different characteristics become quite complicated. In order to perform correction more accurately, it is effective to group elements with similar characteristics. More accurate correction can be achieved when a power supply line, and the constant current source 105 and the buffer amplifier circuit 110 connected thereto are provided in each subpixel and the characteristics of the first monitor light emitting element 66 and the second monitor light emitting element 166 are the same as those of the pixel 10.

It is to be noted in this embodiment mode that two subpixels are provided, however, the number of subpixels is not limited to this. Any number of subpixels may be provided as long as they are connected in parallel.

Embodiment Mode 2

In this embodiment mode, description is made of a circuit configuration and an operation to turn off a monitor controlling transistor when a monitor light emitting element is shorted, which is different from the aforementioned embodiment mode. It is to be noted that a pixel circuit including a subpixel is described in Embodiment Mode 1, however, in this embodiment mode, description is made of a circuit configuration to turn off a monitor controlling transistor when a monitor light emitting element provided in each subpixel is shorted. Therefore, description is made for each subpixel and description will not be repeated.

Figure 7A:
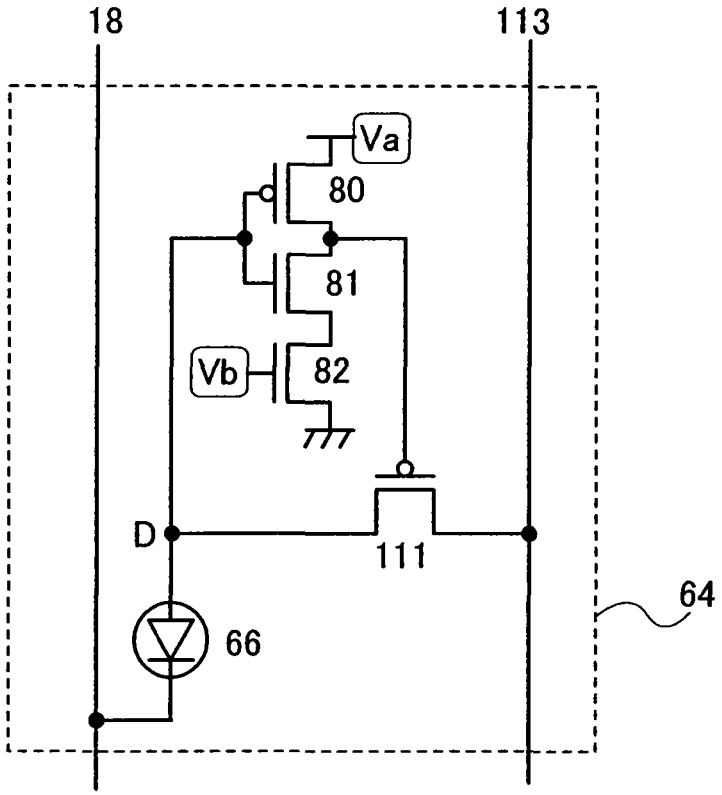
FIGS. 7A and 7B are views showing a monitor circuit of the invention.

The monitor circuit 64 shown in FIG. 7A includes a p-channel first transistor 80, an n-channel second transistor 81 connected in parallel to the first transistor 80 with a common gate electrode, and an n-channel third transistor 82 connected in series to the second transistor 81. The monitor light emitting element 66 is connected to gate electrodes of first and second transistors 80 and 81. A gate electrode of a monitor controlling transistor 111 is connected to an electrode to which the first and second transistors 80 and 81 are connected. Other configurations are similar to the monitor circuit 64 shown in FIG. 6A, however, only a subpixel including the monitor controlling transistor 111 and the monitor light emitting element 66 is shown.

Figure 7B:
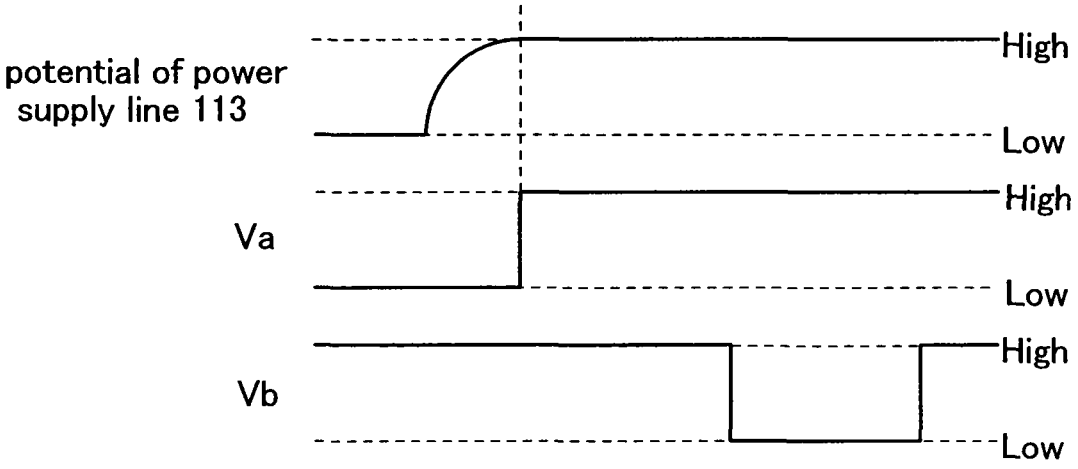

Further, a potential on a high potential side of the first p-channel transistor 80 is set at Va and a potential of a gate electrode of the n-channel third transistor 82 is set at Vb. Then, the potential of the power supply line 113 and the potentials of Va and Vb are operated as shown in FIG. 7B.

First, the capacitor and the parasitic capacitance attached to the power supply line 113 are completely charged. After that, the potential of Va is set High. In the case where the monitor light emitting element 66 is shorted, a potential of an anode of the monitor light emitting element 66, that is a potential of a node D is decreased almost as low as that of a cathode of the monitor light emitting element 66. Then, a low potential, which is Low is inputted to the gate electrodes of the first and second transistors 80 and 81, thereby the n-channel second transistor 81 is turned off and the p-channel first transistor 80 is turned on. Then, a high side potential of a potential of the first transistor 80 is inputted to the gate electrode of the monitor controlling transistor 111, thereby the monitor controlling transistor 111 is turned off. As a result, a current from the power supply line 113 is not supplied to the shorted monitor light emitting element 66.

At this time, when a shorted state is slight and the potential of the anode is slightly decreased, it is sometimes hard to control either the first or second transistor 80 or 81 to be turned on or off. Therefore, the potential of Vb is supplied to a gate electrode of the third transistor 82 as shown in FIG. 7B. In other words, the potential of Vb is set Low while Va is High as shown in FIG. 7B. Then, the n-channel third transistor 82 is turned off. As a result, when the potential of the anode is a potential lower than VDD by a threshold voltage of the first transistor, the first transistor 80 can be turned on and the monitor controlling transistor 111 can be turned off.

By controlling the potential of Vb in this manner, the monitor controlling transistor 111 can be accurately turned off even in the case where the potential of the anode is slightly decreased. It is to be noted that when the monitor light emitting element operates normally, Vb is controlled so that the monitor controlling transistor 111 is turned on. That is, the potential of the anode becomes almost the same as the high potential of the power supply line 113; therefore, the second transistor 81 is turned on. As a result, a low potential is applied to the gate electrode of the monitor controlling transistor 111, and it is turned on.

Figure 8A:
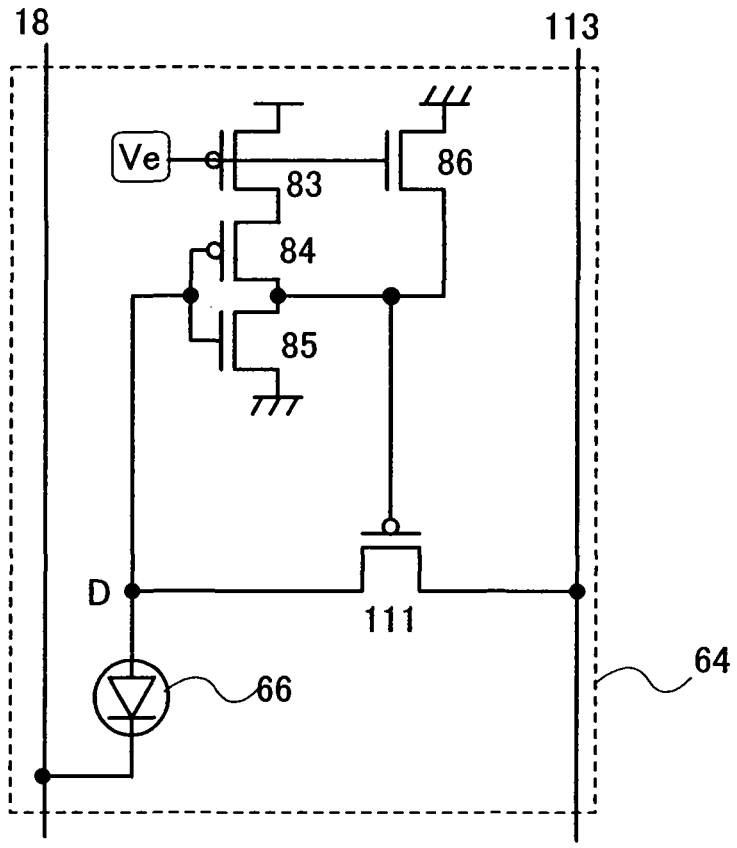
FIGS. 8A and 8B are views showing a monitor circuit of the invention.
Figure 8B:
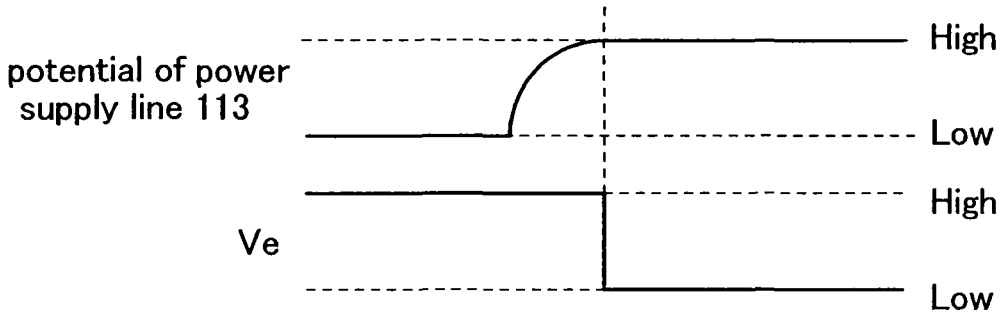

As shown in FIG. 8A, a p-channel first transistor 83, a p-channel second transistor 84 connected in series to the first transistor 83, an n-channel third transistor 85 having a gate electrode in common with the second transistor 84, and an n-channel fourth transistor 86 connected in parallel to the first transistor 83 with a gate electrode in common are provided. The monitor light emitting element 66 is connected to gate electrodes of the second and third transistors 84 and 85. The gate electrode of the monitor controlling transistor 111 is connected to an electrode to which the second and third transistors 84 and 85 are connected. Further, the gate electrode of the monitor controlling transistor 111 is connected to one electrode of the fourth transistor 86. Other configurations are similar to the monitor circuit 64 shown in FIG. 6A.

First, the capacitor and the parasitic capacitance attached to the power supply line 113 are completely charged. After that, a potential of Ve is set Low. In the case where the monitor light emitting element 66 is shorted, a potential of the anode of the monitor light emitting element 66, that is a potential of a node D is decreased almost as low as that of the cathode of the monitor light emitting element 66. Then, a low potential, which is Low is inputted to the gate electrodes of the second and third transistors 84 and 85, thereby the n-channel third transistor 85 is turned off and the p-channel second transistor 84 is turned on. When the potential of Ve is set Low, the first transistor 83 is turned on and the fourth transistor 86 is turned off. Then, a high side potential of a potential of the first transistor is inputted to the gate electrode of the monitor controlling transistor 111 through the second transistor 84, thereby the monitor controlling transistor 111 is turned off. As a result, a current from the power supply line 113 is not supplied to the shorted monitor light emitting element 66. By controlling the voltage Ve of the gate electrode in this manner, the monitor controlling transistor 111 can be accurately turned off.

Embodiment Mode 3

A reverse bias voltage can be applied to a light emitting element and a monitor light emitting element. In this embodiment mode, description is made of the case of applying a reverse bias voltage.

When a voltage applied so that the light emitting element 13 and the monitor light emitting element 66 emit light is called a forward voltage, a reverse bias voltage is a voltage obtained by inverting a high side potential and a low side potential of the forward voltage. In specific, in the monitor light emitting element 66, the potential of the power supply line 113 is set lower than the potential of the power source 18 so as to invert the potentials of the anode electrode 66*a* and the cathode electrode 66*c*.

Figure 14:
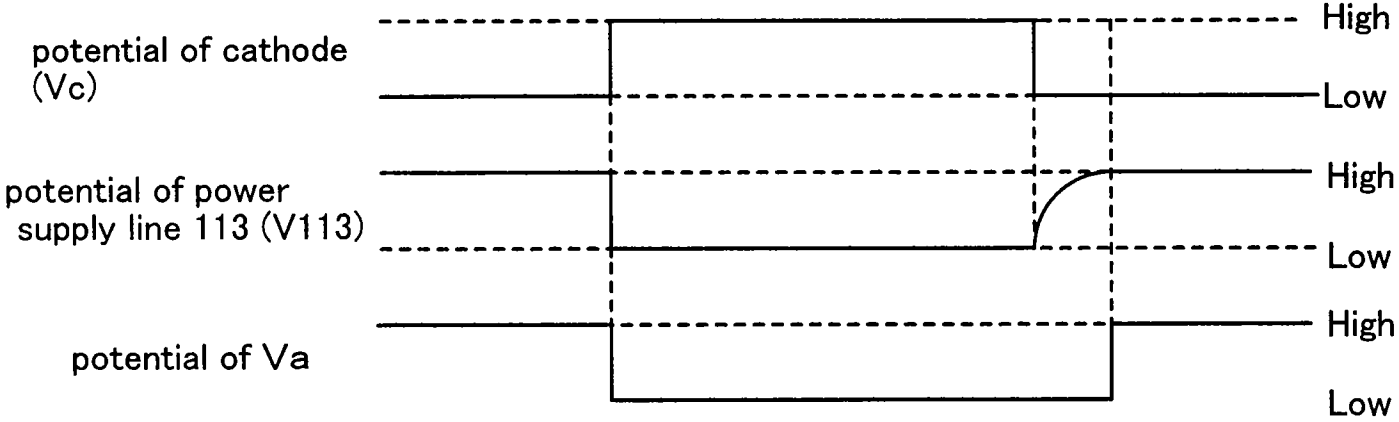
FIG. 14 is a timing chart of the invention.

In specific, as shown in FIG. 14, the potential of the anode electrode 66*a* (anode potential: Va) and the potential of the cathode electrode 66*c* (cathode potential: Vc) are set at Low potentials. At this time, the potential of the power supply line 113 (V113) is inverted at the same time. A period in which the anode potential and the cathode potential are inverted is called a reverse bias voltage applying period. Then, the cathode potential is brought back after a predetermined reverse bias voltage applying period passes and a certain current is supplied through the power supply line 113, thereby charging is completed. That is, after the voltage is saturated, the potential is brought back. At this time, the potential of the power supply line 113 is brought back in a curved shape because a constant current is used for charging a plurality of the monitor light emitting elements and further the parasitic capacitance.

It is preferable to invert an anode potential prior to inverting a cathode potential. Then, after a predetermined reverse bias voltage applying period passes, the anode potential is brought back and then the cathode potential is brought back. At the same time as when the anode potential is inverted, the potential of the power supply line 113 is charged to be High.

In this reverse bias voltage applying period, the driving transistor 12 and the monitor controlling transistor 111 are required to be turned on.

As a result of applying a reverse bias voltage to the light emitting element, defective states of the light emitting element 13 and the monitor light emitting element 66 can be improved, which leads to improved reliability. Moreover, an initial defect may occur in the light emitting element 13 and the monitor light emitting element 66 in that an anode and a cathode are shorted due to a foreign substance, a pinhole caused by a minute projection of the anode or the cathode or unevenness of a light emitting layer. Such an initial defect prevents light emission and non-light emission in accordance with signals, and most of the current flows to the shorted element. As a result, display of an image cannot be performed favorably. Moreover, this defect may occur in an arbitrary pixel.

When a reverse bias voltage is applied to the light emitting element 13 and the monitor light emitting element 66 as in this embodiment mode, a current flows locally to a shorted portion, thereby the shorted portion generates heat and can be oxidized or carbonized. Consequently, the shorted portion can be insulated. A current flows to other regions than the insulated portion, and the light emitting element 13 and the monitor light emitting element 66 can operate normally. By applying a reverse bias voltage in this manner, an initial defect can be fixed if generated. It is to be noted that such a short-circuit portion is preferably insulated before shipment.

Moreover, not only an initial defect, but an anode and a cathode may be newly shorted as time passes. Such a defect is also called a progressive defect. In view of this, as in this invention, a reverse bias voltage is applied to the light emitting element 13 and the monitor light emitting element 66 regularly. As a result, a progressive defect can be fixed if generated. Thus, the light emitting element 13 and the monitor light emitting element 66 can operate normally.

In addition, by applying a reverse bias voltage, image sticking can be prevented. Image sticking is caused by the deterioration of the light emitting element 13. The deterioration can be lowered by applying a reverse bias voltage. As a result, image sticking can be prevented.

In general, the deterioration of the light emitting element 13 and the monitor light emitting element 66 progresses at a faster rate in the initial period, and the progress rate thereof decreases with time. That is, in the light emitting element 13 and the monitor light emitting element 66 which have already deteriorated in a pixel, further deterioration hardly occurs. As a result, variations are generated in each light emitting element 13. In view of this, all the light emitting elements 13 and the monitor light emitting elements 66 may emit light before shipment, when displaying no image, or the like. By generating deterioration in a pixel which has not deteriorated in this manner, the deterioration levels of all the pixels can be averaged. As described above, a structure of lighting all pixels may be provided in a display device.

Embodiment Mode 4

Figure 3:
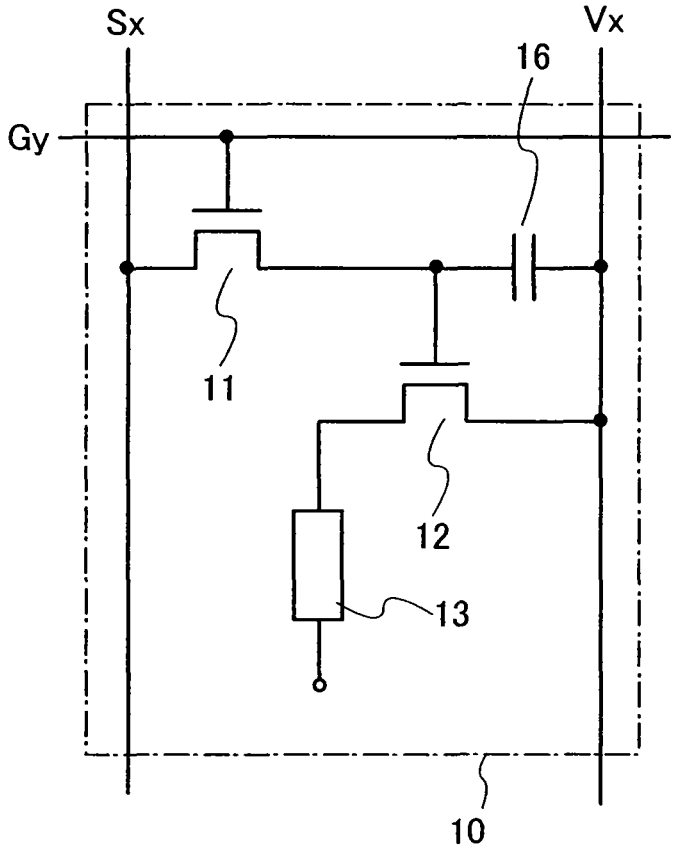
FIG. 3 is a diagram showing an equivalent circuit of a pixel of the invention.

In this embodiment mode, examples of a pixel circuit and configuration are described. FIG. 3 shows a pixel circuit which can be applied to a pixel portion of the invention. In the pixel portion 40, a data line Sx, a gate line Gy, and a power supply line Vx are provided in matrix, in which pixels 10 are provided at intersections thereof. The pixel 10 includes a switching transistor 11, a driving transistor 12, a capacitor 16, and a light emitting element 13.

Connections in the pixel are described. The switching transistor 11 is provided at an intersection of the data line Sx and the gate line Gy. One electrode of the switching transistor 11 is connected to the signal line Sx and a gate electrode of the switching transistor 11 is connected to the gate line Gy. One electrode of the driving transistor 12 is connected to the power supply line Vx and a gate electrode thereof is connected to the other electrode of the switching transistor 11. A capacitor 16 is provided so as to hold a gate-source voltage of the driving transistor 12. In this embodiment mode, the capacitor 16 has one electrode connected to Vx and the other electrode connected to the gate electrode of the driving transistor 12. It is to be noted that the capacitor 16 is not required to be provided in the case where the gate capacitance of the driving transistor 12 is large and there is few leak current. The light emitting element 13 is connected to the other electrode of the driving transistor 12.

A driving method of such a pixel is described. First, when the switching transistor 11 is turned on, a video signal is inputted from the signal line Sx. A charge is accumulated in the capacitor 16 based on the video signal. When the charge accumulated in the capacitor 16 becomes higher than a gate-source voltage (Vgs) of the driving transistor 12, the driving transistor 12 is turned on. Then, a current is supplied to the light emitting element 13 and it emits light. At this time, the driving transistor 12 can operate in a linear region or a saturation region. In the saturation region, the driving transistor 12 can supply a constant current. In the linear region, the driving transistor 12 can operate at a low voltage; thereby low power consumption can be achieved.

Figures 9A, 9B:
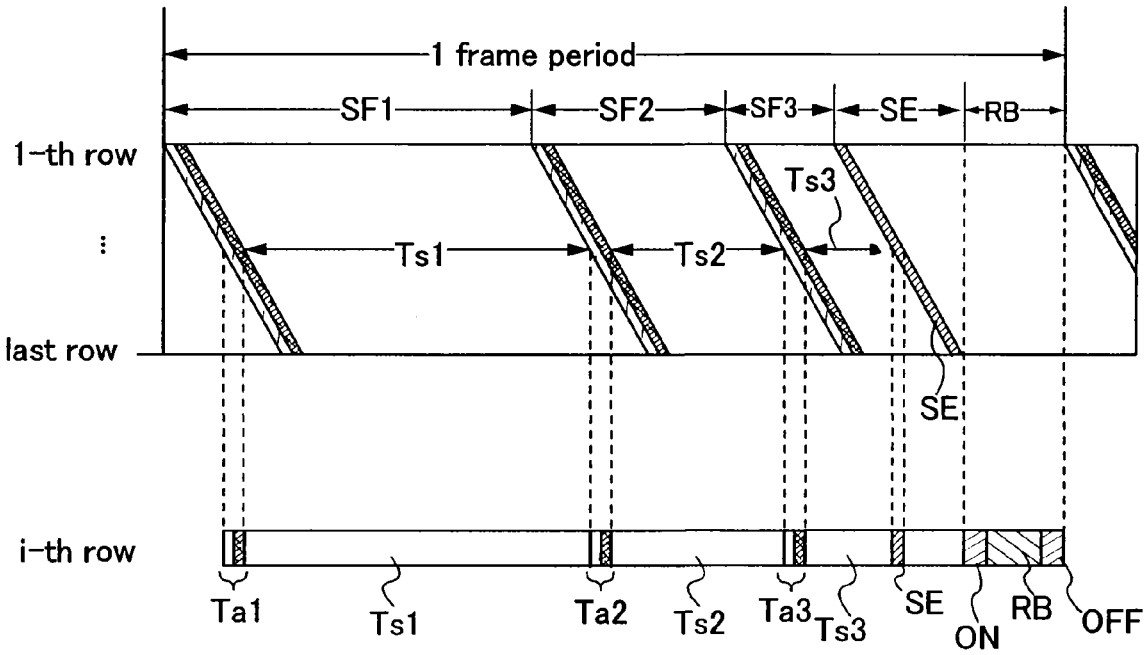
FIGS. 9A and 9B are timing charts of the invention.

Hereinafter, a driving method of a pixel is described with reference to a timing chart. FIG. 9A is a timing chart of one frame period in the case where an image is rewritten 60 frames a second. A longitudinal axis indicates a scan line (first to last rows) and a horizontal axis indicates time in the timing chart.

One frame period includes m (m is a natural number of 2 or larger) subframe periods SF1, SF2, . . . , and SFm. The m subframe periods SF1, SF2, . . . , and SFm each has writing operation periods Ta1, Ta2, . . . , and Tam, display periods (light emission periods) Ts1, Ts2, . . . , and Tsm, and a reverse bias voltage applying period. In this embodiment mode, as shown in FIG. 9A, one frame period includes subframe periods SF1, SF2, and SF3 and a reverse bias voltage applying period (RB). In each subframe period, the writing operation periods Ta1 to Ta3 are sequentially performed, which are followed by the display periods Ts1 to Ts3 respectively.

A timing chart shown in FIG. 9B includes a writing operation period, a display period, and a reverse bias voltage applying period of a certain row (i-th row). After the writing operation period and the display period are alternately performed, the reverse bias voltage applying period starts. The period including the writing operation period and the display period becomes a forward voltage applying period.

The writing operation period Ta can be divided into a plurality of operation periods. In this embodiment mode, the writing operation period Ta is divided into two operation periods, in which an erasing operation is performed in one period and a writing operation is performed in the other period. In this manner, a WE (Write Erase) signal is inputted in order to provide an erasing operation and a writing operation. Other erasing operations and writing operations, and signals are specifically described in the following embodiment mode. Moreover, right before the reverse bias voltage applying period, a period to simultaneously turn on the switching transistors in all pixels, that is a period (On period) to turn on all scan lines is provided.

It is preferable to provide a period to simultaneously turn off the switching transistors in all pixels, that is a period (Off period) to turn off all scan lines immediately after the reverse bias voltage applying period. Moreover, an erasing period (SE) is provided right before the reverse bias voltage applying period. The erasing period can be performed by a similar operation to the aforementioned erasing operation. In the erasing period, operations to sequentially erase the data written in the preceding subframe period, which is SF3 in this embodiment mode are sequentially performed. In the on-period, the switching transistors are turned on all at once after the display period of the pixel in the last row is terminated. Therefore, a pixel of the first row has an unnecessary display period.

The control for providing such an On period, an Off period, and an erasing period is carried out by driver circuits such as a scan line driver circuit and a signal line driver circuit. Note that the timing to apply a reverse bias voltage to the light emitting element 13, namely the reverse bias voltage applying period is not limited to those shown in FIGS. 9A and 9B. That is to say, the reverse bias voltage applying period is not necessarily provided for each frame period, nor in the latter part of one frame period. The On period is only required to be provided immediately before the applying period (RB) and the Off period is only required to be provided immediately after the applying period (RB). In addition, the order of inverting the voltages of the anode and the cathode of the light emitting element is not limited to those shown in FIGS. 9A and 9B. That is, the potential of the anode electrode may be decreased after the potential of the cathode electrode is increased.

Figure 4:
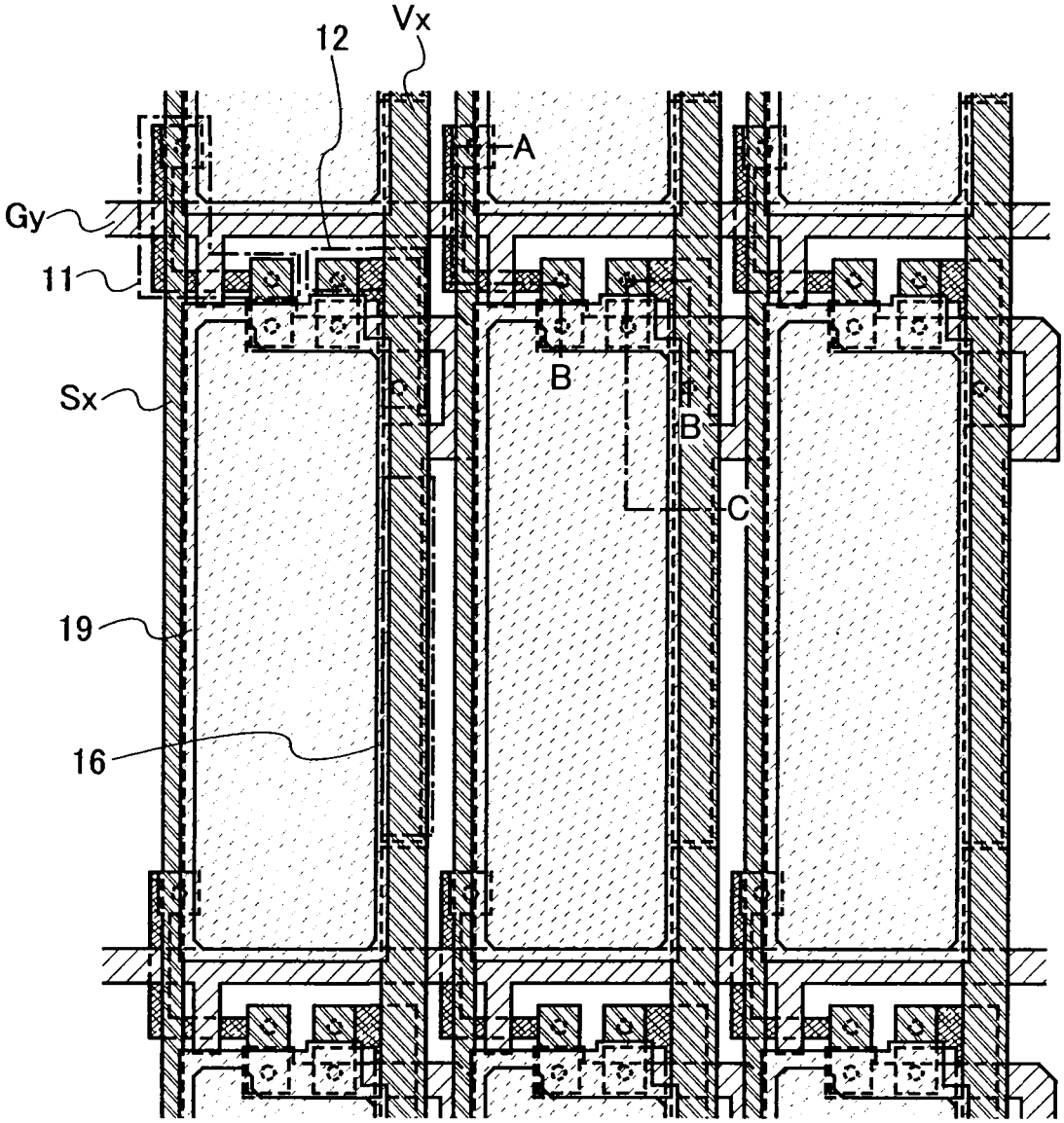
FIG. 4 is a diagram showing a layout of a pixel of the invention.

FIG. 4 shows a layout example of the pixel circuit shown in FIG. 3. A semiconductor film is formed to constitute the switching transistor 11 and the driving transistor 12. Then, a first conductive film is formed with an insulating film functioning as a gate insulating film interposed therebetween. The conductive film is used as gate electrodes of the switching transistor 11 and the driving transistor 12, and can also be used as a gate line Gy. At this time, the switching transistor 11 preferably has a double gate structure.

Subsequently, a second conductive film is formed with an insulating film functioning as an interlayer insulating film interposed therebetween. The conductive film is used as drain and source wires of the switching transistor 11 and the driving transistor 12, and can also be used as the signal line Sx and the power supply line Vx. At this time, the capacitor 16 can be formed by stacking the first conductive film, the insulating film functioning as an interlayer insulating film, and the second conductive film. The gate electrode of the driving transistor 12 is connected to the other electrode of the switching transistor through a contact hole.

A first electrode 19 (pixel electrode) is formed in an opening provided in the pixel. The pixel electrode is connected to the other electrode of the driving transistor 12. If an insulating film or the like is formed between the second conductive film and the pixel electrode at this time, the pixel electrode is required to be connected to the other electrode of the driving transistor 12 through a contact hole. If an insulating film or the like is not formed, the pixel electrode can be connected directly to the other electrode of the driving transistor 12.

In the layout as shown in FIG. 4, the first conductive film and the pixel electrode may overlap in order to achieve a high aperture ratio. In such an area, coupling capacitance may occur. Such coupling capacitance is unwanted capacitance.

Figure 5:
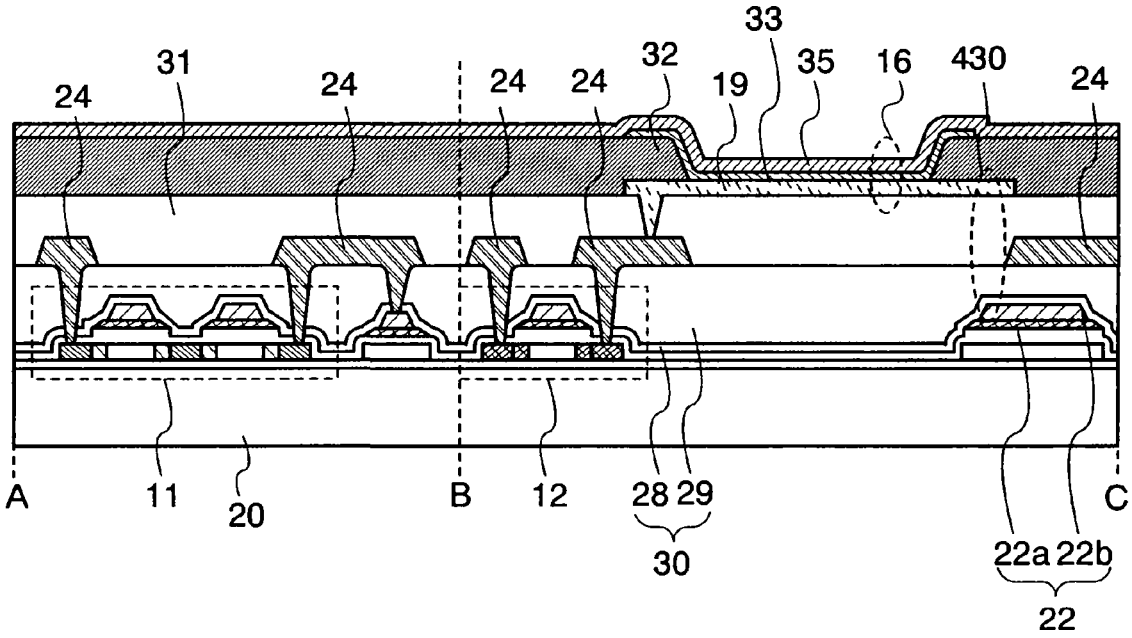
FIG. 5 is a view showing a cross section of a pixel of the invention.

FIG. 5 is a cross sectional view taken along A-B and B-C in FIG. 4. A semiconductor film is formed over the insulating substrate 20 with a base film interposed therebetween. As the insulating substrate 20, a glass substrate formed of barium borosilicate glass or alumino borosilicate glass, a quartz substrate, a stainless steel substrate or the like may be used. Alternatively, a synthetic resin substrate having flexibility such as a plastic substrate typified by PET (Polyethylene Terephthalate), or PEN (Polyethylene Naphthalate) and an acrylic substrate can be used as long as it can withstand the processing temperatures during the manufacturing steps although it generally has a lower heat resistance temperature as compared to other substrates. As a base film, an insulating film formed of silicon oxide, silicon nitride, silicon nitride oxide, or the like can be used.

An amorphous semiconductor film is formed over the base film so as to have a thickness of 25 to 100 nm (preferably, 30 to 60 nm). Silicon germanium as well as silicon can be used for the amorphous semiconductor.

The amorphous semiconductor film is crystallized as required to form a crystalline semiconductor film. The crystallization can be performed by using an annealing furnace, laser irradiation, irradiation of light emitted from a lamp (hereinafter referred to as lamp annealing), or a combination of them. For example, a crystalline semiconductor film is formed by adding a metal element to an amorphous semiconductor film and applying heat treatment using an annealing furnace. A semiconductor film is preferably added with a metal element since it can be crystallized at a low temperature. Thus formed crystalline semiconductor film is processed into a predetermined shape. The predetermined shape is to be the switching transistor 11 and the driving transistor 12 as shown in FIG. 4.

Then, an insulating film functioning as a gate insulating film is formed. The insulating film is formed so as to have a thickness of 10 to 150 nm, and preferably 20 to 40 nm, and cover the semiconductor film. The insulating film may have a single layer structure or a stacked-layer structure using a silicon oxynitride film, a silicon oxide film or the like.

A first conductive film functioning as a gate electrode is formed over the semiconductor film with a gate insulating film interposed therebetween. The gate electrode may have a single layer structure or a stacked-layer structure, though a stacked-layer structure of conductive films 22*a* and 22*b* is used in this embodiment mode. Each of the conductive films 22*a* and 22*b* may be formed by using an element selected from Ta, Ti, W, Mo, Al, and Cu, or an alloy or a compound material mainly containing such an element. In this embodiment mode, the conductive film 22*a* is formed of a tantalum nitride film with a thickness of 10 to 50 nm, for example 30 nm, and the conductive film 22*b* is stacked thereover using a tungsten film with a thickness of 200 to 400 nm, for example 370 nm.

An impurity element is added with the gate electrode used as a mask. At this time, a low concentration impurity region may be formed in addition to a high concentration impurity region, which is called an LDD (Lightly Doped Drain) structure. In specific, a structure where the low concentration impurity region overlaps the gate electrode is called a GOLD (Gate-drain Overlapped LDD) structure. An N-channel transistor preferably has the low concentration impurity region in particular.

Subsequently, insulating films 28 and 29 functioning as an interlayer insulating film 30 are formed. The insulating film 28 may be formed of an insulating film containing nitrogen, and in this embodiment mode, a silicon nitride film with a thickness of 100 nm is formed by a plasma CVD method.

Meanwhile, the insulating film 29 may be formed by using an organic material or an inorganic material. The organic material includes polyimide, acrylic, polyamide, polyimide amide, resist, benzocyclobutene, siloxane, and polysilazane. Siloxane has a skeleton structure formed by the bond of silicon (Si) and oxygen (O), in which a polymer material containing at least hydrogen as a substituent or at least one of fluorine, an alkyl group, or aromatic hydrocarbon as the substituent is used as a starting material. Polysilazane is a polymer material having the bond of silicon (Si) and nitrogen (N), namely polysilazane. The inorganic material includes an insulating film containing oxygen or nitrogen such as silicon oxide ($SiO_x$), silicon nitride ($SiN_x$), silicon oxynitride ($SiO_xN_y$) (x>y), and silicon nitride oxide ($SiN_xO_y$) (x>y) (x, y=1, 2 . . . ). Further, the insulating film 29 may have a stacked layer structure of these insulating films. In specific, when the insulating film 29 is formed by using an organic material, uniformity is improved whereas moisture and oxygen are absorbed by the organic material. In order to prevent this, an insulating film containing an inorganic material may be formed over the organic material. An insulating film containing nitrogen is preferably used as the inorganic material since alkali ions such as Na can be prevented from entering. An organic material is preferably used for the insulating film 29 since uniformity can be improved.

A contact hole is formed in the interlayer insulating film 30. Then, a second conductive film is formed, which functions as source and drain wirings 24 of the switching transistor 11 and the driving transistor 12, the signal line Sx, and the power supply line Vx. The second conductive film may be formed by using an element such as aluminum (Al), titanium (Ti), molybdenum (Mo), tungsten (W), and silicon (Si), or an alloy film using such elements. In this embodiment mode, the second conductive film is formed by stacking a titanium (Ti) film, a titanium nitride (TiN) film, a titanium-aluminum alloy film, and a titanium film, which have thicknesses of 60 nm, 40 nm, 300 nm, and 100 nm respectively. Then, an insulating film 31 is formed so as to cover the second conductive film. The insulating film 31 can be formed by using any of the materials of the interlayer insulating film 30 described above. A high aperture ratio can be achieved by providing such insulating film 31.

A first electrode (a pixel electrode) 19 is formed in the opening provided in the insulating film 31. In order to increase the step coverage of the pixel electrode in the opening, the end portion of the opening is preferably roundish so as to have a plurality of radii of curvature. The first electrode 19 may be formed by using a light transmissive material such as indium tin oxide (ITO), indium zinc oxide (IZO) obtained by mixing 2 to 20% of zinc oxide (ZnO) into indium oxide, ITO—$SiO_x$ obtained by mixing 2 to 20% of silicon oxide ($SiO_2$) into indium oxide, organic indium, and organotin. The pixel electrode 19 may also be formed by using a light shielding material such as an element selected from silver (Ag), tantalum, tungsten, titanium, molybdenum, aluminum, and copper, or an alloy or compound material mainly containing such an element. When the insulating film 31 is formed by using an organic material to improve uniformity, the surface uniformity on which the pixel electrode is formed is improved, which allows a constant voltage to be applied and prevents a short-circuit.

Unwanted coupling capacitance may occur in the area 430 where the first conductive film overlaps the pixel electrode 19. This is unwanted coupling capacitance.

Subsequently, a partition wall 32 is formed and a light emitting layer 33 is formed by a vapor deposition method or an ink jet printing method. The light emitting layer 33 is formed by arbitrarily combining an electron injection layer (EIL), an electron transporting layer (ETL), a light emitting layer (EML), a hole transporting layer (HTL), a hole injection layer (HIL) and the like using an organic material or an inorganic material. Note that the boundaries between each layer are not necessarily clearly defined, and there is also a case where materials of the respective layers are partially mixed with each other, which blurs the boundaries. The structure of the light emitting layer 33 is not limited to the aforementioned stacked-layer structure.

As a host material for forming the light emitting layer 33, an inorganic material can be used. As an inorganic material, it is preferable to use sulfide, oxide, or nitride of a metal material such as zinc, cadmium, and gallium. For example, as sulfide, zinc sulphide (ZnS), cadmium sulfide (CdS), calcium sulfide (CaS), yttrium sulfide ($Y_2S_3$), gallium sulfide ($Ga_2S_3$), strontium sulfide (SrS), or barium monosulfide (BaS) or the like can be used. As oxide, zinc oxide (ZnO), yttrium oxide ($Y_2O_3$), or the like can be used. In addition, as nitride, aluminum nitride (AlN), gallium nitride (GaN), indium nitride (InN), or the like can be used. Furthermore, zinc selenide (ZnSe), zinc telluride (ZnTe), or the like can be used as well. Alternatively, ternary mixed crystal such as calcium sulfide-gallium ($CaGa_2S_4$), strontium sulfide-gallium ($SrGa_2S_4$), or barium sulfide-gallium ($BaGa_2S_4$), may be used.

As an impurity element, a metal element such as manganese (Mn), copper (Cu), samarium (Sm), terbium (Th), erbium (Er), thulium (Tm), europium (Eu), cerium (Ce), or praseodymium (Pr) can be used to form a light emission center using inner-shell electron transition of a metal ion. As charge compensation, a halogen element such as fluorine (F) or chlorine (Cl) may be added.

In addition, as a light emission center using donor-acceptor recombination, a light emitting material including the first impurity element and the second impurity element can be used. For example, as the first impurity element, metal elements such as copper (Cu), silver (Ag), gold (Au), and platinum (Pt), or silicon (Si) can be used. The second impurity element can be, for example, fluorine (F), chlorine (Cl), bromine (Br), iodine (I), boron (B), aluminum (Al), gallium (Ga), indium (In), thallium (Tl), or the like.

A light-emitting material is obtained by solid phase reaction, namely weighing a host material and an impurity element, mixing them in a mortar, and heating it in an electric furnace so that an impurity element is contained in the host material. For example, the host material and a first impurity element or a compound including the first impurity element, a second impurity element or a compound including the second impurity element are weighed. After mixing them in a mortar, it is heated and baked in an electric furnace. A baking temperature is preferably 700 to 1500° C. When the temperature is too low, the solid phase reaction does not advance while the host material is decomposed when the temperature is too high. Note that the composition may be baked in a powder state, however, it is preferable to perform baking in a pellet state.

Further, as an impurity element in the case of utilizing solid phase reaction, a compound formed of the first impurity element and the second impurity element may be used in combination. In this case, the solid phase reaction easily advances since the impurity elements are easily dispersed. Therefore, an even light emitting material can be obtained. Moreover, as no unnecessary impurity elements are mixed, a light emitting material with high purity can be obtained. As a compound formed of the first impurity element and the second impurity element, for example, copper fluoride ($CuF_2$), copper chloride (CuCl), copper iodide (CuI), copper bromide (CuBr), copper nitride ($Cu_3N$), copper phosphide ($Cu_3P$), silver fluoride (CuF), silver chloride (CuCl), silver iodide (CuI), a silver bromide (CuBr), gold chloride ($AuCl_3$), gold bromide ($AuBr_3$), platinum chloride ($PtCl_2$), or the like can be used. In addition, a light emitting material including the third impurity element instead of the second impurity element may be used.

For example, the third impurity element can be lithium (Li), sodium (Na), potassium (K), rubidium (Rb), cesium (Cs), nitrogen (N), phosphorus (P), arsenic (As), antimony (Sb), bismuth (Bi), or the like. These impurity elements are preferably contained at a concentration of 0.01 to 10 mol %, and preferably in a range of 0.1 to 5 mol % in the host material.

As a light emitting material having high electric conductivity, the material described above is used as a host material, thereby a light emitting material to which a light emitting material including the first impurity element, the second impurity element and the third impurity element can be used. These impurity elements are preferably contained at a concentration of 0.01 to 10 mol %, and preferably in a range of 0.1 to 5 mol % in the host material.

As a compound formed of the second impurity element and the third impurity element, for example, alkali halide such as lithium fluoride (LiF), lithium chloride (LiCl), lithium iodide (LiI), copper bromide (LiBr), and sodium chloride (NaCl), boron nitride (BN), aluminum nitride (AlN), aluminum antimony (AlSb), gallium phosphorus (GaP), gallium arsenide (GaAs), indium phosphorus (InP), indium arsenic (InAs), indium antimonide (InSb), or the like can be used.

By using the aforementioned material as a host material, a light emitting layer formed by using a light emitting material including the aforementioned first impurity element, second impurity element, and third impurity element can emit light without a hot electron accelerated by a high electric field. That is to say, it is not necessary to apply high voltage to a light emitting element, therefore, the light emitting element which can operate with a low driving voltage can be obtained. Moreover, because the light emitting element can emit light with a low driving voltage, power consumption can be reduced. Moreover, the element which becomes another light emission center may further be included.

Moreover, by using the material as a host material, a light emitting material including a light emission center using inner-shell electron transition of the second impurity element and the third impurity element and the aforementioned metal ion can be used. In this case, it is desirable that a metal ion becoming a light emission center be contained at a concentration of 0.05 to 5 atom % in the host material. Moreover, it is preferable that the concentration of the second impurity element be 0.05 to 5 atom % in the host material. Moreover, it is preferable that the concentration of the third impurity element be 0.05 to 5 atom % in the host material. A light emitting material with such a structure can emit light with a low voltage. Therefore, a light emitting element which can emit light with a low driving voltage with reduced power consumption can be obtained. Moreover, the element which become another light emission center may further be included. Luminance decay of a light emitting element can be suppressed by using such a light emitting material. Moreover, a light emitting element can be driven with a low voltage by using a transistor.

A second electrode 35 is formed by a vapor deposition method. The first electrode (pixel electrode) 19 and the second electrode 35 of the light emitting element function as an anode or a cathode depending on a pixel configuration. The anode is preferably formed using a metal, an alloy, a conductive compound, and a mixture thereof, each of which has a high work function (work function of 4.0 eV or higher). More specifically, it is possible to use ITO, IZO obtained by mixing 2 to 20% of zinc oxide (ZnO) into indium oxide, gold (Au), platinum (Pt), nickel (Ni), tungsten (W), chromium (Cr), molybdenum (Mo), iron (Fe), cobalt (Co), copper (Cu), palladium (Pd), nitride of a metal material (TiN), or the like.

The cathode is preferably formed using a metal, an alloy, a conductive compound, and a mixture thereof, each of which has a low work function (work function of 3.8 eV or lower).

More specifically, it is possible to use an element belonging to group 1 or group 2 of the periodic table, namely an alkali metal such as Li and Cs, an alkaline earth metal such as Mg, Ca and Sr, an alloy (Mg:Ag, Al:Li) or a compound (LiF, CsF, $CaF_2$) containing them, and a transition metal including a rare earth metal. Since the cathode is required to transmit light, these metals or alloys containing them are formed extremely thin and stacked with a metal (including an alloy) such as ITO.

A protective film may be formed thereafter so as to cover the second electrode 35. As the protective film, a silicon nitride film or a DLC film may be used. In this manner, the pixel of the display device can be formed.

Embodiment Mode 5

Configurations of a pixel and a driver circuit of a display device of the invention are described with reference to FIGS. 29 to 31.

Figure 29:
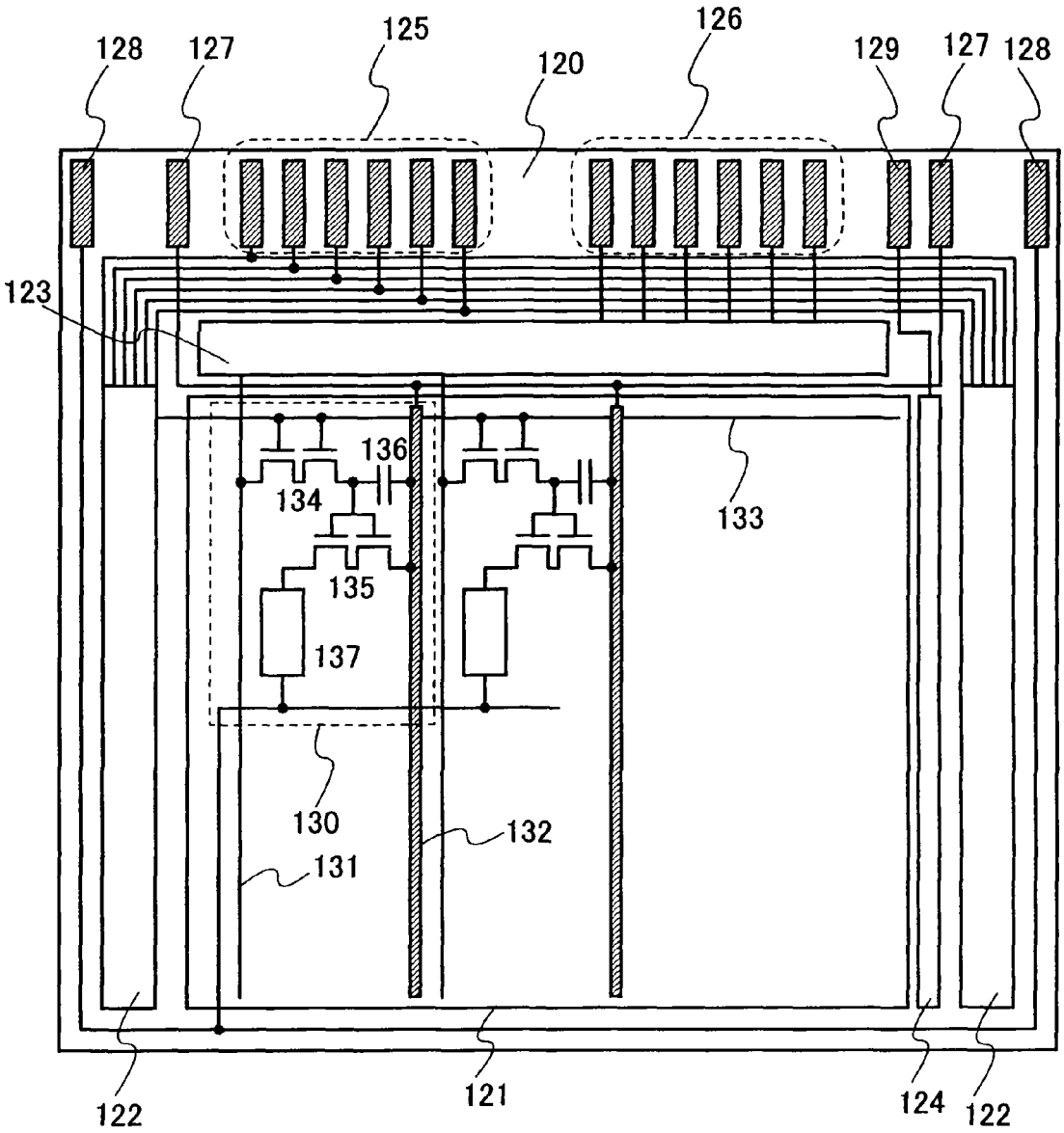
FIG. 29 is a diagram showing a configuration of a display panel of the invention.

FIG. 29 shows a configuration of a display panel of the invention. This display panel includes a pixel portion 121 in which subpixels 130 are arranged in a plurality of columns, a scan line driver circuit 122 which controls a signal of a scan line 133, and a data line driver circuit 123 which controls a signal of a data line 131 over a substrate 120. Moreover, a monitor circuit 124 for correcting a luminance change of a light emitting element 137 included in the subpixel 130 may be provided as well. The light emitting element 137 and a light emitting element included in the monitor circuit 124 have the same structures. The light emitting element 137 has a structure in which a layer containing a material which exhibits electroluminescence is sandwiched between a pair of electrodes.

Input terminals 125 for inputting signals from an external circuit to the scan line driver circuit 122, input terminals 126 for inputting signals from an external circuit to the data line driver circuit 123, and an input terminal 129 for inputting signals to the monitor circuit 124 are provided in the periphery of the substrate 120.

The subpixel 130 includes a transistor 134 connected to the data line 131 and a transistor 135 which is connected between the power supply line 132 and the light emitting element 137 in series. A gate of the transistor 134 is connected to the scan line 133. When the transistor 134 is selected by a scan signal, it inputs a signal of the data line 131 to the subpixel 130. The inputted signal is applied to a gate of the transistor 135 and charges a holding capacitor portion 136. In accordance with this signal, the power supply line 132 and the light emitting element 137 become conductive, thereby the light emitting element 137 emits light.

A power is required to be supplied from an external circuit so that the light emitting element 137 provided in the subpixel 130 emits light. The power supply line 132 provided in the pixel portion 121 is connected to the external circuit at input terminals 127. As resistance loss occurs in the power supply line 132 depending on the length of a wire to be led, it is preferable to provide the input terminals 127 at a plurality of positions in the periphery of the substrate 120. The input terminals 127 are provided at opposite end portions of the substrate 120 so that luminance variations in the area of the pixel portion 121 do not become notable. That is, it is prevented that one side of the screen becomes bright while the other side thereof becomes dark. Further, in the light emitting element 137 having a pair of electrodes, an electrode on the opposite side to the electrode connected to the power supply line 132 is formed as a common electrode shared by the plurality of subpixels 130. In order to reduce the resistance loss of this electrode, a plurality of terminals 128 are provided.

Figure 30:
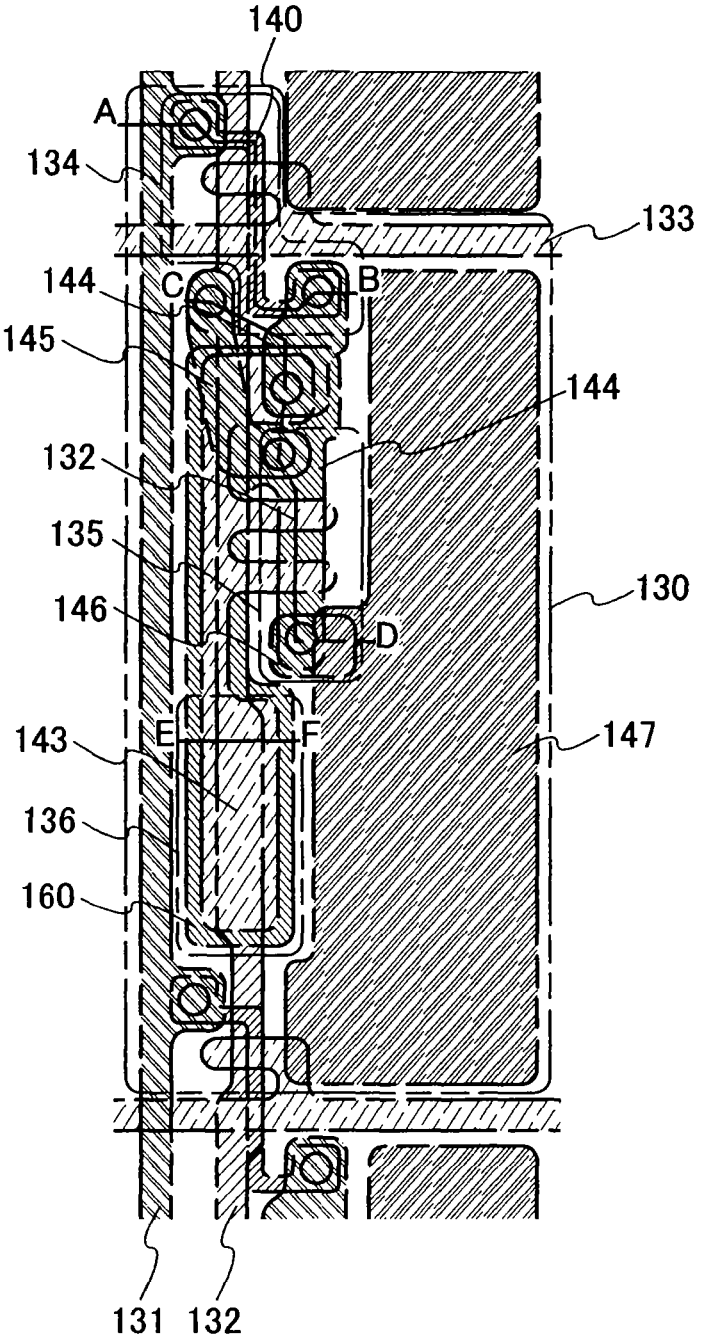
FIG. 30 is a diagram showing a configuration of a subpixel in a display panel of the invention.
Figure 31:
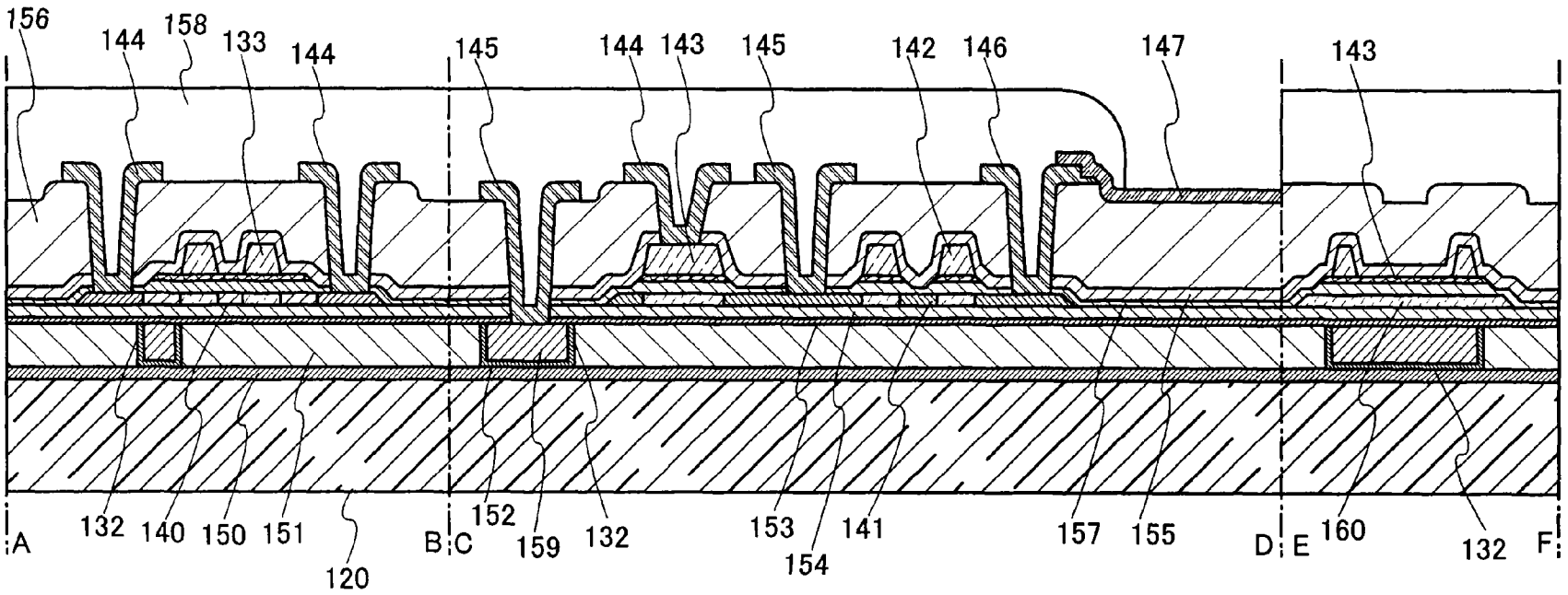
FIG. 31 is a diagram showing a configuration of a subpixel in a display panel of the invention.

Next, an example of the subpixel 130 is described in details with reference to FIGS. 30 and 31. It is to be noted that FIG. 30 shows a top plan view of the subpixel 130 and FIG. 31 shows a longitudinal sectional view taken along lines A-B, C-D, and E-F in FIG. 30.

The scan line 133 and the data line 131 are formed of different layers and cross each other with an insulating layer 155 and an insulating layer 156 interposed therebetween. The scan line 133 functions as a gate electrode of a transistor at a portion where it crosses a semiconductor layer 141 with a gate insulating layer 157 interposed therebetween. In this case, by providing the transistor 134 in accordance with the arrangement of the semiconductor layer 141 and by branching the scan line 133 so that a plurality of parts intersect with the semiconductor layer 141, what is called a multi-gate transistor in which a plurality of channel forming regions are arranged in series between a pair of source and a drain can be provided.

It is preferable that the resistance of the power supply line 132 connected to the transistor 135 be low, therefore, it is preferable to use Al, Cu, or the like having particularly low resistance for the power supply line 132. In the case of forming a Cu wire, the Cu wire can be formed in an insulating layer in combination with a barrier layer. FIG. 31 shows an example where the power supply line 132 is formed over the substrate 120 and under the semiconductor layer 141. A barrier layer 150 is formed over the surface of the substrate 120, thereby preventing impurities such as alkali metal contained in the substrate 120 from seeping. The power supply line 132 is formed of a barrier layer 152 and a Cu layer 159 in an opening formed in the insulating layer 151. The barrier layer 152 is formed of tantalum (Ta), tantalum nitride (TaN), tungsten nitride (WN), titanium nitride (TiN), or the like. The Cu layer 159 is formed by forming a seed layer by sputtering and accumulated in a thickness of 1 to 5 μm by plating, and planarized by chemical mechanical polishing. That is, by using damascene process, the Cu layer 159 can be embedded in the insulating layer 151.

A base insulating layer for semiconductor layers 140 and 141 is formed over the insulating layer 151. The structure of the base insulating layer is not limited, however, it is preferably formed of a silicon nitride layer 153 and a silicon oxide layer 154. Besides, as a structure of the insulating layer, an insulating layer 156 is formed of silicon oxide, silicon nitride, or the like as a protective film over the semiconductor layers 140 and 141 in addition to the gate insulating layer 157.

The power supply line 132 and the transistor 135 are connected by a wire 145 through a contact hole which passes through the aforementioned insulating layer. Moreover, a gate electrode 142 is connected to the transistor 134 by a wire 144. The gate electrodes of the transistors 134 and 135 may be formed by stacking a plurality of layers. For example, a first conductive layer and a second conductive layer may be combined in consideration of adhesion with a gate insulating layer and resistance. Alternatively, the shapes of the overlaying and underlying layers may be changed (for example, a shape of a peaked hat) so that source and drain regions and a low concentration impurity (LDD) region can be formed in a semiconductor layer in a self-aligned manner.

A capacitor electrode 143 of a holding capacitor portion 136 provided by extending the gate electrode 142 is preferably formed to have low resistance by utilizing the combination of the first conductive layer and the second conductive layer by providing a thin film portion of the first conductive layer and adding impurities imparting one conductivity type to the underlying semiconductor layer. That is, the holding capacitor portion 136 is formed of the capacitor electrode 143 of the holding capacitor portion 136 provided by extending the gate electrode 142, a semiconductor layer 160 provided by extending the semiconductor layer 141 of the transistor 135, and a gate insulating layer 157 sandwiched by them. The holding capacitor portion 136 can function efficiently by adding impurities imparting one conductivity type to the semiconductor layer 160 so as to have low resistance.

A pixel electrode 147 of a light emitting element may have a direct contact with the semiconductor layer 141 of the transistor 135, however, they can be connected through a wire 146 as shown in FIG. 31. In this case, it is preferable to provide a plurality of steps at an end portion of the wire 146 since a contact area with the pixel electrode 147 can be increased. Such steps can be formed by using a photo mask using a light reducing function such as a slit or a translucent film. A partition layer 158 covers a peripheral end portion of the pixel electrode 147.

A display panel described in this embodiment mode has a power supply line formed of a low resistant material such as Cu, therefore, it is efficient when a screen size is large in particular. For example, when the screen size is about 13-inch, a diagonal length of the screen is 340 mm while it is 1500 mm or longer in the screen of about 60-inch. In such a case, wiring resistance is inevitably generated, therefore, a wire is preferably formed of a low resistant material such as Cu. Moreover, a data line and a scan line may be similarly formed when wiring delay is considered.

It is to be noted that this embodiment mode can be freely implemented in combination with Embodiment Modes 1 to 4.

Embodiment Mode 6

In this embodiment, a vapor deposition apparatus used for manufacturing a display panel is described with reference to the drawings.

The display panel is manufactured by forming an EL layer over an element substrate in which a pixel circuit and/or a driver circuit is formed by transistors. The EL layer is formed so as to have at least a portion containing a material which exhibits electroluminescence. The EL layer may be formed of a plurality of layers with different functions. In that case, the EL layer is sometimes formed by using layers with different functions, which are also called a hole injecting/transporting layer, a light emitting layer, an electron injecting/transporting layer, and the like.

Figure 32:
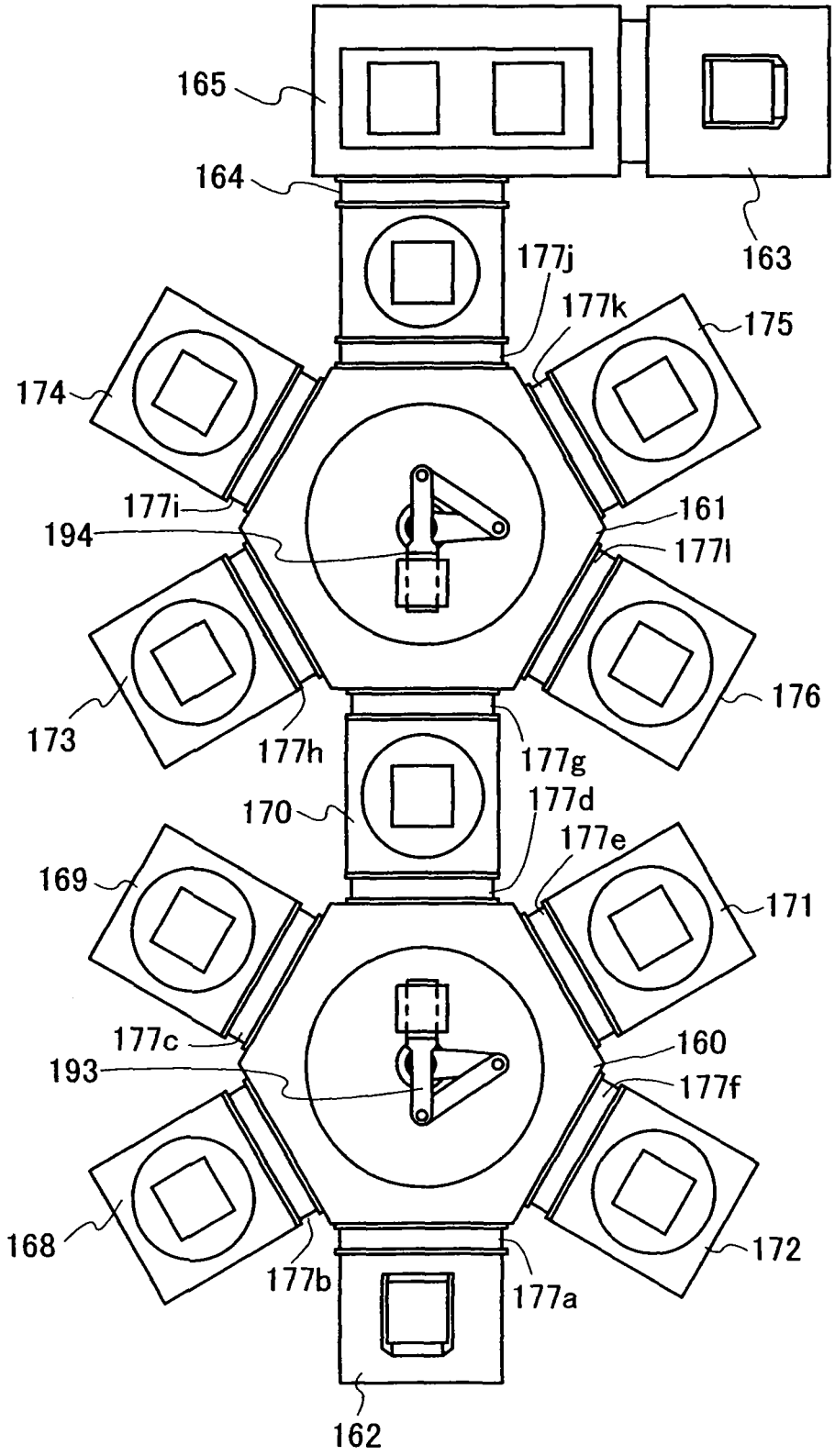
FIG. 32 is a diagram showing a structure of a vapor deposition apparatus for forming an EL layer.

FIG. 32 shows a structure of a vapor deposition apparatus for forming an EL layer over the element substrate in which transistors are formed. This vapor deposition apparatus has a plurality of treatment chambers connected to transfer chambers 160 and 161. The treatment chambers include a load chamber 162 for providing a substrate, an unload chamber 163 for collecting a substrate, a thermal treatment chamber 168, a plasma treatment chamber 172, film forming treatment chambers 169 to 175 for vapor-depositing an EL material, and a film forming treatment chamber 176 for forming a conductive film formed of aluminum or aluminum as a main component as one electrode of a light emitting element. Further, gate valves 177*a* to 177*l* are provided between the transfer chamber and each treatment chamber. The pressure of each treatment camber can be independently controlled, thereby mutual contamination between the treatment chambers is prevented.

A substrate introduced from the load chamber 162 to the transfer chamber 161 is transferred to a predetermined treatment chamber by an arm type transfer unit 193 capable of rotating. The substrate is transferred by the transfer unit 193 from a certain treatment chamber to another treatment chamber. The transfer chambers 160 and 161 are connected by a film forming treatment chamber 170, where the substrate is passed from the transfer unit 193 to a transfer unit 194.

Each treatment chamber connected to the transfer chambers 160 and 161 is kept in a reduced pressure state. Therefore, in this vapor deposition apparatus, film forming treatment of an EL layer can be performed continuously without exposing a substrate to the air. A display panel in which an EL layer has been formed may deteriorate by moisture or the like. Therefore, a sealing treatment chamber 165 is connected to the transfer chamber 161 for performing sealing treatment to keep the quality before contact with the air. The sealing chamber 165 is kept at an atmospheric pressure or a reduced pressure close to the atmospheric pressure, therefore, an intermediate chamber 164 is provided between the transfer chamber 161 and the sealing treatment chamber 165. The intermediate chamber 164 is provided for passing the substrate and buffering the pressure between the chambers.

The load chamber 162, the unload chamber 163, the transfer chambers, and the film forming treatment chambers are provided with exhausting units for keeping the reduced pressure. As an exhausting unit, various vacuum pumps such as a dry pump, a turbo molecular pump, and a diffusion pump can be used.

In the vapor deposition apparatus shown in FIG. 32, the number and constitution of the treatment chambers connected to the transfer cambers 160 and 161 may be combined in accordance with a stacked-layer structure of a light emitting element. An example of the combination is described below.

The thermal treatment chamber 168 performs degasification treatment by heating a substrate over which a lower electrode, an insulating partition, or the like is formed. The plasma treatment chamber 172 performs plasma treatment with rare gas or oxygen to the surface of the lower electrode. This plasma treatment is performed for cleaning the surface, stabilizing the surface condition, and stabilizing the surface physically or chemically (for example, a work function or the like).

The film forming treatment chamber 169 is a treatment chamber for forming an electrode buffer layer which contacts one electrode of a light emitting element. The electrode buffer layer has a carrier injecting property (a hole injecting property or an electron injecting property) and suppresses a short-circuit and a dark spot defect of a light emitting element. The electrode buffer layer is typically formed of an organic and inorganic mixture material so as to have a resistance of $5\times10^4$ to $1\times10^6$ Ωcm with a thickness of 30 to 300 nm. The film forming chamber 171 is a treatment chamber for forming a hole transporting layer.

A light emitting layer of a light emitting element has a different structure depending on the case of a mono-color light emission and the case of white light emission. In the vapor deposition apparatus, film forming chambers are preferably arranged in accordance with the light emission color. For example, in the case of forming three kinds of light emitting elements with different light emission colors in a display panel, light emitting layers corresponding to each light emission color is required to be formed. In this case, the film forming treatment chamber 170 can be used for forming a first light emitting layer, the film forming treatment chamber 173 can be used for forming a second light emitting layer, and the film forming treatment chamber 174 can be used for forming a third light emitting layer. By changing the film forming treatment chamber for each light emitting layer, mutual contamination of different light emission materials can be prevented, thereby the throughput of the film forming treatment can be improved.

Further, each of the film forming treatment chambers 170, 173, and 174 may be used for sequentially vapor-depositing three kinds of EL materials with different light emission colors. In this case, vapor deposition is performed by moving a shadow mask in accordance with a region to be deposited.

In the case of forming a light emitting element which exhibits white light emission, light emitting layers with different light emission colors are stacked vertically. In that case also, it is possible that an element substrate sequentially moves among the film forming treatment chambers to form each light emitting layer. Moreover, different light emitting layers can be continuously formed in the same film forming treatment chamber as well.

In the film forming treatment chamber 176, an electrode is formed over the EL layer. The electrode can be formed by an electron beam vapor deposition method or a sputtering method, but a resistance thermal vapor deposition method is preferably used.

The element substrate in which up to the electrode has been formed is transferred into the sealing treatment chamber 165 through the intermediate chamber 164. Inert gas such as helium, argon, neon, or nitrogen is filled in the sealing treatment chamber 165. In such an atmosphere, a sealing substrate is attached to a side of the element substrate where the EL layer is formed. In the sealed condition, inert gas or a resin material may be filled between the element substrate and the sealing substrate. In the sealing treatment chamber 165, a dispenser for drawing a sealing material, a mechanical component such as an arm or a fixing stage for fixing the sealing substrate so as to oppose the element substrate, a dispenser or a spin coater for filling the resin material, and the like are provided.

Figure 33:
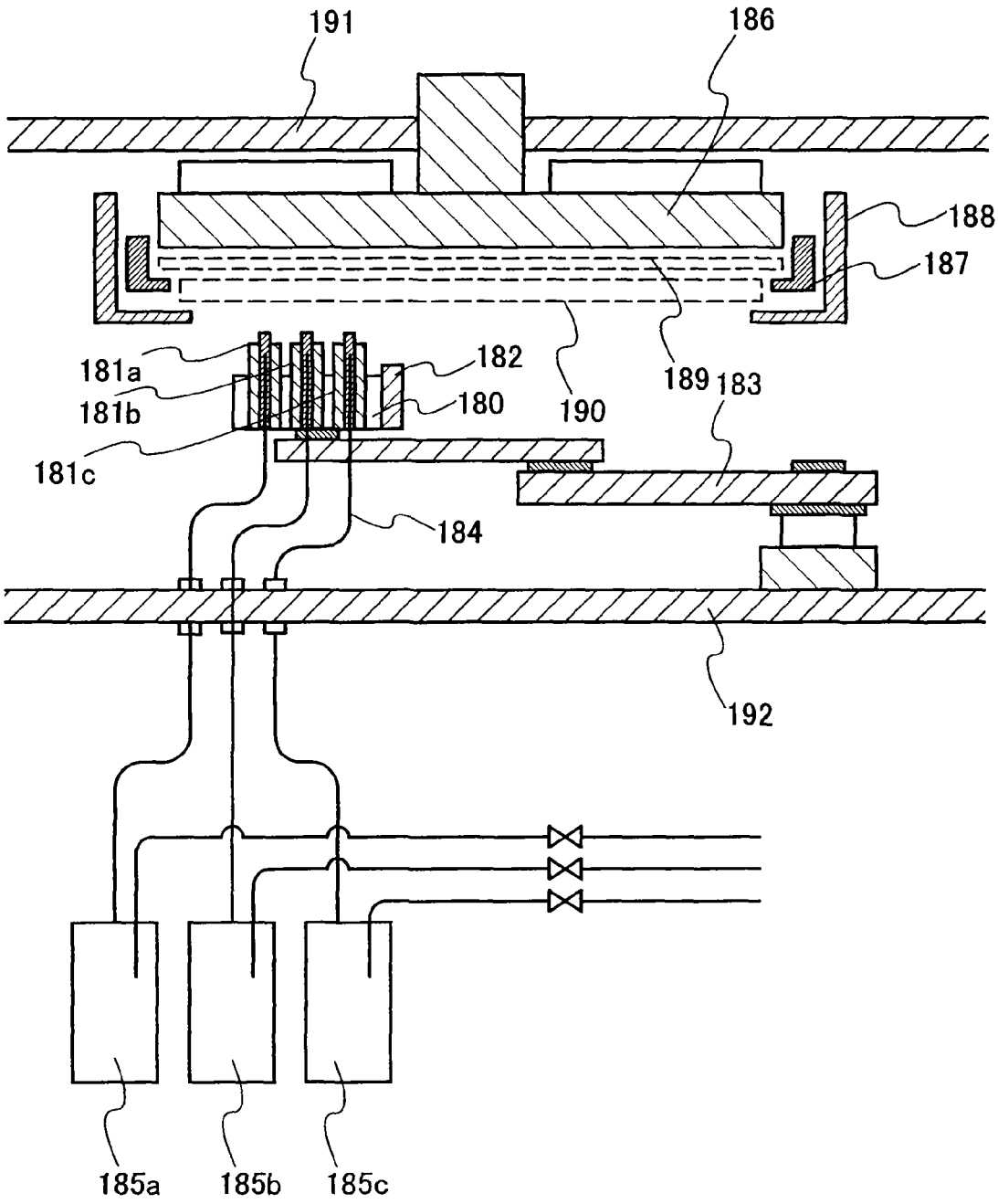
FIG. 33 is a diagram showing a structure of a vapor deposition apparatus for forming an EL layer.

FIG. 33 shows an internal structure of the film forming treatment chamber. The film forming treatment chamber is kept at a reduced pressure. A space sandwiched between a top plate 191 and a bottom plate 192 is the interior which is kept at a reduced pressure.

In the treatment chamber, one or a plurality of evaporation sources is provided. In the case of forming a plurality of layers with different compositions or co-depositing different materials, a plurality of evaporation sources are preferably provided. In FIG. 33, evaporation sources 181*a*, 181*b*, and 181*c* are fitted in an evaporation source holder 180. The evaporation source holder 180 is held by a multi-joint arm 183. The multi-joint arm 183 can freely move the evaporation source holder 180 within its movable region by extending and contracting the joints. Moreover, a distance sensor 182 may be provided in the evaporation source holder 180 to monitor a distance between the evaporation sources 181*a* to 181*c* and a substrate 189 so as to control an optimum distance for vapor deposition. In that case, the multi-joint arm may move in top and bottom directions (Z direction) as well.

A substrate stage 186 and a substrate chuck 187 as a pair fix the substrate 189. The substrate stage 186 may be constituted with a heater incorporated therein so that the substrate 189 can be heated. The substrate 189 is released by the substrate chuck 187 and transferred while being fixed in the substrate stage 186. A shadow mask 190 provided with an opening formed in accordance with a pattern to be deposited can be used as required. In that case, the shadow mask 190 is provided between the substrate 189 and the evaporation sources 181*a* to 181*c*. The shadow mask 190 is fixed tightly or with a certain distance to the substrate 189 by a mask chuck 188. When the shadow mask 190 requires alignment, a camera is provided in the treatment chamber and a positioning unit is provided for the mask chuck 188 for slightly moving the shadow mask 190 in X-Y-θ direction.

An evaporation material supplying unit for continuously supplying an evaporation material to the evaporation source is attached to the evaporation sources 181*a*, 181*b*, and 181*c*. The evaporation material supplying unit includes evaporation material supplying sources 185*a*, 185*b*, and 185*c* which are provided apart from the evaporation sources 181*a*, 181*b*, and 181*c*, and a material supplying tube 184 which connects between them. The material supplying sources 185*a*, 185*b*, and 185*c* are typically provided corresponding to the evaporation sources 181*a*, 181*b*, and 181*c*. In FIG. 33, the material supplying source 185*a* and the evaporation source 181*a* correspond to each other. The same applies to the material supplying source 185*b* and the evaporation source 181*b*, and the material supplying source 185*c* and the evaporation source 181*c*.

The evaporation material can be supplied by an air current transfer method, an aerosol method, or the like. By the air current transfer method, impalpable powder of the evaporation material is transferred over the air current such as inert gas to the evaporation sources 181*a*, 181*b*, and 181*c*. By the aerosol method, a material liquid in which the evaporation material is dissolved or dispersed in a solvent is transferred and formed into aerosol by a sprayer so that the solvent in the aerosol is vaporized to be deposited. In either case, a heating unit is provided for each of the evaporation sources 181*a*, 181*b*, and 181*c*, which vaporizes the transferred evaporation material to be formed as a film over the substrate 189. In the case of FIG. 33, the material supplying tube 184 is formed of a narrow tube which can be flexibly bent and has enough rigidity not to be deformed even in the reduced pressure.

In the case of applying the air current transfer method or the aerosol method, it is preferable that the films be formed in the film forming treatment chamber at an atmospheric pressure or lower, and preferably at a reduced pressure of 133 to 13300 Pa. The film forming treatment chamber is filled with inert gas such as helium, argon, neon, krypton, xenon, or nitrogen. Alternatively, the pressure can be controlled while supplying the gas (exhausting at the same time). Moreover, the film forming treatment chamber for forming an oxide film may have an oxygen atmosphere by introducing gas such as oxygen and nitrous oxide. Further, gas such as hydrogen may be introduced in the film forming treatment chamber for vapor-depositing an organic material so as to have a reducing atmosphere.

As other methods for supplying an evaporation material, a screw may be provided in the material supplying tube 184 so as to continuously push the evaporation material to the evaporation source.

With the vapor deposition apparatus of this embodiment mode, a film can be continuously formed uniformly even for a large display panel. Moreover, an evaporation material is not required to be replenished every time the evaporation material is used up in the evaporation source, therefore, the throughput can be improved.

It is to be noted that this embodiment mode can be freely implemented in combination with Embodiment Modes 1 to 5.

Embodiment Mode 7

Figure 17A:
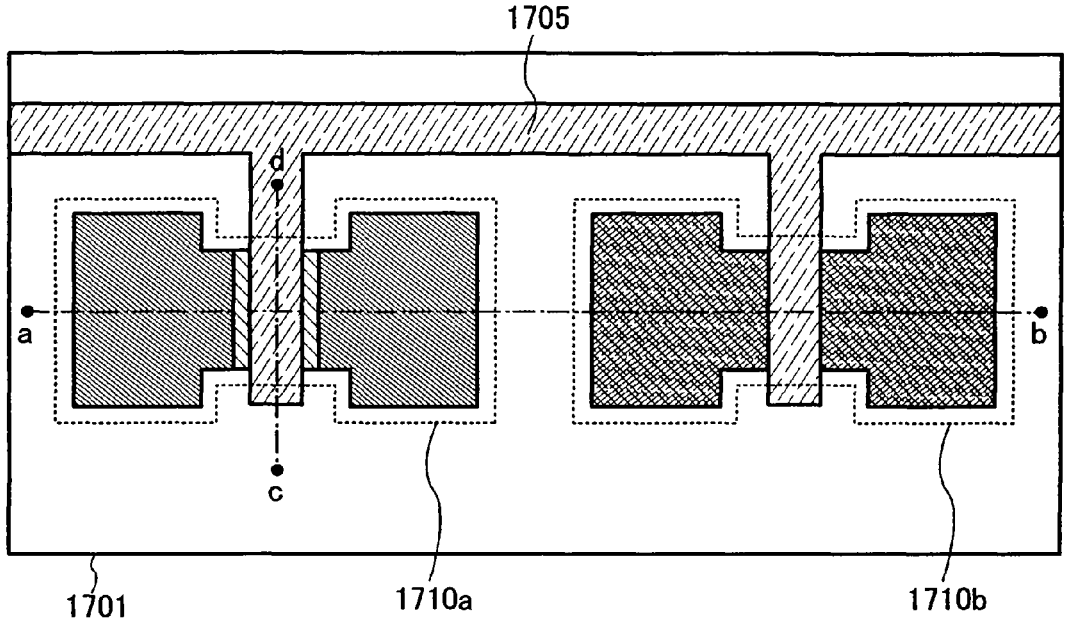
FIGS. 17A to 17C are views showing examples of a display device to which the invention can be applied.
Figure 17B:
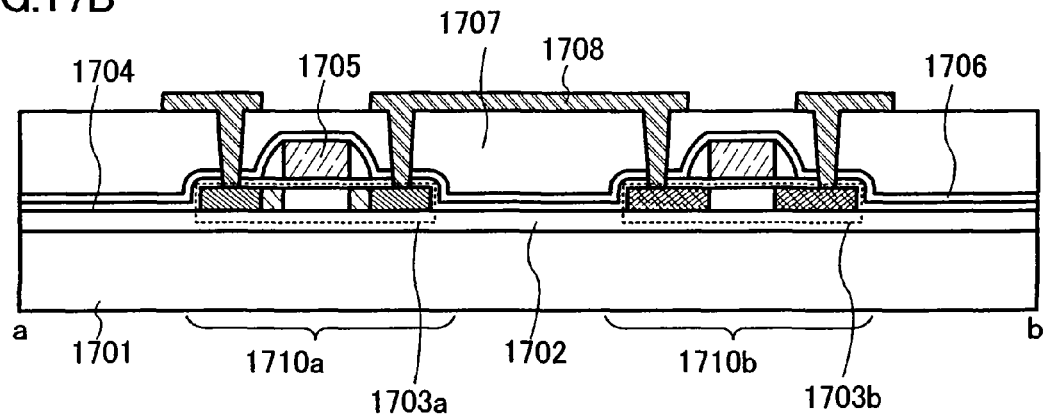
Figure 17C:
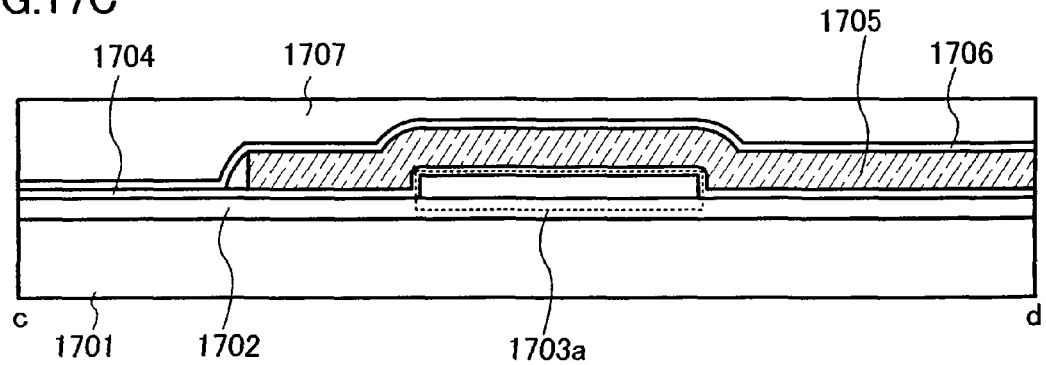

In this embodiment mode, a manufacturing method of a display device to which the invention can be applied is described. A display device to which the invention can be applied may be formed in combination with a high density plasma method which is excited by microwaves. An example of this is shown in FIGS. 17A to 17C. It is to be noted in FIGS. 17A to 17C that FIG. 17B is a cross sectional view taken along a-b of FIG. 17A and FIG. 17C is a cross sectional view taken along c-d of FIG. 17A.

The display device shown in FIGS. 17A to 17C includes semiconductor films 1703*a* and 1703*b* provided over the substrate 1701 with an insulating film 1702 interposed therebetween, a gate electrode 1705 provided over the semiconductor films 1703*a* and 1703*b* with a gate insulating film 1704 interposed therebetween, insulating films 1706 and 1707 provided so as to cover the gate electrode 1705, and a conductive film 1708 which is electrically connected to a source region or a drain region of the semiconductor films 1703*a* and 1703*b* and is provided over the insulating film 1707. In FIGS. 17A to 17C, an n-channel thin film transistor 1710*a* having a portion of the semiconductor film 1703*a* as a channel region and a p-channel thin film transistor 1710*b* having a portion of the semiconductor film 1703*b* as a channel region are provided, however, the invention is not limited to this structure. For example, in FIGS. 17A to 17C, an LDD region is provided in the n-channel thin film transistor 1710*a* and is not provided in the p-channel thin film transistor 1710*b*, however, it may be provided in both or none of the thin film transistors.

The substrate 1701 can be formed of a glass substrate such as barium borosilicate glass and alumino borosilicate glass, a quartz substrate, a ceramic substrate, a metal substrate including stainless steel, or the like. In addition, a substrate containing a flexible synthetic resin such as plastic or acrylic represented by polyethylene terephthalate (PET), polyethylene naphthalate (PEN), or polyether sulfone (PES) can also be used. By using a flexible substrate, a semiconductor device which can be bent can be formed. In addition, as such a substrate has no limit in its area and size, for example, a rectangular substrate having a side of 1 meter or longer can be used as the substrate 1701, thereby the productivity can be drastically improved. Such an advantage is a big dominance as compared to the case of using a circular silicon substrate.

The insulating film 1702 functions as a base film and prevents an alkali metal such as Na and alkaline earth metal from dispersing from the substrate 1701 into the semiconductor films 1703*a* and 1703*b* and affecting the characteristics of the semiconductor element. As the insulating film 1702, a single layer structure of an insulating film containing oxygen or nitrogen, such as silicon oxide ($SiO_x$), silicon nitride ($SiN_x$), silicon oxynitride ($SiO_xN_y$) (x>y), silicon nitride oxide ($SiN_xO_y$) (x>y), or the like or a stacked-layer structure of these. For example, in the case of providing the insulating film 1702 as a two-layer structure, it is preferable that a silicon nitride oxide film be provided as a first layer insulating film and a silicon oxynitride film be provided as a second layer insulating film. Further, in the case of providing the insulating film 1702 as a three-layer structure, it is preferable that a silicon oxynitride film be provided as a first layer insulating film, a silicon nitride oxide film be provided as a second layer insulating film, and a silicon oxynitride film be provided as a third layer insulating film.

The semiconductor films 1703*a* and 1703*b* are formed by forming an amorphous semiconductor film from a material containing silicon (Si) as a main component by a sputtering method, an LPCVD method, a plasma CVD method, or the like and crystallizing the amorphous semiconductor film by a crystallization method such as a laser crystallization method, a thermal crystallization method using an RTA or an annealing furnace, or a thermal crystallization method using a metal element which promotes crystallization.

The gate insulating film 1704 can be formed of a single layer structure or a stacked-layer structure of an insulating film containing oxygen or nitrogen such as silicon oxide ($SiO_x$), silicon nitride ($SiN_x$), silicon oxynitride ($SiO_xN_y$, x>y), and silicon nitride oxide ($SiN_xO_y$, x>y).

The insulating film 1706 can be formed of a single layer structure or a stacked-layer structure of an insulating film containing oxygen or nitrogen such as silicon oxide ($SiO_x$), silicon nitride ($SiN_x$), silicon oxynitride ($SiO_xN_y$, x>y), and silicon nitride oxide ($SiN_xO_y$, x>y) or a film containing carbon such as DLC (Diamond-Like Carbon).

The insulating film 1707 can be formed of a single layer structure or a stacked-layer structure of an insulating film containing oxygen or nitrogen such as silicon oxide ($SiO_x$), silicon nitride ($SiN_x$), silicon oxynitride ($SiO_xN_y$, x>y), and silicon nitride oxide ($SiN_xO_y$, x>y) or a film containing carbon such as DLC (Diamond-Like Carbon), and in addition, an organic material such as epoxy, polyimide, polyamide, polyvinyl phenol, benzocyclobutene, and acrylic, or siloxane resin can be used. Siloxane resin is resin including a Si—O—Si bond. Siloxane includes a skeleton formed by a bond of silicon (Si) and oxygen (O). An organic group containing at least hydrogen (such as an alkyl group or aromatic hydrocarbon) is included as a substituent. In addition, a fluoro group may be used as the substituent. Further, a fluoro group and an organic group containing at least hydrogen may be used as the substituent. In the display device shown in FIGS. 17A to 17C, the insulating film 1707 can be formed directly so as to cover the gate electrode 1705 without providing the insulating film 1706.

The conductive film 1708 can be formed of a single layer or a stacked-layer structure of an element selected from Al, Ni, C, W, Mo, Ti, Pt, Cu, Ta, Au, and Mn, or an alloy containing a plurality of the aforementioned elements. For example, as a conductive film formed of an alloy containing a plurality of the aforementioned elements, an Al alloy containing C and Ti, an Al alloy containing Ni, an Al alloy containing C and Ni, an Al alloy containing C and Mn, and the like can be used. Moreover, in the case of a stacked-layer structure, Al and Ti can be stacked.

Moreover, in FIGS. 17A to 17C, the n-channel thin film transistor 1710*a* includes sidewalls in contact with side surfaces of the gate electrode 1705. A source region and a drain region to which impurities imparting n-type conductivity are selectively added, and an LDD region provided under the sidewalls are formed in the semiconductor film 1703*a*. Moreover, the p-channel thin film transistor 1710*b* has sidewalls in contact with the side surfaces of the gate electrode 1705. A source region and a drain region to which impurities imparting p-type conductivity are selectively added are formed in the semiconductor film 1703*b*.

In the display device of the invention, by oxidizing or nitriding at least one of the substrate 1701, the insulating film 1702, the semiconductor films 1703*a* and 1703*b*, the gate insulating film 1704, the insulating film 1706, and the insulating film 1707 by plasma treatment, the semiconductor film or the insulating film is oxidized or nitrided. In this manner, by oxidizing or nitriding a semiconductor film or an insulating film by plasma treatment, the surface of the semiconductor film or the insulating film is improved in quality, thereby a denser insulating film can be formed as compared to an insulating film formed by a CVD method or a sputtering method. Therefore, a defect such as a pinhole can be suppressed and the characteristics and the like of a display device can be improved.

Further, the plasma treatment is performed with an electron density of $1\times10^{11}$ to $1\times10^{13}$ $cm^{-3}$ and a plasma electron temperature of 0.5 to 1.5 eV. As the plasma electron density is high and an electron temperature in the periphery of a processed object (the semiconductor films 1703*a* and 1703*b* here) formed over the substrate 1701 is low, damage to the processed object due to plasma can be prevented. Moreover, as a plasma electron density is $1\times10^{11}$ $cm^{-3}$ or higher, an oxide or a nitride film formed by oxidizing or nitriding an object by plasma treatment has superior uniformity in thickness or the like and denser as compared to a film formed by a CVD method, a sputtering method, or the like. As the plasma electron temperature is as low as 1 eV or lower, the oxidization or nitridation treatment can be performed at a lower temperature as compared to conventional plasma treatment or thermal oxidization method. For example, oxidization or nitridation treatment can be sufficiently performed even by performing plasma treatment at a temperature lower than a strain point temperature of a glass substrate by 100° C. or higher. It is to be noted that plasma can be formed at a high frequency of microwaves (2.45 GHz) or the like.

Figure 18A:
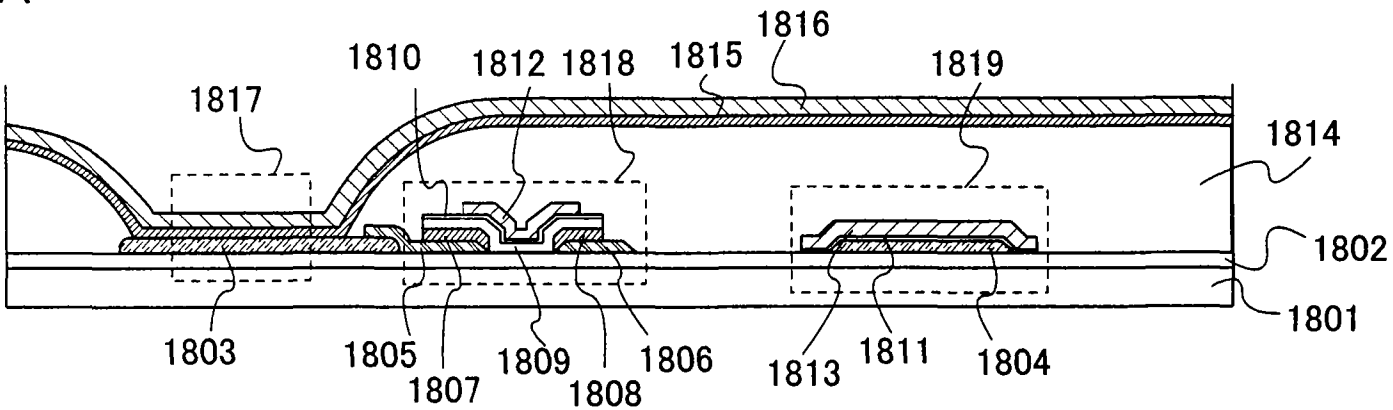
FIGS. 18A and 18B are views showing examples of a display device to which the invention can be applied.
Figure 18B:
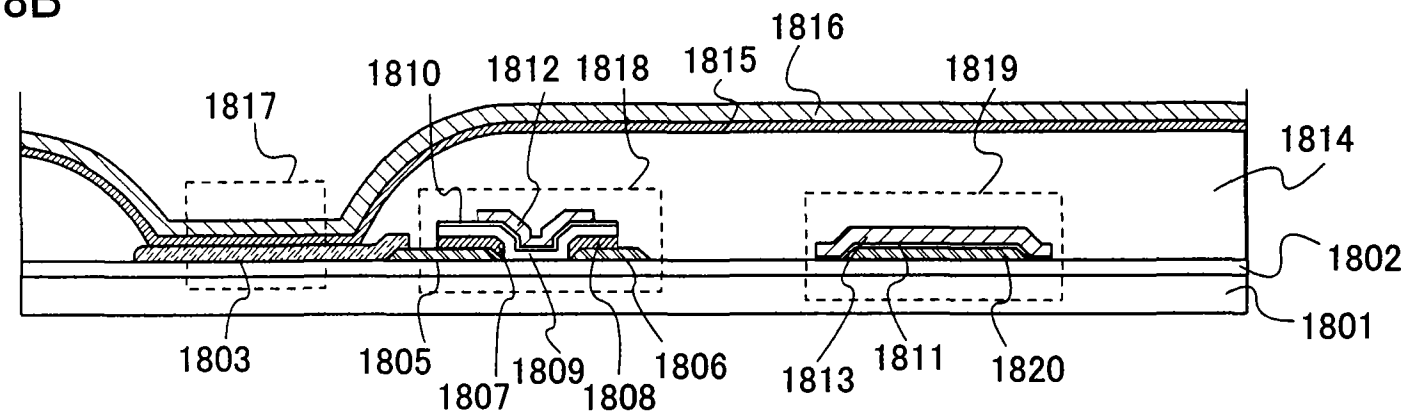

Next, description is made on the case of using an amorphous silicon (a-Si:H) film as a semiconductor layer of a transistor. FIGS. 18A and 18B show top gate transistors while FIGS. 19A to 20B show bottom gate transistors.

FIG. 18A is a cross section of a top gate transistor having a semiconductor layer formed of amorphous silicon. As shown in FIG. 18A, a base film 1802 is formed over a substrate 1801. Moreover, a pixel electrode 1803 is formed over the base film 1802. Moreover, a first electrode 1804 is formed in the same layer and of the same material as the pixel electrode 1803. The substrate may be a glass substrate, a quartz substrate, a ceramic substrate, or the like. Further, as a base film 1802, a single layer or stacked layers of aluminum nitride (AlN), silicon oxide ($SiO_2$), silicon oxynitride ($SiO_xN_y$), and the like can be used.

Wires 1805 and 1806 are formed over the base film 1802 and an end portion of the pixel electrode 1803 is covered with the wire 1805. An n-channel semiconductor layer 1807 and an n-channel semiconductor layer 1808 which have n-type conductivity are formed over the wires 1805 and 1806. A semiconductor layer 1809 is formed over the base film 1802 between the wires 1805 and 1806. A portion of the semiconductor layer 1809 extends over the n-channel semiconductor layer 1807 and the n-channel semiconductor layer 1808. It is to be noted that these semiconductor layers are formed of semiconductor films having non-crystallinity such as amorphous silicon (a-Si:H) and a microcrystalline semiconductor (μc-Si:H). A gate insulating film 1810 is formed over the semiconductor layer 1809. Moreover, an insulating film 1811 which is formed in the same layer and of the same material as the gate insulating film 1810 is formed over the first electrode 1804. It is to be noted that a silicon oxide film, a silicon nitride film, or the like is used as the gate insulating film 1810.

A gate electrode 1812 is formed over the gate insulating film 1810. Moreover, a second electrode 1813 formed in the same layer and of the same material as the gate electrode 1812 is formed over the first electrode 1804 with an insulating film 1811 interposed therebetween. The first electrode 1804 and the second electrode 1813 sandwiching the insulating film 1811 form a capacitor 1819. An interlayer insulating film 1814 is formed so as to cover an end portion of the pixel electrode 1803, driving transistors 1818 and the capacitor 1819.

A layer 1815 containing an organic compound and an opposite electrode 1816 are formed over the interlayer insulating film 1814 and the pixel electrode 1803 provided at an opening of the interlayer insulating film 1814. A light emitting element 1817 is formed in a region where the layer 1815 containing an organic compound is sandwiched by the pixel electrode 1803 and the opposite electrode 1816.

Figure 19A:
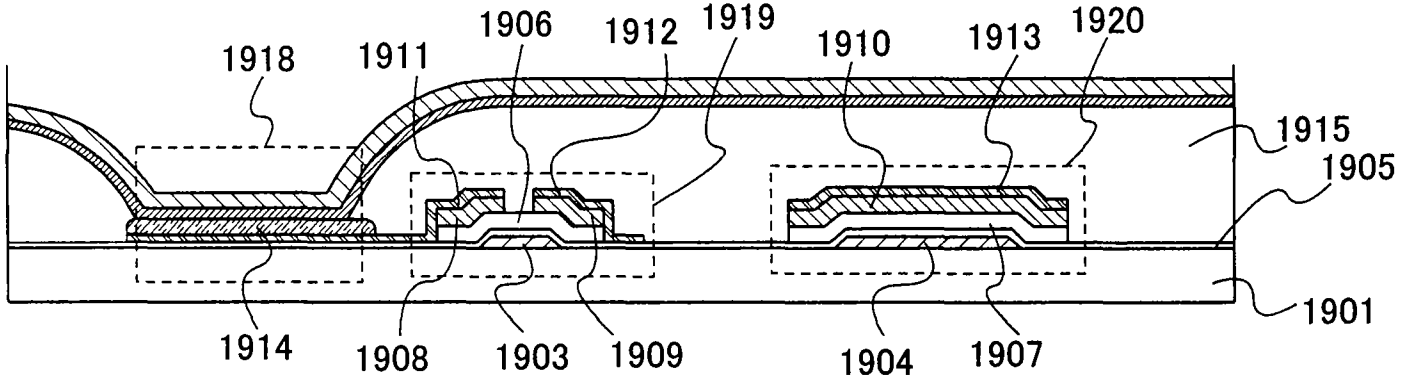
FIGS. 19A and 19B are views showing examples of a display device to which the invention can be applied.
Figure 19B:
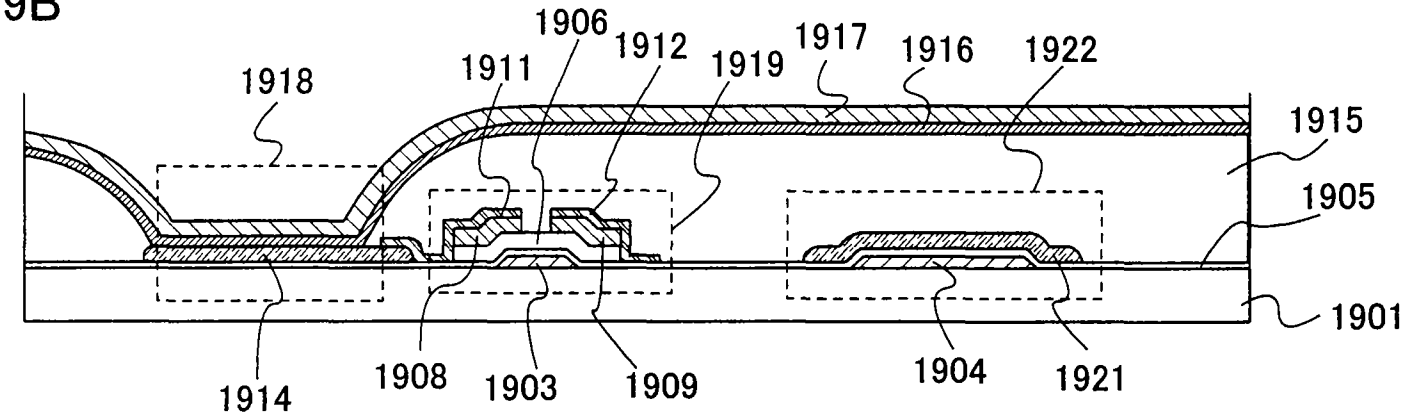

Moreover, the first electrode 1804 shown in FIG. 18A may be formed of a first electrode 1820 as shown in FIG. 18B. The first electrode 1820 is formed in the same layer and of the same material as the wires 1805 and 1806. FIGS. 19A and 19B show cross sections of portions of a panel in a display device formed of a bottom gate transistor having a semiconductor layer formed of amorphous silicon.

A gate electrode 1903 is formed over a substrate 1901. A first electrode 1904 is formed in the same layer and of the same material as the gate electrode 1903. The gate electrode 1903 can be formed of polycrystalline silicon to which phosphorus is added. In addition to polycrystalline silicon, silicide which is a compound of metal and silicon may also be used.

A gate insulating film 1905 is formed so as to cover the gate electrode 1903 and the first electrode 1904. As the gate insulating film 1905, a silicon oxide film, a silicon nitride film, or the like is used. A semiconductor layer 1906 is formed over the gate insulating film 1905. Moreover, a semiconductor layer 1907 is formed in the same layer and of the same material as the semiconductor layer 1906.

N-channel semiconductor layers 1908 and 1909 having n-type conductivity are formed over the semiconductor layer 1906 and an n-channel semiconductor layer 1910 is formed over the semiconductor layer 1907. Wires 1911 and 1912 are formed over the n-channel semiconductor layers 1908 and 1909 respectively. A conductive layer 1913 formed in the same layer and of the same material as the wires 1911 and 1912 is formed over the n-channel semiconductor layer 1910. A second electrode is formed of the semiconductor layer 1907, the n-channel semiconductor layer 1910, and the conductive layer 1913. It is to be noted that a capacitor 1920 is formed of a structure where the gate insulating film 1902 is sandwiched between the second electrode and the first electrode 1904.

One end portion of the wire 1911 extends, and the pixel electrode 1914 is formed in contact with a top portion of the extended wire 1911. An insulating layer 1915 is formed so as to cover the end portion of the pixel electrode 1914, the driving transistor 1919, and the capacitor 1920.

A light emitting layer 1916 and an opposite electrode 1917 are formed over the pixel electrode 1914 and the insulating layer 1915. A light emitting element 1918 is formed in a region where the light emitting layer 1916 is sandwiched between the pixel electrode 1914 and the opposite electrode 1917.

The semiconductor layer 1907 to be a portion of the second electrode of the capacitor and the n-channel semiconductor layer 1910 are not always required to be provided. That is, in the capacitor, the conductive layer 1913 may function as the second electrode and the gate insulating film may be sandwiched between the first electrode 1904 and the conductive layer 1913.

In FIG. 19A, by forming the pixel electrode 1914 before forming the wire 1911, a capacitor 1922 with a structure where a second electrode 1921 formed of the pixel electrode 1914 and the first electrode 1904 sandwich the gate insulating film 1905 can be formed. It is to be noted in FIGS. 19A and 19B that an inversely staggered channel etch type transistor is shown, however, it is needless to say that a channel protective type transistor may also be used. The case of using a channel protective type transistor is described with reference to FIGS. 20A and 20B.

Figure 20A:
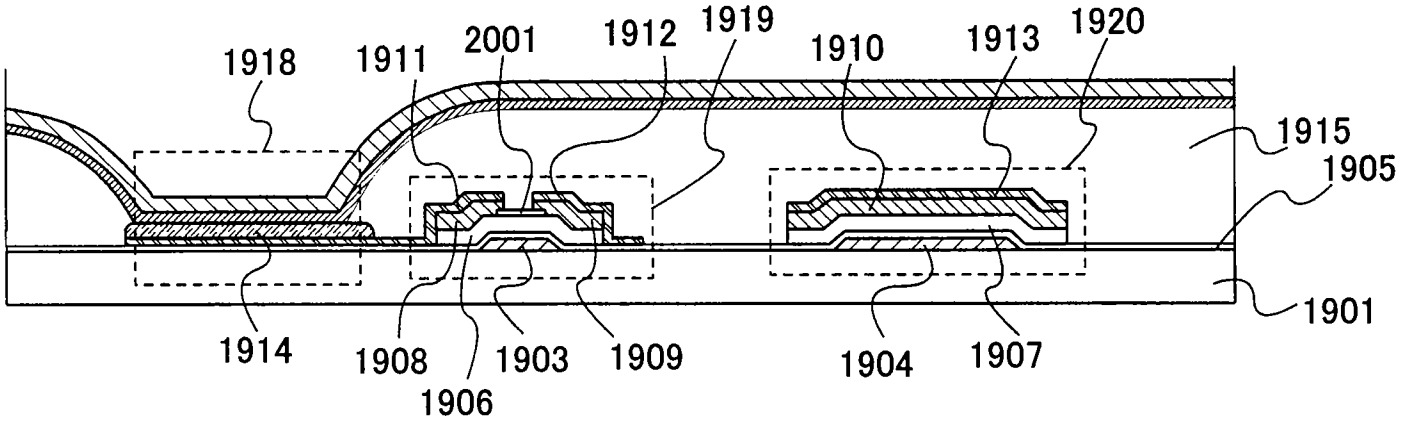
FIGS. 20A and 20B are views showing examples of a display device to which the invention can be applied.
Figure 20B:
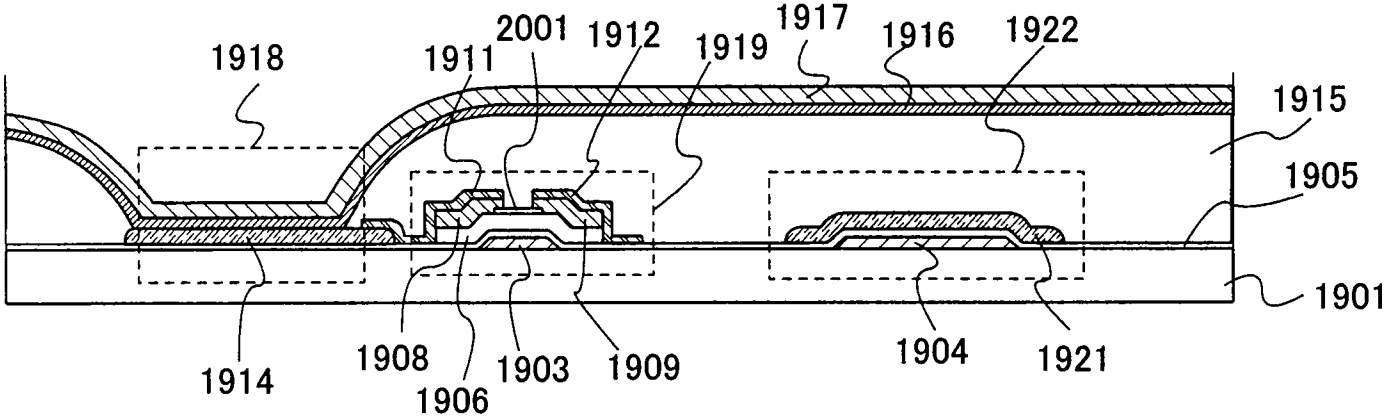

A channel protective type transistor shown in FIG. 20A is different from the channel etch type driving transistor 1919 shown in FIG. 19A in that an insulator 2001 as a mask for etching is provided in a region where a channel of the semiconductor layer 1906 is formed. Other common portions are denoted by the same reference numerals. Similarly, the channel protective type transistor shown in FIG. 20B is different from the channel etch type driving transistor 1919 shown in FIG. 19B in that the insulator 2001 as a mask for etching is provided in a region where a channel of the semiconductor layer 1906 is formed. Other common portions are denoted by the same reference numerals.

By using an amorphous semiconductor film for semiconductor layers (a channel forming region, a source region, a drain region, and the like) which forms a pixel, manufacturing cost can be reduced. It is to be noted that the structures of a transistor and a capacitor which can be applied to a pixel configuration of the invention are not limited to the aforementioned ones and various structures can be used for the transistor and the capacitor.

When manufacturing this display device, a photo mask (a half tone mask) having an inclination in transmittance may be used in the photolithography step. A method for manufacturing a display device to which the invention is applied in the case of using a half tone mask is described below.

Figure 21:
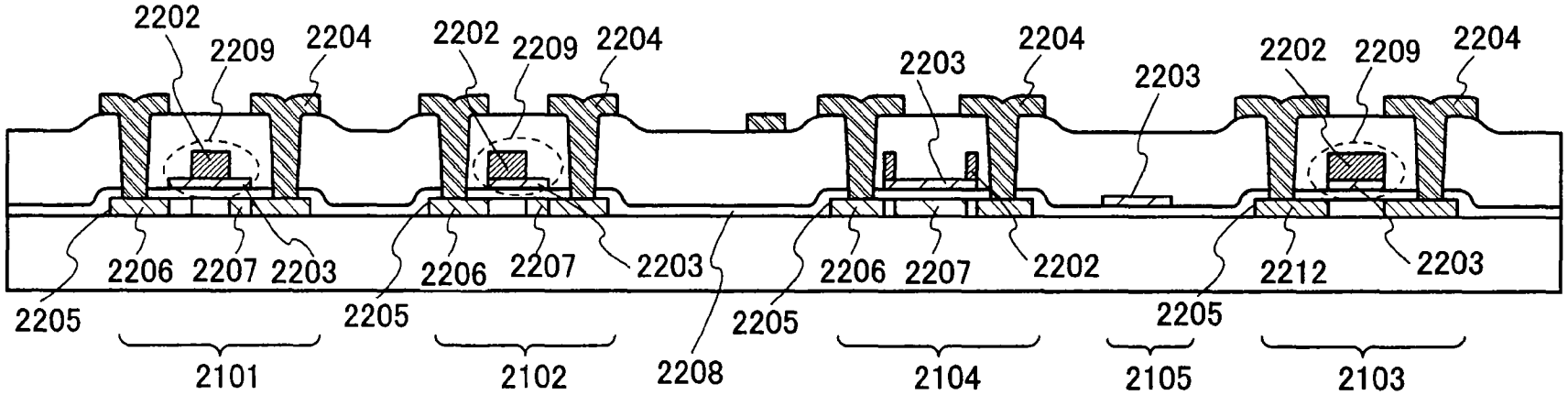
FIG. 21 is a view showing an example of a display device to which the invention can be applied.

A transistor may be a thin film transistor (TFT) as well as a MOS transistor formed over a single crystalline substrate. FIG. 21 is a cross sectional structure of a transistor which forms a circuit. In FIG. 21, an n-channel transistor 2101, an n-channel transistor 2102, a capacitor 2104, a resistor 2105, and a p-channel transistor 2103 are shown. Each transistor includes a semiconductor layer 2205, a gate insulating layer 2208, and a gate electrode 2209. The gate electrode 2209 is formed of a stacked-layer structure of a first conductive layer 2203 and a second conductive layer 2202. Further, FIGS. 22A to 22D can be referred to in combination as top plan views corresponding to the transistor, the capacitor, and the resistor shown in FIG. 21.

In FIG. 21, the n-channel transistor 2101 has, in a channel length direction (a direction of carrier flow), an impurity region 2207 doped with impurities is formed in a semiconductor layer 2205 on both sides of a gate electrode. The impurity region 2207 is doped at a lower concentration than an impurity concentration of an impurity region 2206 which forms a source or drain region which contacts a wire 2204. Such an impurity region is called a low concentration drain (LDD). In the case of forming the n-channel transistor 2101, phosphorus or the like is added as an impurity imparting n-type conductivity to the impurity regions 2206 and 2207. The LDD region is formed for suppressing hot electron deterioration or a short channel effect.

Figure 22A:
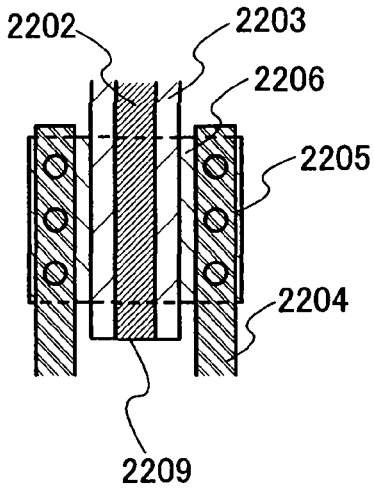
FIGS. 22A to 22E are views showing examples of a display device to which the invention can be applied.

As shown in FIG. 22A, the first conductive layer 2203 is formed so as to expand to both sides of the second conductive layer 2202 in the gate electrode 2209 of the n-channel transistor 2101. In this case, the thickness of the first conductive layer 2203 is thinner than that of the second conductive layer. The thickness of the first conductive layer 2203 is formed thin enough for ion species to pass through, which are accelerated in an electric field of 10 to 100 kV. The impurity region 2207 is formed so as to overlap the first conductive layer 2203 of the gate electrode 2209. That is, an LDD region overlapping the gate electrode 2209 is formed. In this structure, by adding impurities imparting one conductivity type to the gate electrode 2209 through the first conductive layer 2203 with the second conductive layer 2202 as a mask, the impurity region 2207 is formed in a self-aligned manner. That is, an LDD region overlapping the gate electrode is formed in a self-aligned manner.

Figure 22B:
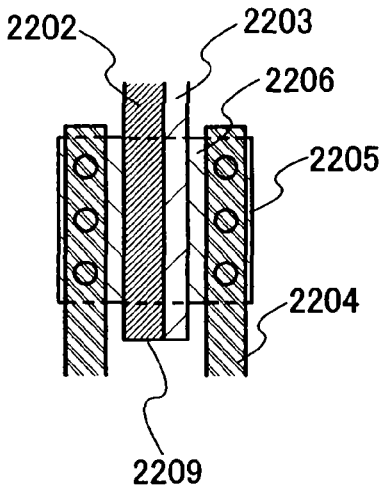

In FIG. 21, in the n-channel transistor 2102, the impurity region 2207 doped with impurities at a lower concentration than an impurity concentration of the impurity region 2206 is formed on one side of a gate electrode in the semiconductor layer 2205. As shown in FIG. 22B, the first conductive layer 2203 is formed so as to expand to one side of the second conductive layer 2202 in the gate electrode 2209 of the n-channel transistor 2102. In this case also, by adding impurities imparting one conductivity type through the first conductive layer 2203 with the second conductive layer 2202 as a mask, an LDD region can be formed in a self-aligned manner.

A transistor having an LDD region on one side may be used as a transistor in which only a positive voltage or a negative voltage is applied between a source electrode and a drain electrode. In specific, such a transistor may be applied to a transistor which forms a logic gate such as an inverter circuit, a NAND circuit, a NOR circuit, and a latch circuit, or a transistor which forms an analog circuit such as a sense amplifier, a constant voltage generating circuit, and VCO.

Figure 22C:
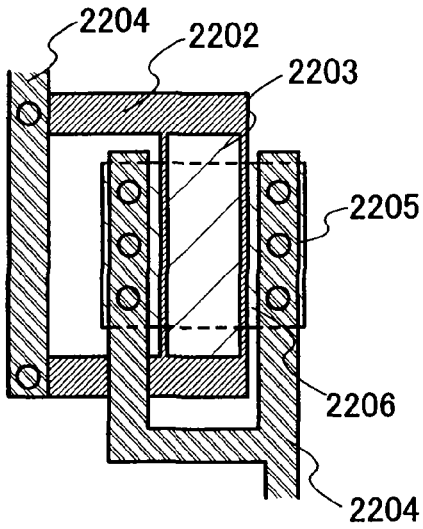
Figure 22D:
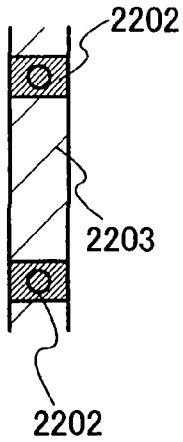
Figure 22E:
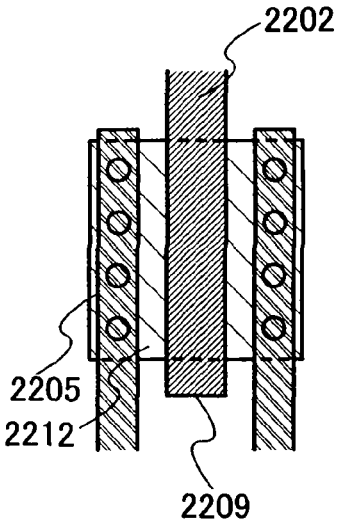

In FIG. 21, the capacitor 2104 is formed of the first conductive layer 2203 and the semiconductor layer 2205 sandwiching the gate insulating layer 2208. The semiconductor layer 2205 forming the capacitor 2104 is provided with the impurity region 2206 and the impurity region 2207. The impurity region 2207 is formed so as to overlap the first conductive layer 2203 in the semiconductor layer 2205. Moreover, the impurity region 2206 contacts the wire 2204. Impurities imparting one conductivity type can be added to the impurity region 2207 through the first conductive layer 2203, therefore, the impurity concentrations of the impurity regions 2206 and 2207 can be set the same or different. In either case, the semiconductor layer 2205 in the capacitor 2104 functions as an electrode, therefore, it is preferable to add impurities imparting one conductivity type so as to achieve low resistance. Moreover, the first conductive layer 2203 can function as an electrode sufficiently by using the second conductive layer 2202 as an auxiliary electrode as shown in FIG. 22C. In this manner, by forming a multiple electrode structure in which the first conductive layer 2203 and the second conductive layer 2202 are combined, the capacitor 2104 can be formed in a self-aligned manner.

In FIG. 21, a resistor 2105 is formed of the first conductive layer 2203. The first conductive layer 2203 is formed with a thickness of 30 to 150 nm, therefore, the width and length thereof are appropriately set to form the resistor.

In FIG. 21, the p-channel transistor 2103 has the semiconductor layer 2205 provided with an impurity region 2212. This impurity region 2212 forms a source region and a drain region which contact the wire 2204. The gate electrode 2209 is formed of the first conductive layer 2203 overlapped with the second conductive layer 2202. The p-channel transistor 2103 is a single drain transistor without an LDD region. In the case of forming the p-channel transistor 2103, boron or the like is added as an impurity imparting p-type conductivity to the impurity region 2212. On the other hand, by adding phosphorus to the impurity region 2212, a single drain n-channel transistor can also be formed.

One or both of the semiconductor layer 2205 and the gate insulating layer 2208 may be oxidized or nitrided by high density plasma treatment which is excited by microwaves and has an electron temperature of 2 eV or lower, an ion energy of 5 eV or lower, and an electron density of about $10^{11}$ to $10^{13}$ $cm^{-3}$. At this time, by performing treatment with a substrate temperature of 300 to 450° C. in an oxygen atmosphere ($O_2$, $N_2O$, or the like) or a nitrogen atmosphere ($N_2$, $NH_3$, or the like), a defect level of an interface between the semiconductor layer 2205 and the gate insulating layer 2208 can be reduced. By performing this treatment to the gate insulating layer 2208, the gate insulating layer 2208 can be densified. That is, generation of a charge defect can be suppressed, thereby a change in a threshold voltage level can be suppressed. When the transistor is driven with a voltage of lower than 3 V, an insulating layer which is oxidized or nitrided by this plasma treatment can be used as the gate insulating layer 2208. When the transistor is driven with a voltage of 3 V or higher, the gate insulating layer 2208 can be formed by using an insulating layer formed over the surface of the semiconductor layer 2205 by this plasma treatment and an insulating layer accumulated by a CVD method (a plasma CVD method or a thermal CVD method) in combination. Moreover, this insulating layer can be used as a dielectric layer of the capacitor 2104 as well. In this case, the insulating layer formed by this plasma treatment is formed with a thickness of 1 to 10 nm and dense, therefore, a capacitor having large capacitance can be formed.

As described with reference to FIGS. 21A and 22A to 22E, by using conductive layers with different thicknesses in combination, elements with various structures can be formed. A region where only the first conductive layer is formed and a region where the first conductive layer and the second conductive layer are stacked can be formed by using a photo mask or a reticle provided with a diffraction grating pattern or an auxiliary pattern having a light intensity reducing function formed of a translucent film. That is, in a photolithography step, amounts of light transmitting a photo mask are controlled when exposing the photo resist, thereby the thickness of a developed resist mask is differentiated. In this case, a slit of a resolution limit or lower may be provided in the photo mask or the reticle to form a resist with the aforementioned complicated shape. Further, baking treatment at about 200° C. may be performed after the development so as to deform a mask pattern formed of a photo resist material.

By using a photo mask or a reticle provided with a diffraction grating pattern or an auxiliary pattern which is formed of a translucent film and has a light intensity reducing function, a region where only the first conductive layer is formed and a region where the first conductive layer and the second conductive layer are stacked can be continuously formed. As shown in FIG. 22A, the region where only the first conductive layer is formed can be selectively formed over a semiconductor layer. Such a region is effective over the semiconductor layer, however, is not required in other regions (a wiring region connected to a gate electrode). By using this photo mask or reticle, a region where only the first conductive layer is formed is not formed in the wiring portion, therefore, wiring density can be substantially enhanced.

In the case of FIGS. 21 and 22A to 22E, the first conductive layer is formed of a high melting point metal such as tungsten (W), chromium (Cr), tantalum (Ta), tantalum nitride (TaN), or molybdenum (Mo), an alloy or a compound containing the high melting point metal as a main component with a thickness of 30 to 50 nm. Further, the second conductive layer is formed of a high melting point metal such as tungsten (W), chromium (Cr), tantalum (Ta), tantalum nitride (TaN), or molybdenum (Mo), an alloy or a compound containing the high melting point metal as a main component with a thickness of 300 to 600 nm. For example, the first conductive layer and the second conductive layer are formed of different conductive materials so that they have different etching rates in a subsequent etching step. For example, the first conductive layer is formed of TaN and the second conductive layer is formed of a tungsten film.

In this embodiment mode, transistors, capacitors, and resistors with different electrode structures can be formed in the same step by using a photo mask or a reticle provided with a diffraction grating pattern or an auxiliary pattern having a light intensity reducing function, which is formed of a translucent film. As a result, elements of different modes can be formed in accordance with the characteristics of the circuit and integrated without increasing the number of steps.

Embodiment Mode 8

Figure 10:
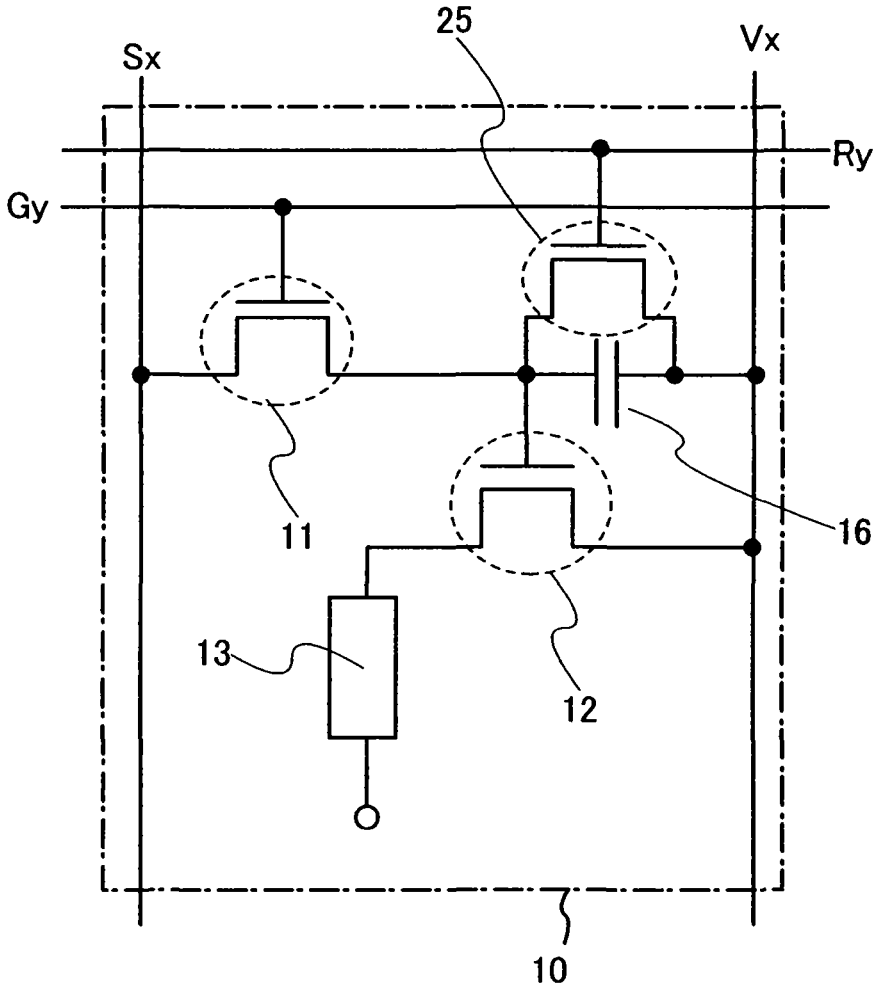
FIG. 10 is a diagram showing an equivalent circuit of a pixel of the invention.

In this embodiment mode, a pixel configuration which can be applied to the invention is described as an example. It is to be noted that the same configuration as FIG. 3 is not described here. FIG. 10 shows a pixel configuration where a third transistor 25 is provided on both ends of the capacitor 16 in the pixel configuration shown in FIG. 3. The third transistor 25 has a function to discharge a charge accumulated in the capacitor 16 for a predetermined period. This third transistor 25 is also referred to as an erasing transistor. The predetermined period is controlled by an erasing gate line Ry connected to a gate electrode of the third transistor 25.

For example, in the case of providing a plurality of subframe periods, the charge in the capacitor 16 is discharged by the third transistor 25 in a short subframe period. As a result, a duty ratio can be improved.

Figure 11A:
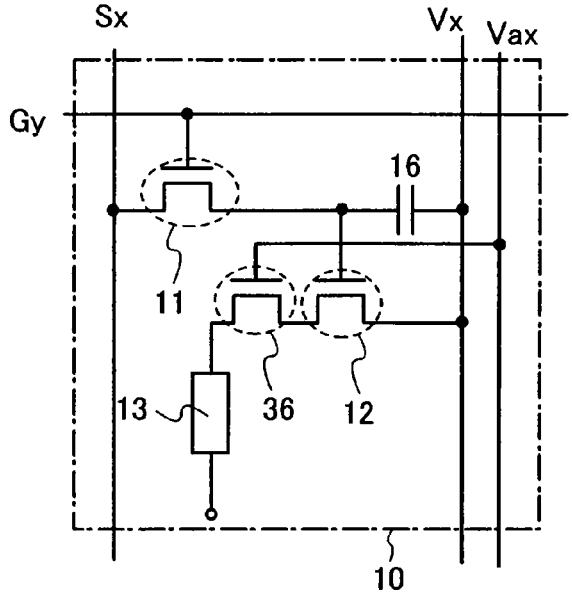
FIGS. 11A to 11C are diagrams showing equivalent circuits of a pixel of the invention.
Figure 11B:
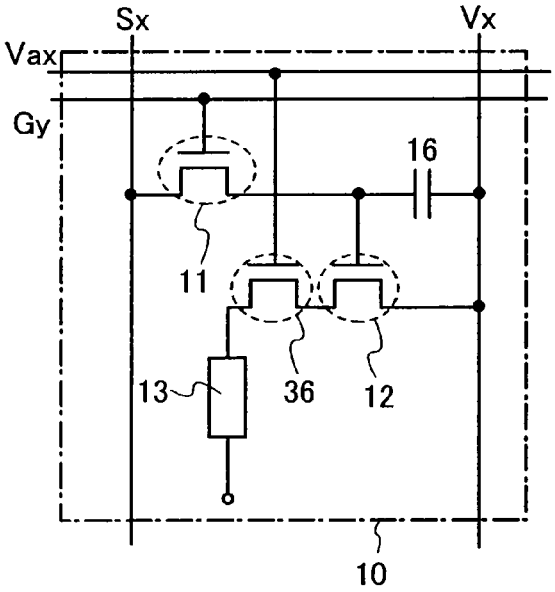
Figure 11C:
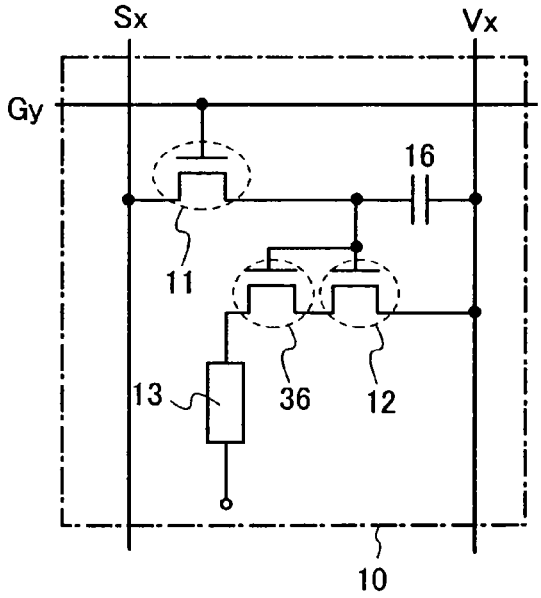

FIG. 11A shows a pixel configuration where a fourth transistor 36 is provided between the driving transistor 12 and the light emitting element 13 in the pixel configuration shown in FIG. 3. A second power supply line Vax at a fixed potential is connected to a gate electrode of the fourth transistor 36. Therefore, a current supplied to the light emitting element 13 can be set constant independent of a gate-source voltage of the driving transistor 12 or the fourth transistor 36. The fourth transistor 36 is also referred to as a current controlling transistor. FIG. 11B shows a pixel configuration where the second power supply line Vax at a fixed potential is provided in parallel to the gate line Gy, which is different from FIG. 11A. FIG. 11C shows a pixel configuration where the gate electrode of the fourth transistor 36 at a fixed potential is connected to the gate electrode of the driving transistor 12, which is different from FIGS. 11A and 11B. An aperture ratio can be kept in the pixel configuration where a power supply line is not additionally provided as shown in FIG. 11C.

Figure 12:
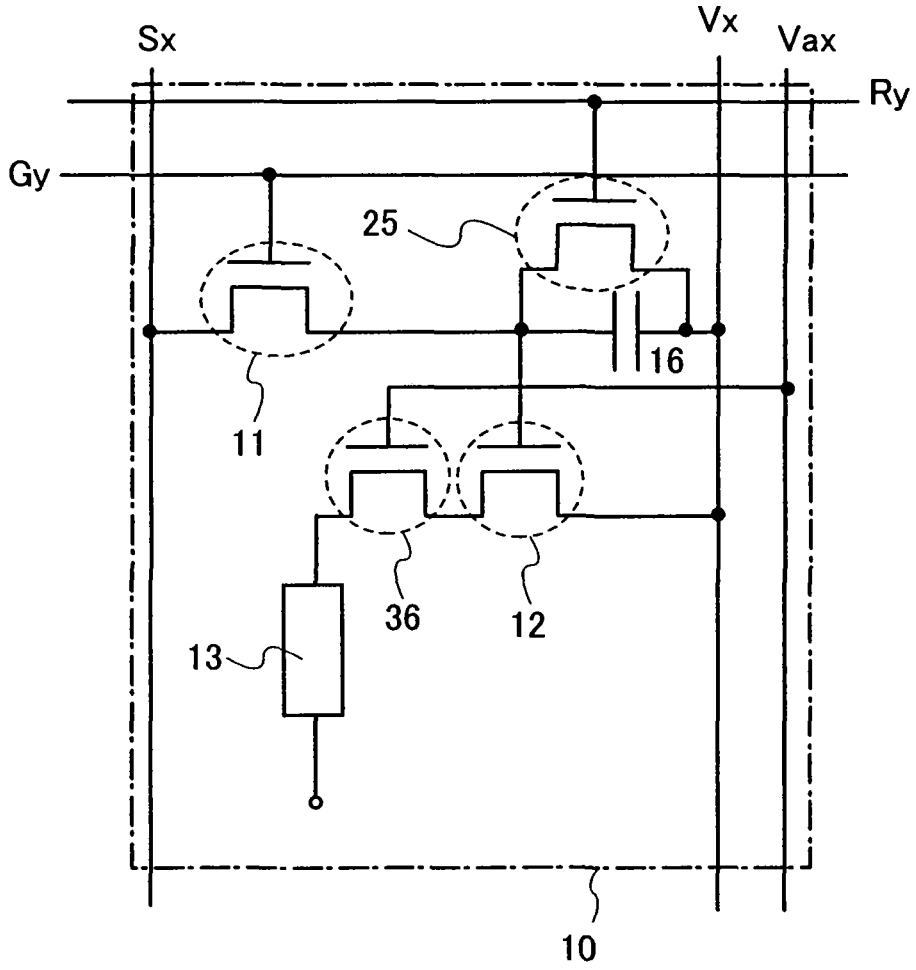
FIG. 12 is a diagram showing an equivalent circuit of a pixel of the invention.

FIG. 12 shows a pixel configuration where the erasing transistor 25 shown in FIG. 10 is provided in the pixel configuration shown in FIG. 11A. By the erasing transistor, the charge in the capacitor 16 can be discharged. It is needless to say that an erasing transistor can be provided in the pixel configuration shown in FIG. 11B or 11C.

Here, a pixel circuit where a plurality of subpixels are provided in one pixel is described. Although not shown, in the case where the plurality of subpixels are provided in one pixel and driven independently, data lines, scan lines, and power supply lines are provided in the same number as the subpixels and elements for one pixel are to be provided. However, the data lines, scan lines, and power supply lines may be shared by the subpixels if possible. A circuit example where the line is shared is described below.

Figure 23A:
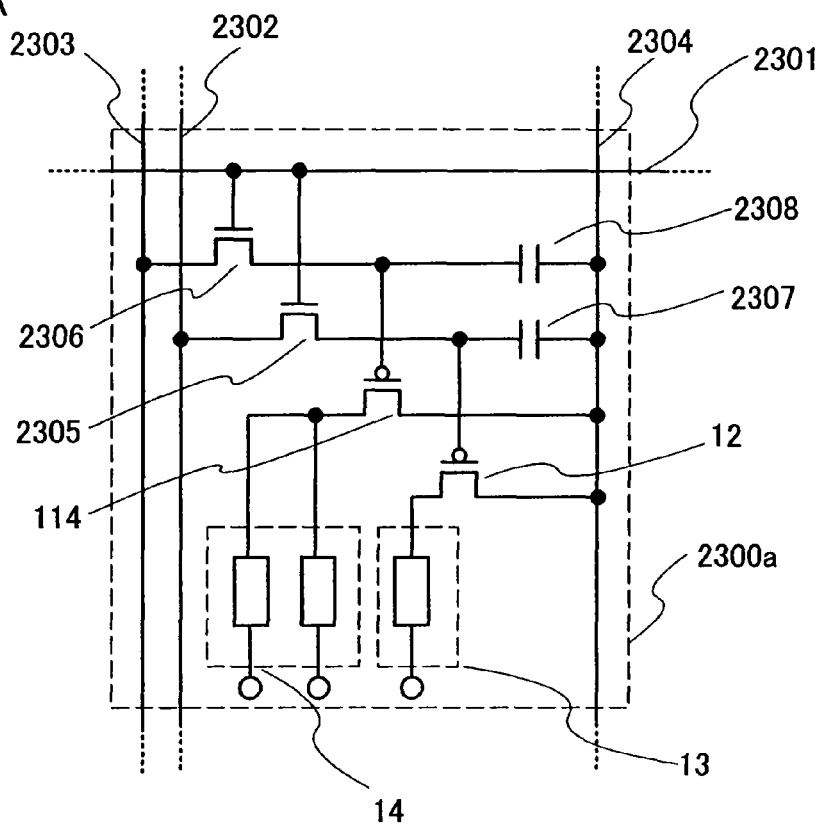
FIGS. 23A and 23B are diagrams showing equivalent circuits of a pixel of the invention.
Figure 23B:
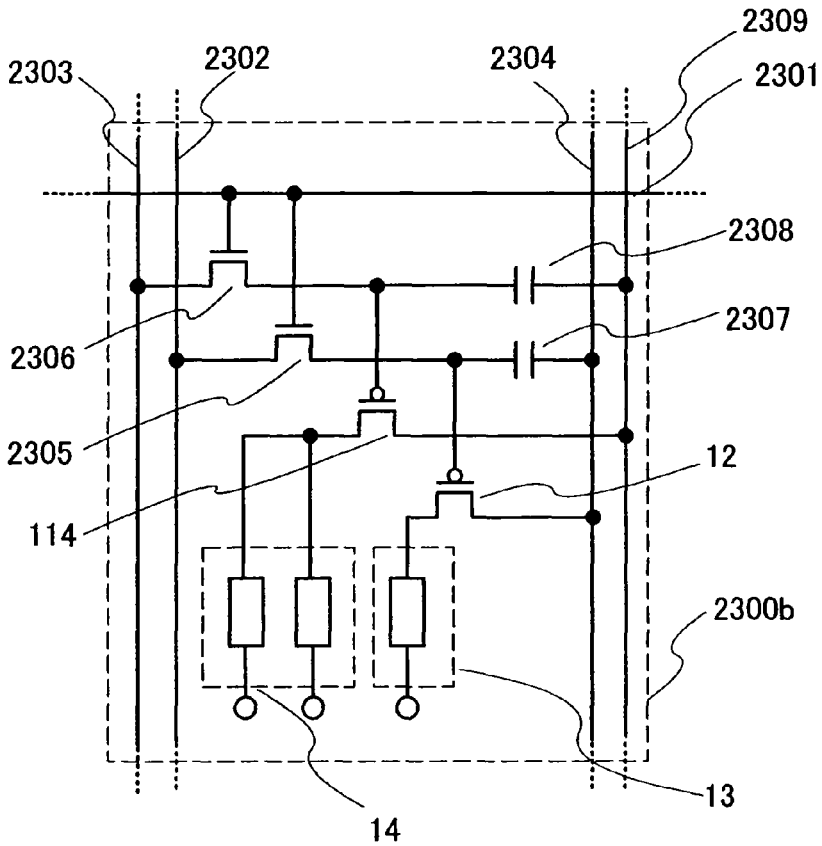

FIG. 23A shows a pixel circuit diagram of the case where a power supply line and a scan line connected to one of a source region or a drain region of a driving transistor is shared by subpixels. FIG. 23B shows a pixel circuit diagram of the case where only a scan line is shared. The first driving transistor 12, the first light emitting element 13, the second driving transistor 114, and the second light emitting element 14 are equivalent to those shown in FIG. 1. In FIG. 23A, in addition to these, a scan line 2301, a first data line 2302, a second data line 2303, a power supply line 2304, a first selecting transistor 2305, a second selecting transistor 2306, a first capacitor 2307, and a second capacitor 2308 are provided. In FIG. 23B, a second power supply line 2309 is provided in addition to these.

The first selecting transistor 2305, the first capacitor 2307, the first driving transistor 12, and the first light emitting element 13 form a first subpixel. Similarly, the second selecting transistor 2306, the second capacitor 2308, the second driving transistor 114, and the second light emitting element 14 form a second subpixel.

A timing to scan may be the same in the subpixels, therefore, a scan line may be shared by the subpixels and data lines may be independently provided for each of them as shown in FIG. 23A. By sharing the scan line, a layout of a pixel circuit has a margin, thereby a pixel aperture ratio can be enhanced. Moreover, yield can also be improved.

Figure 24A:
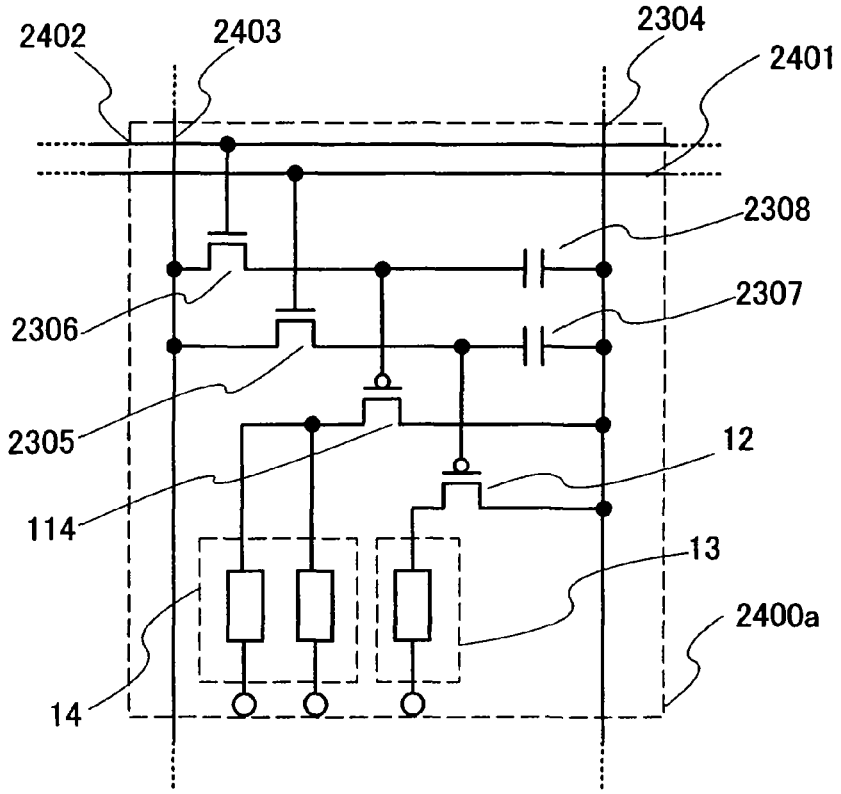
FIGS. 24A and 24B are diagrams showing equivalent circuits of a pixel of the invention.
Figure 24B:
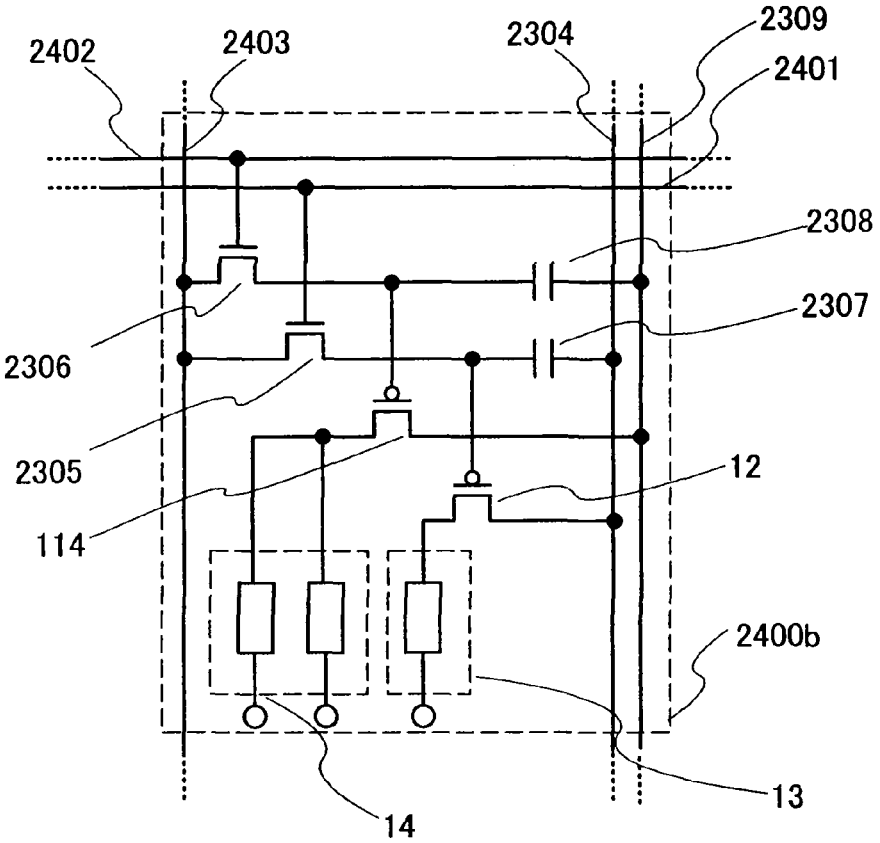

FIG. 24A shows a pixel circuit diagram of the case where a power supply line connected to one of a source region or a drain region of a driving transistor and a data line connected to one of a source region or a drain region of a selecting transistor are shared by a data line 2403 in subpixels. FIG. 24B shows a pixel circuit diagram of the case where only the data line is shared. As shown in a scan line 2401 and a scan line 2402 of FIGS. 24A and 24B, by changing a scan timing for each subpixel by separately providing scan lines, a data line may be shared. By sharing the data line, a layout of a pixel circuit has a margin, thereby a pixel aperture ratio can be enhanced. Moreover, yield can also be improved. As the data line has little parasitic capacitance, power consumption for charging and discharging the data line becomes small.

In the case of performing an area grayscale display by sharing a wire by subpixels, a multi-level grayscale can be realized without decreasing the pixel aperture ratio and yield as compared to the pixel without a subpixel. It is to be noted that when the power supply line is not shared, there are special effects such that deterioration and temperature can be corrected by a monitor light emitting element in each subpixel and that a voltage change due to a voltage drop caused by a current flowing through the power supply line can be reduced as shown in Embodiment Mode 1, therefore, the case where a power supply line is not shared is also described.

Next, a pixel circuit of a display device capable of performing full color display using the invention is described. In case where deterioration and characteristics change by temperature of light emitting elements differ depending on light emission colors of the light emitting elements in a display device having pixels separately formed into R, G, and B, the configuration of the invention may be applied to each color as shown in FIGS. 25A and 25B.

Figure 25A:
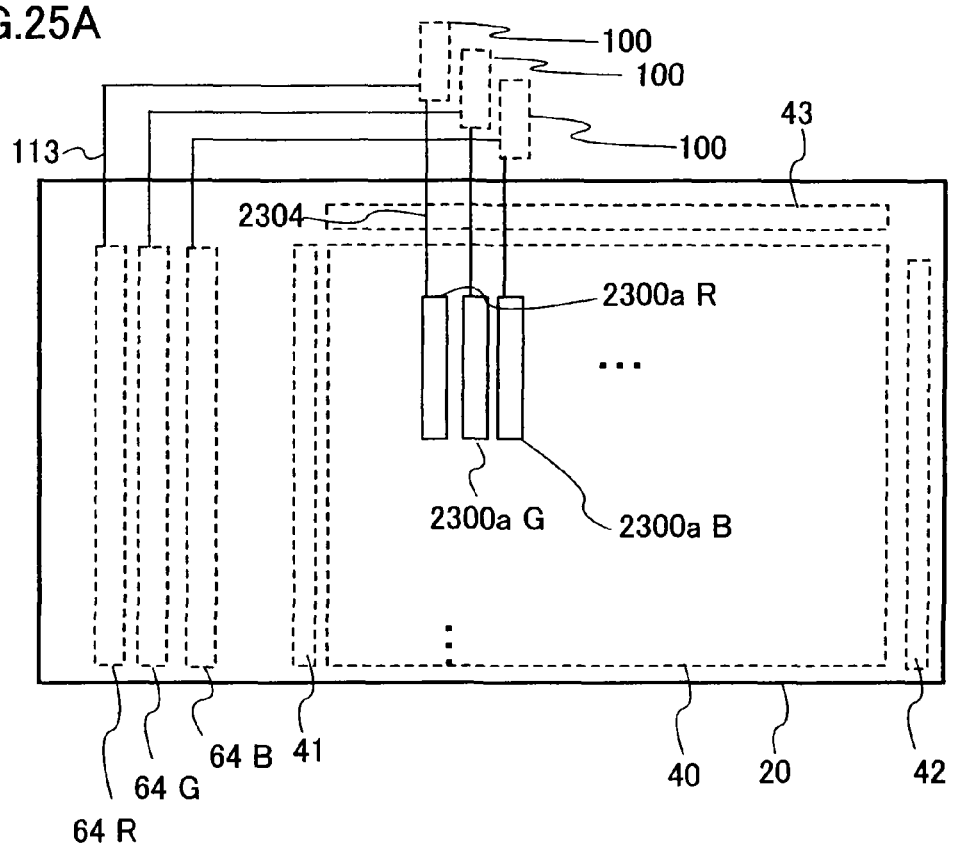
FIGS. 25A and 25B are diagrams showing a display device of the invention.

FIG. 25A shows a configuration where the invention is applied to a display device where the light emitting elements of a pixel 2300*a* shown in FIG. 23A are separately formed into R, G, and B. In this case, the monitor circuits 64 may be similarly formed separately for different colors so that the characteristics change by deterioration or temperature can be corrected by each of R, G, and B. Here, the pixel configuration may be similar to a pixel 2400*a* in FIG. 24A instead of FIG. 23A.

Figure 25B:
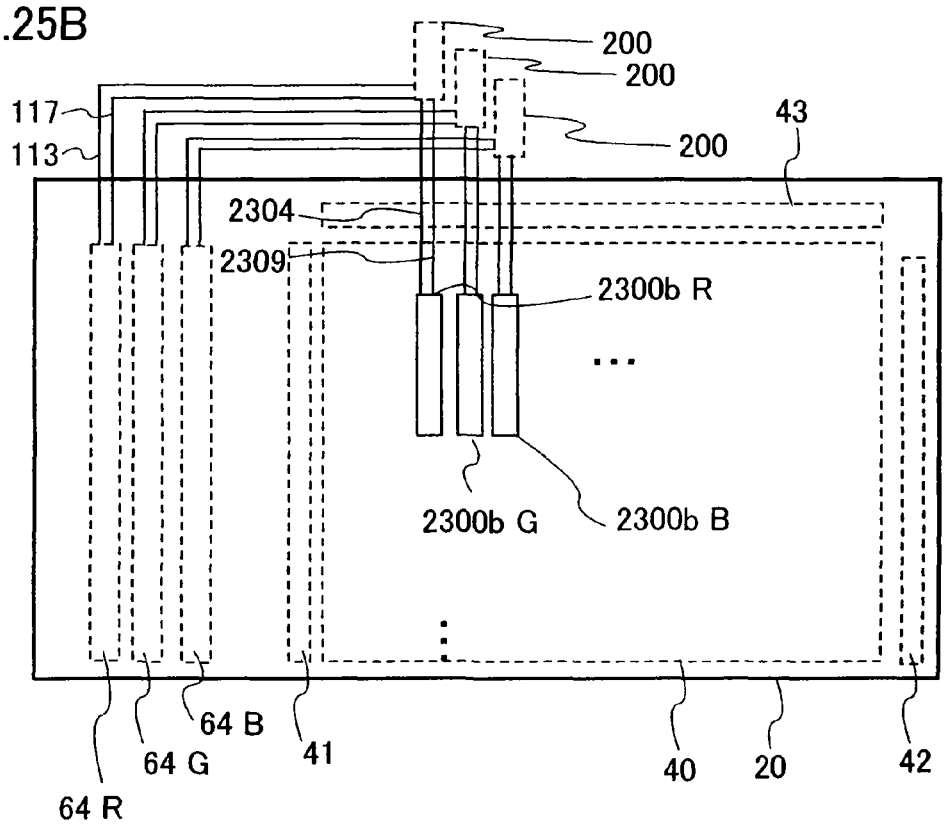

FIG. 25B shows a configuration of a display device where the light emitting elements of a pixel 2300*b* shown in FIG. 23B are separately formed into R, G, and B, to which the invention is applied. In this case, the monitor circuits 64 may be similarly formed separately for different colors so that the characteristics change by deterioration or temperature can be corrected by each of R, G, and B. Here, the pixel configuration may be similar to a pixel 2400*b* in FIG. 24B instead of FIG. 23B. Moreover, one pixel may be divided into three or more as shown in FIG. 26 as a pixel configuration to achieve full color display. At this time, the monitor circuits 64 may be provided in the same number as the divided pixels to correct the characteristics change by deterioration or temperature of each light emitting element.

Figure 26A:
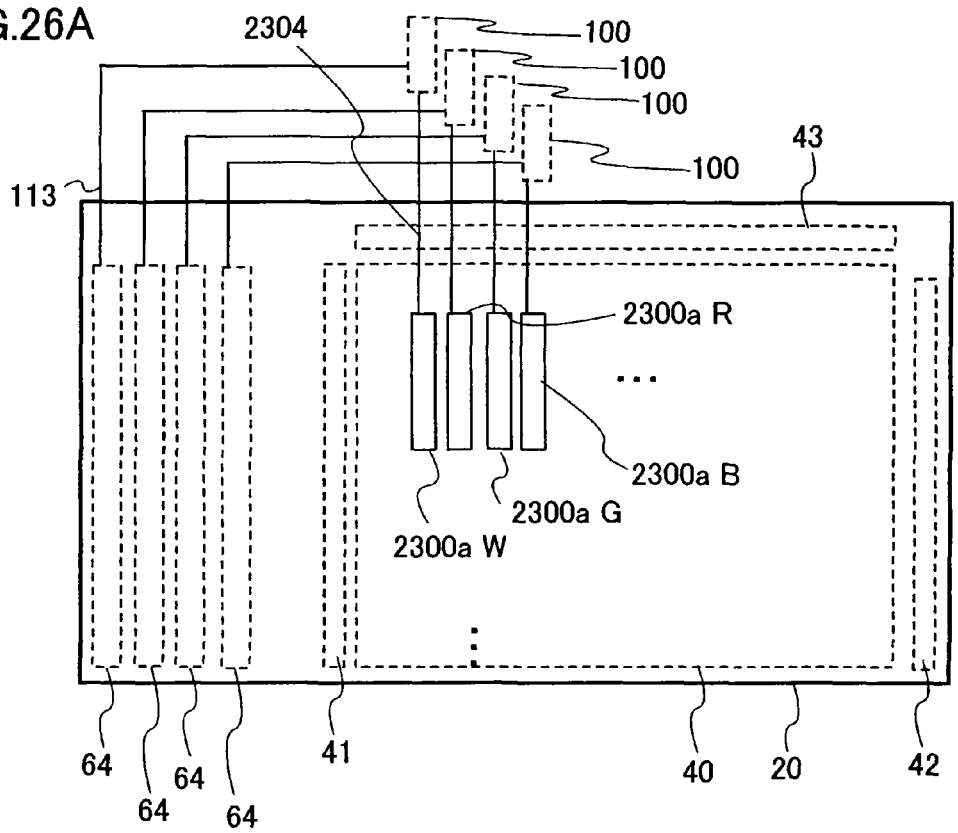
FIGS. 26A and 26B are diagrams showing a display device of the invention.

FIG. 26A shows a configuration where the invention is applied to a display device where the light emitting elements of the pixels shown in FIG. 23A are separately formed into W, R, G, and B. In this case, the monitor circuits 64 may be similarly formed separately for different colors so that the characteristics change by deterioration or temperature can be corrected by each of W, R, G, and B. Here, the pixel configuration may be similar to FIG. 24A instead of FIG. 23A.

Figure 26B:
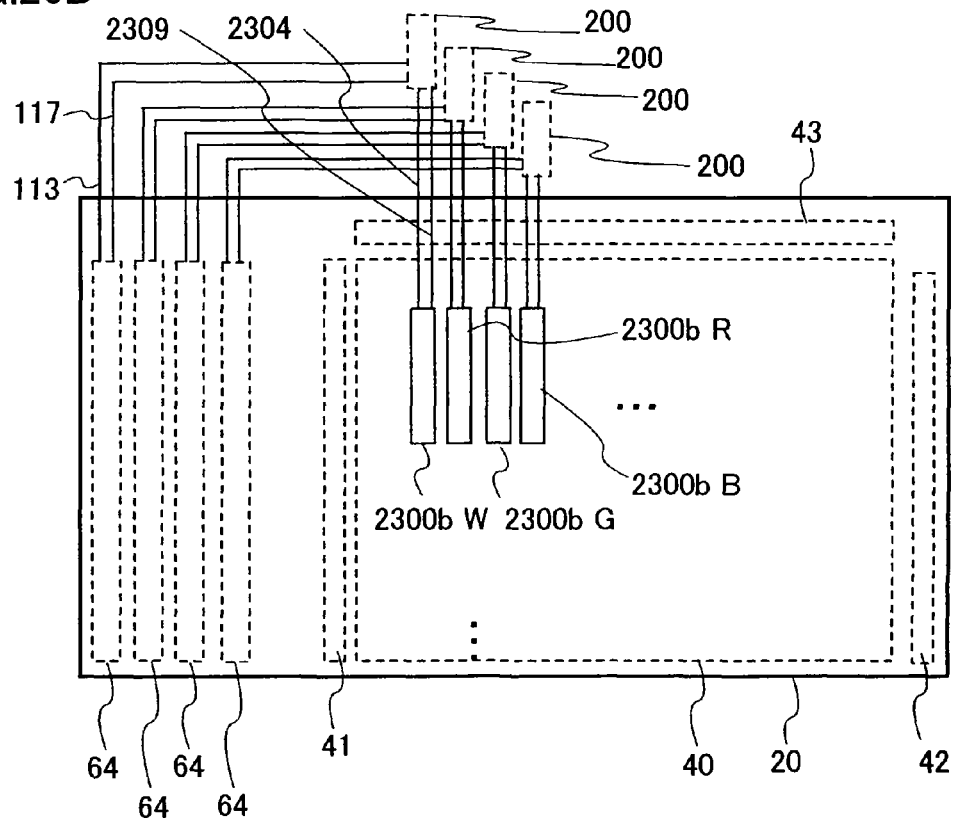

FIG. 26B shows a configuration where the invention is applied to a display device where the light emitting elements of the pixels shown in FIG. 23B are separately formed into W, R, G, and B. In this case, the monitor circuits 64 may be similarly formed separately for different colors so that the characteristics change by deterioration or temperature can be corrected by each of W, R, G, and B. Here, the pixel configuration may be similar to FIG. 24B instead of FIG. 23B.

In FIGS. 25 and 26, the same number of power supply lines are provided in all of the divided pixels, however, the invention is not limited to this. For example, only the W pixel may have the configuration shown in FIG. 23A while the R, G, and B pixels have the configuration shown in FIG. 23B. In this manner, each of the pixel circuits formed separately into colors may have a different pixel configuration, which can be freely selected.

Embodiment Mode 9

In this embodiment mode, a pixel configuration where the invention is applied to a display device constituted by transistors formed of amorphous silicon and a method for writing luminance data to the pixel are described.

With a semiconductor integrated device formed of amorphous silicon, it is difficult to form what is called a CMOS circuit where transistors with different conductivity are integrated because of its manufacturing steps. Even if possible, the manufacturing steps inevitably become complicated as compared to the case of forming only transistors with single conductivity. Therefore, low cost realized by simple manufacturing steps, which is the greatest advantage of using amorphous silicon cannot be achieved. In the case of designing a semiconductor integrated device formed of amorphous silicon, it is required to consider constituting a circuit using only transistors with single conductivity.

A transistor formed of amorphous silicon is different from a transistor formed of bulk silicon or polysilicon in that it deteriorates with time, in particular, a threshold value increases faster by continuing operation. It is a major factor of the increase in threshold value that a charge trapped in a gate insulating film increases and defect density of a channel portion becomes high when a positive voltage keeps being applied to a gate electrode of the transistor. In order to suppress these phenomena and suppress a threshold value shift of the transistor, for example, there is a method to provide a period to apply a negative voltage to the gate electrode.

Figure 27:
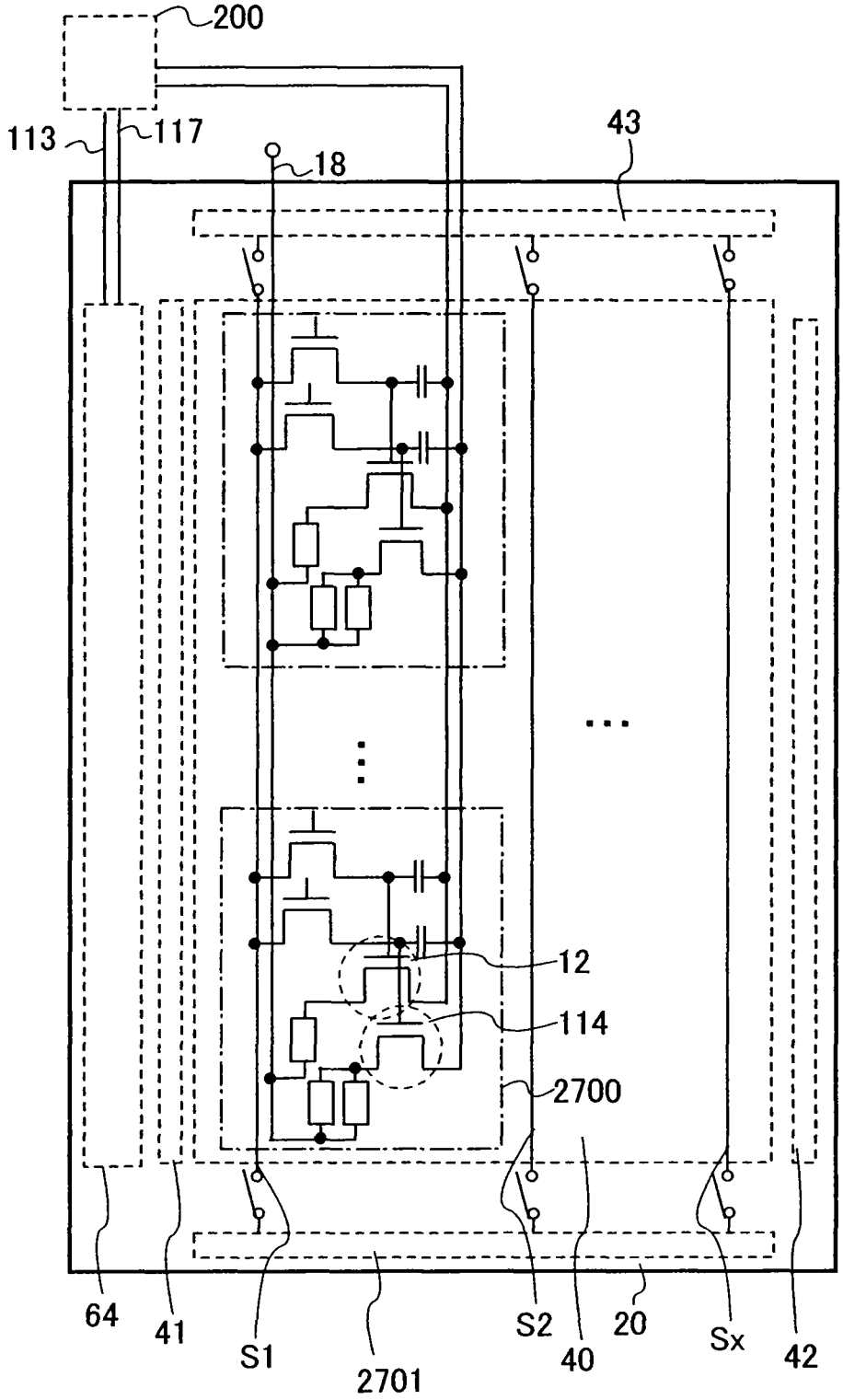
FIG. 27 is a diagram showing a display device of the invention.

FIG. 27 shows a configuration of a display device for suppressing the deterioration with time of a transistor formed of amorphous silicon. The elements in FIG. 27 which are the same as those in FIG. 2 are considered to have the same or approximately the same functions. Reference numeral 2700 denotes a pixel circuit, 2701 denotes a precharge circuit, S1 to Sx denote data lines for transmitting luminance signals to be written to the pixels. The data lines S1 to Sx are connected to the signal line driver circuit 43 and the precharge circuit 2701 through switches. One data line is provided with two switches, however, both of these switches are not turned on at the same time, and at least either one of them is turned on. Moreover, the conductivity of the transistors which constitute the pixel circuit 2700 are all n-channel type.

The precharge circuit 2701 operates before the signal line driver circuit 43 operates and a predetermined voltage is written to pixels. That is, the switches on the precharge circuit 2701 side are turned on among the switches provided in the data lines S1 to Sx. The voltage written to the pixel is once set at a voltage determined by the precharge circuit 2701, and then the switches provided in the data lines S1 to Sx are changed over, thereby the voltage predetermined by the signal line driver circuit 43 is written to the pixels.

Here, the precharge voltage determined by the precharge circuit 2701 is preferably set the same or lower than a voltage to turn off the driving transistors 12 and 144 and the same or higher than a potential of the power source 18. As described above, it is effective to provide a period to apply a negative voltage to a gate electrode of a transistor formed of amorphous silicon in order to suppress a threshold voltage shift due to the deterioration with time. By setting a voltage written to the pixels in a precharge period to be lower than a voltage to turn off the driving transistors 12 and 114, a period where gate voltages of all the driving transistors become negative voltages can be provided, and thus a threshold voltage shift due to the deterioration with time of the driving transistors can be reduced. Further, it is preferable to set the precharge voltage to be the same or higher than the potential of the power source 18 on the opposite electrode side because the power consumption and cost of the power supply circuit increase when the precharge voltage is too low.

The precharge circuit 2701 is provided for applying a constant voltage to gate electrodes of all the driving transistors, therefore, an electrical element is not required in the circuit, and the precharge circuit 2701 may be a wire for supplying an externally inputted power supply to the data lines S1 to Sx.

Figure 28:
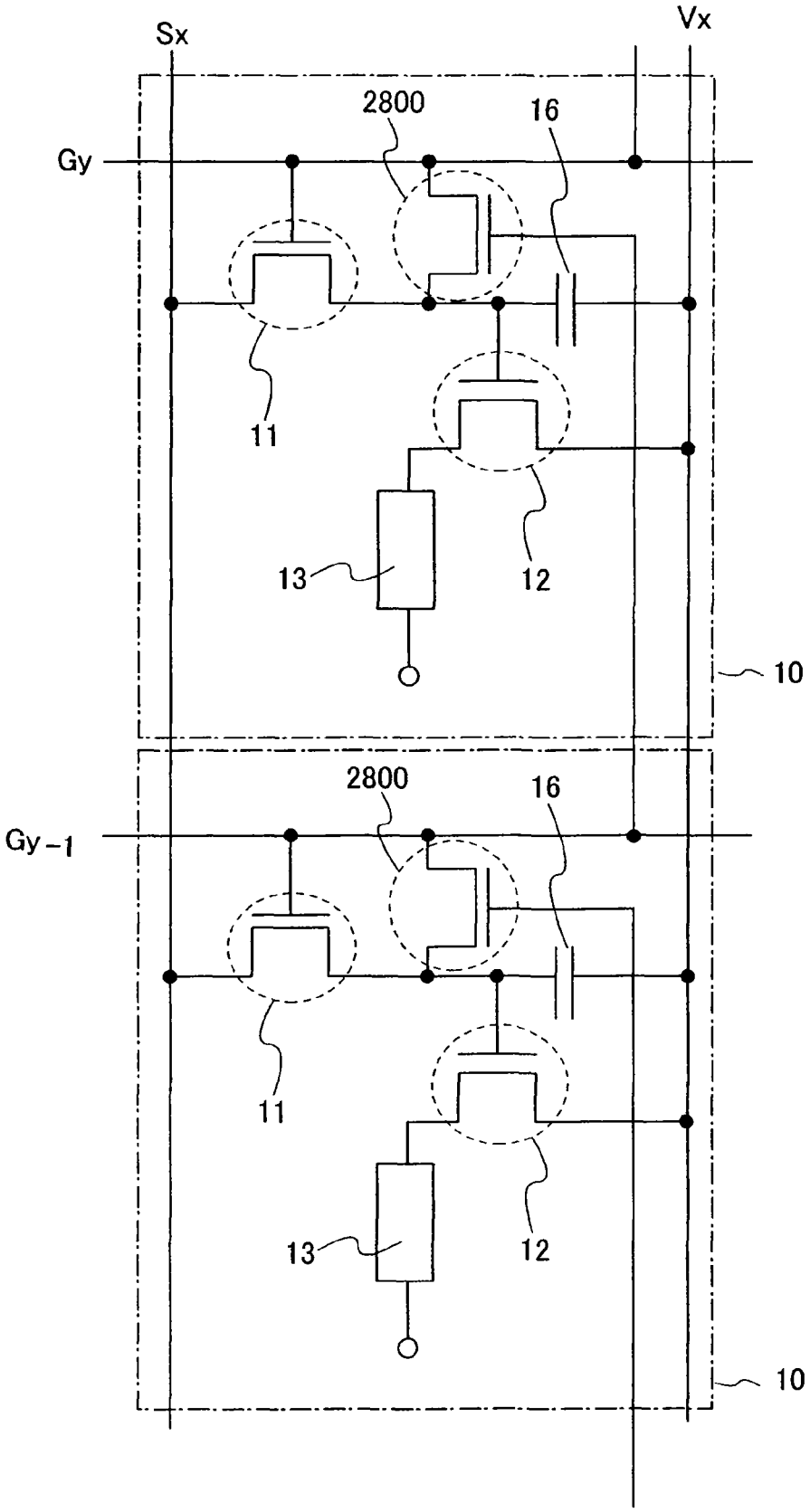
FIG. 28 is a diagram showing a suitable pixel configuration for applying a negative voltage to a gate of a driving transistor.

Next, a pixel configuration suitable for applying a negative voltage to a gate of a driving transistor is described with reference to FIG. 28. FIG. 28 is a circuit diagram of two pixels provided adjacent in a gate line direction, which corresponds to the pixel circuit shown in FIG. 3 which is additionally provided with a transistor 2800 for applying a negative voltage. A gate electrode of the transistor 2800 for applying a negative voltage is connected to a scan line of a preceding pixel, one of a source electrode or a drain electrode of the transistor 2800 for applying a negative voltage is connected to a scan line of the pixel, and the other thereof is connected to the gate electrode of the driving transistor 12.

By exactly the same way as the circuit shown in FIG. 3, the pixel shown in FIG. 28 can be driven in such a manner that a negative voltage is applied to the gate electrode of the driving transistor 12 without using any special driving method. The transistor 2800 of the pixel is turned on at a timing that the preceding pixel is selected. Then, a potential of a scan line of the pixel is at a low potential, therefore, the potential of the gate electrode of the driving transistor 12 becomes low through the transistor 2800. At this time, a negative voltage is applied to the gate electrode of the driving transistor 12. When the pixel is selected, the potential of the gate electrode of the transistor 2800 becomes low and the potential of the source or drain electrode becomes higher than that. Therefore, the transistor 2800 is turned off. When the pixel is selected, data is written, and the transistor 2800 does not disturb the writing operation. In this manner, by using a pixel shown in FIG. 28, reliability of the transistor can be considerably enhanced without a writing time limitation and without adding a special peripheral driver circuit for applying a negative charge.

Here, in order to accurately turn on/off the transistor 2800, it is preferable that the low side potential of the scan line be the lowest potential taken by an electrode of the pixel while the high side potential thereof be the highest potential taken by an electrode of the pixel.

It is to be noted that the pixel circuit shown in FIG. 28 is provided for the purpose of applying a sufficiently low potential to the gate electrode of the driving transistor 12 before writing data to the pixel, therefore, an electrode of an additionally provided transistor may be connected anywhere as long as it does not depart from the purpose. For example, the gate electrode of the transistor 2800 may be connected to a scan line of two lines before the pixel or a dedicated scan line. Moreover, one of the source or drain electrode of the transistor 2800 may be connected to, for example, the opposite electrode or the power supply line. Further, a pixel additionally provided with the transistor 2800 is not required to be the one shown in FIG. 3. For example, the pixel provided with a subpixel, which is shown in FIG. 23 or the pixel shown in FIG. 24 may also be used. Moreover, the pixel additionally provided with an erasing transistor, which is shown in FIG. 10 may be used or the pixels additionally provided with transistors having fixed gate potentials, which are shown in FIGS. 11 and 12 may also be used. A configuration of a pixel to be additionally provided with the transistor 2800 is not limited as long as a low potential is written to a gate electrode of a driving transistor before writing data.

Embodiment Mode 10

Described in this embodiment mode is a configuration of the whole panel which has the pixel circuit shown in the aforementioned embodiment mode.

Figure 13:
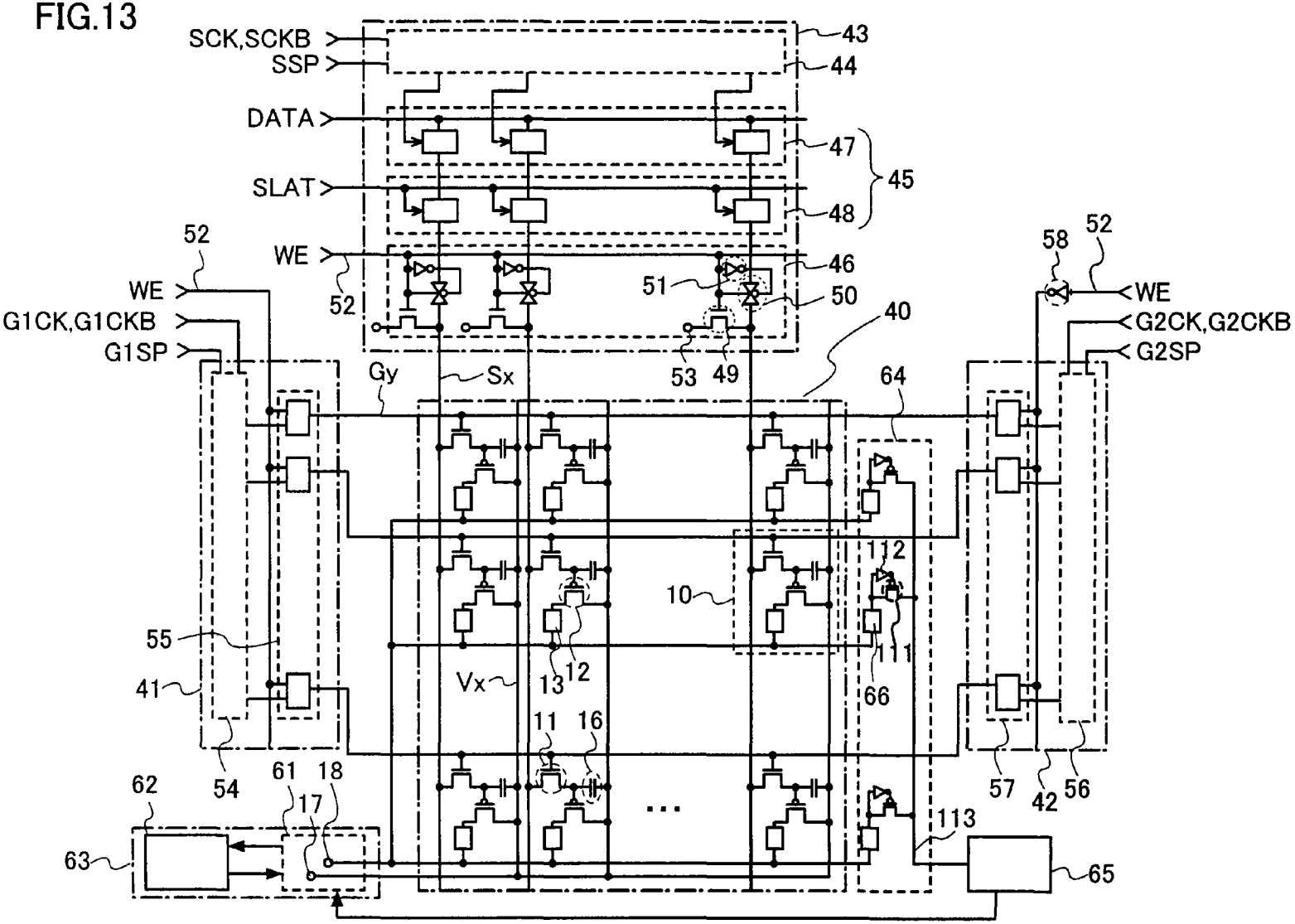
FIG. 13 is a diagram showing a panel of the invention.

As shown in FIG. 13, the light emitting device of the invention has the pixel portion 40 in which the aforementioned plurality of pixels 10 are arranged in matrix, the first scan line driver circuit 41, the second scan line driver circuit 42, and the signal line driver circuit 43. The first scan line driver circuit 41 and the second scan line driver circuit 42 may be arranged to face each other with the pixel portion 40 interposed therebetween, or arranged on any one of the four sides: left, right, top, and bottom of the pixel portion 40.

The signal line driver circuit 43 has a pulse output circuit 44, a latch 45, and a selecting circuit 46. The latch 45 has a first latch 47 and a second latch 48. The selecting circuit 46 has a transistor 49 and an analog switch 50 as switching units. The transistor 49 and the analog switch 50 are provided in each column depending on a signal line. In addition, in this embodiment mode, an inverter 51 is provided in each column to generate an inverted signal of a WE signal. Note that the inverter 51 is not necessarily provided in the case where the inverted signal of the WE signal is supplied externally.

A gate electrode of the transistor 49 is connected to a selection signal line 52, and one electrode thereof is connected to a signal line while the other electrode is connected to a power source 53. The analog switch 50 is provided between the second latch 48 and each signal line. In other words, an input terminal of the analog switch 50 is connected to the second latch 48, while an output terminal is connected to a signal line. The analog switch 50 has two control terminals, one of which is connected to the selection signal line 52, while the other is connected to the selection signal line 52 through the inverter 51. The power source 53 has a potential which turns off the driving transistor 12 in each pixel, and the potential of the power source 53 is at Low in the case where the driving transistor 12 has n-channel conductivity, while the potential of the power source 53 is at High in the case where the driving transistor 12 has p-channel conductivity.

The first scan line driver circuit 41 has a pulse output circuit 54 and a selecting circuit 55. The second scan line driver circuit 42 has a pulse output circuit 56 and a selecting circuit 57. Start pulses (G1SP and G2SP) are inputted to the pulse output circuits 54 and 56 respectively. Further, clock pulses (G1CK and G2CK) and inverted clock pulses (G1CKB and G2CKB) thereof are inputted to the pulse output circuits 54 and 56 respectively.

The selecting circuits 55 and 57 are connected to the selection signal line 52. Note that the selecting circuit 57 included in the second scan line driver circuit 42 is connected to the selection signal line 52 through an inverter 58. That is to say, WE signals which are inputted to the selecting circuits 55 and 57 through the selection signal line 52 are inverted from each other.

Each of the selecting circuits 55 and 57 has a tri-state buffer. The tri-state buffer operates in the case where a signal inputted from the selection signal line 52 is at H level, while the tri-state buffer is brought into a high impedance state in the case where the signal is at L level. Each of the pulse output circuit 44 included in the signal line driver circuit 43, the pulse output circuit 54 included in the first scan line driver circuit 41, and the pulse output circuit 56 included in the second scan line driver circuit 42 has a shift register including a plurality of flip-flop circuits or a decoder circuit. When a decoder circuit is used as the pulse output circuits 44, 54, and 56, a signal line or a scan line can be selected at random, which can prevent pseudo-contour from occurring in the case where a time grayscale method is adopted.

Note that the configuration of the signal line driver circuit 43 is not limited to the aforementioned one, and a level shifter or a buffer may be provided additionally. The configurations of the first scan line driver circuit 41 and the second scan line driver circuit 42 are not also limited to the aforementioned one, and a level shifter or a buffer may be provided additionally. Further, each of the signal line driver circuit 43, the first scan line driver circuit 41, and the second scan line driver circuit 42 may have a protection circuit.

In the invention, a protection circuit may be provided. The protection circuit may include a plurality of resistors. For example, P-channel transistors can be used as the plurality of resistors. The protection circuit can be provided in each of the signal line driver circuit 43, the first scan line driver circuit 41, and the second scan line driver circuit 42. The protection circuit is preferably provided between the pixel portion 40 and the signal line driver circuit 43, the first scan line driver circuit 41, or the second scan line driver circuit 42. Such a protection circuit prevents degradation or destruction of elements due to static electricity.

In this embodiment mode, the display device has a power source control circuit 63. The power source control circuit 63 has a controller 62 and a power source circuit 61 which supplies power to the light emitting element 13. The power source circuit 61 has a first power source 17 which is connected to a pixel electrode of the light emitting element 13 through the driving transistor 12 and the power supply line Vx. The power source circuit 61 also has a second power source 18 which is connected to the light emitting element 13 through the power supply line connected to an opposite electrode.

In such a power source circuit 61, when a forward bias voltage is applied to the light emitting element 13 so that the light emitting element 13 is supplied with a current and emits light, a potential of the first power source 17 is set to be higher than a potential of the second power source 18. On the other hand, when a reverse bias voltage is applied to the light emitting element 13, the potential of the first power source 17 is set to be lower than the potential of the second power source 18. Such a setting of the power source can be performed by supplying a predetermined signal from the controller 62 to the power source circuit 61.

In this embodiment mode, the display device has the monitor circuit 64 and a control circuit 65. The control circuit 65 has the constant current source 105 and the buffer amplifier circuit 110. The monitor circuit 64 has the monitor light emitting element 66, the monitor controlling transistor 111, and the inverter 112.

The control circuit 65 supplies to the power source control circuit 63 a signal which corrects a power source potential based on an output of the monitor circuit 64. The power source control circuit 63 corrects a power source potential to be supplied to the pixel portion 40 based on a signal which is supplied from the control circuit 65. In the display device of the invention which has the aforementioned configuration, variation in a current value due to a change of ambient temperature and degradation with time can be suppressed, leading to improved reliability. Further, the monitor controlling transistor 111 and the inverter 112 can prevent a current supply from the constant current source 105 to the monitor light emitting element 66 which is short-circuited, so that variations in a current value can be supplied to the light emitting element 13 accurately.

Embodiment Mode 11

In this embodiment mode, an operation of the display device of the invention which has the aforementioned configuration is described with reference to drawings.

Figure 15A:
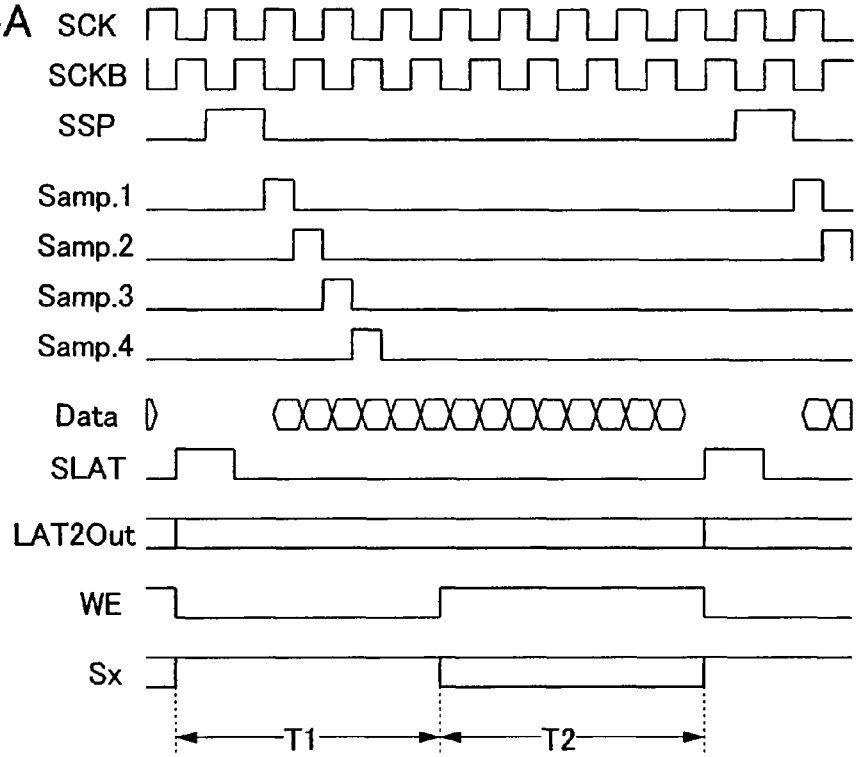
FIGS. 15A and 15B are timing charts of the invention.

First, an operation of the signal line driver circuit 43 is described with reference to FIG. 15A. A clock signal (hereinafter referred to as SCK), a clock inverted signal (hereinafter referred to as SCKB), and a start pulse (hereinafter referred to as SSP) are inputted to the pulse output circuit 44, and in accordance with the timing of these signals, a sampling pulse is outputted to the first latch 47. The first latch 47 to which data is inputted holds video signals from the first column to the last column in accordance with the timing of the sampling pulse input. The video signals held in the first latch 47 are transferred to the second latch 48 all at once when a latch pulse is inputted.

Here, operation of the selection circuit 46 during each period is described, on the assumption that a WE signal transmitted from the selection signal line 52 is at L level during a period T1 while at H level during a period T2. Each of the periods T1 and T2 corresponds to half of a horizontal scanning period, and the period T1 is referred to as a first subgate selection period while the period T2 is referred to as a second subgate selection period.

During the period T1 (the first subgate selection period), the WE signal transmitted from the selection signal line 52 is at L level, the transistor 49 is in an on-state, and the analog switch 50 is in a non-conductive state. Then, a plurality of data lines S1 to Sn are electrically connected to the power source 53 through the transistor 49 which is arranged in each column. In other words, a plurality of signal lines Sx have the same potential as the power source 53. At this time, the switching transistor 11 in the selected pixel 10 is turned on so that the potential of the power source 53 is transmitted to the gate electrode of the driving transistor 12 through the switching transistor 11. Then, the driving transistor 12 is turned off so that no current flows between both electrodes of the light emitting element 13 and no light is emitted. Thus, independently of a state of a video signal which is inputted to the signal line Sx, the potential of the power source 53 is transmitted to the gate electrode of the driving transistor 12 so that the switching transistor 11 is brought into an off-state, and light emission of the light emitting element 13 is forcibly stopped, which is erasing operation. At this time, it is preferable to set the potential of the power source 53 sufficiently high in a direction to turn off the driving transistor of the pixel, since a reverse bias voltage is applied to the gate electrode of the driving transistor as compared to the case of writing data, which leads to improved reliability of the transistor.

During the period T2 (the second subgate selection period), the WE signal transmitted from the selection signal line 52 is at H level, the transistor 49 is in an off-state, and the analog switch 50 is in a conductive state. Then, video signals of one row which are held in the second latch 48 are transmitted to each signal line Sx at the same time. At this time, the switching transistor 11 in the pixel 10 is turned on, and a video signal is transmitted to the gate electrode of the driving transistor 12 through the switching transistor 11. In accordance with the inputted video signal, the driving transistor 12 is turned on or off, and the first electrode and the second electrode of the light emitting element 13 have different potentials or the same potential. More specifically, when the driving transistor 12 is turned on, the first electrode and the second electrode of the light emitting element 13 have different potentials so that a current flows to the light emitting element 13, and light is emitted. Note that the current flowing to the light emitting element 13 is the same as the current flowing between the source and drain of the driving transistor 12.

On the other hand, when the driving transistor 12 is turned off, the first electrode and the second electrode of the light emitting element 13 have the same potentials, and no current flows to the light emitting element 13. That is to say, the light emitting element 13 emits no light. In this manner, in accordance with a video signal, the driving transistor 12 is turned on or off, and the first electrode and the second electrode of the light emitting element 13 have different potentials or the same potential, which is a writing operation.

Figure 15B:
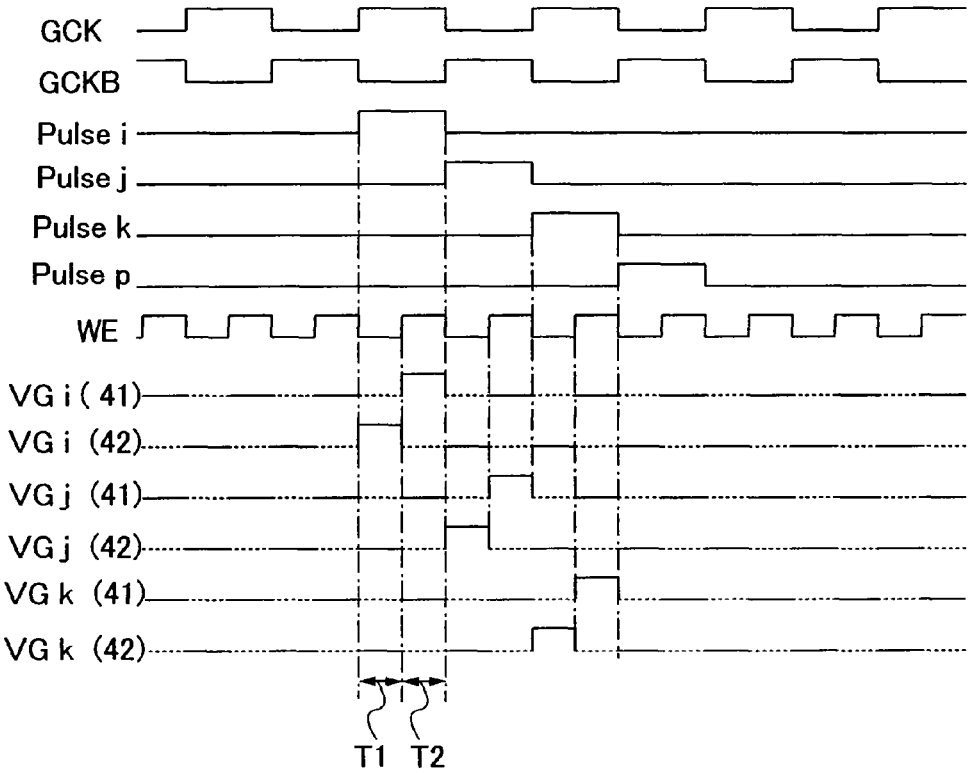

Next, the operation of the first scan line driver circuit 41 and the second scan line driver circuit 42 is described. G1CK, G1CKB, and G1SP are inputted to the pulse output circuit 54, and in accordance with the timing of these signals, pulses are outputted to the selection circuit 55 sequentially. Meanwhile, G2CK, G2CKB, and G2SP are inputted to the pulse output circuit 56, in accordance with the timing of these signals, pulses are outputted to the selection circuit 57 sequentially. Potentials of the pulses which are supplied to the selection circuits 55 and 57 of each column in the i-th row, the j-th row, the k-th row, and the p-th row (i, j, k, and p are natural numbers, $1 \leq i$, j, k, and $p \leq n$) are shown in FIG. 15B (dotted lines denote a floating state).

Here, described are operations of the selection circuit 55 included in the first scan line driver circuit 41 and the selection circuit 57 included in the second scan line driver circuit 42 during each period, on the assumption that a WE signal transmitted from the selection signal line 52 is at L level during a period T1, while the WE signal is at H level during a period T2 similarly to the description of the operation of the signal line driving circuit 43. Note that in a timing chart of FIG. 15B, a potential of the gate line Gy (y is a natural number, $1 \leq y \leq n$) to which a signal is transmitted from the first scan line driver circuit 41 is described as VGy (41), while a potential of the gate line to which a signal is transmitted from the second scan line driver circuit 42 is described as VGy (42). VGy (41) and VGy (42) can be supplied by the same gate line Gy.

During the period T1 (the first subgate selection period), the WE signal transmitted from the selection signal line 52 is at L level. Then, an L level WE signal is inputted to the selection circuit 55 included in the first scan line driver circuit 41, and the selection circuit 55 is brought into a floating state. On the other hand, an inverted WE signal, namely an H level signal is inputted to the selection circuit 57 included in the second scan line driver circuit 42 so that the selection circuit 57 is brought into an operation state. That is to say, the selection circuit 57 transmits an H level signal (row selection signal) to a gate line Gi of the i-th row so that the gate line Gi has the same potential as that of the H level signal. In other words, the gate line Gi of the i-th row is selected by the second scan line driver circuit 42. As a result, the switching transistor 11 in the pixel 10 is turned on. A potential of the power source 53 included in the signal line driver circuit 43 is transmitted to the gate electrode of the driving transistor 12 so that the driving transistor 12 is turned off and the potentials of the two electrodes of the light emitting element 13 become equal to each other. That is to say, during the period T1, the erasing operation in which the light emitting element 13 emits no light is performed.

During the period T2 (the second subgate selection period), the WE signal transmitted from the selection signal line 52 is at H level. Then, an H level WE signal is inputted to the selection circuit 55 included in the first scan line driver circuit 41 so that the selection circuit 55 is in an operation state. In other words, the selection circuit 55 transmits an H level signal to the gate line Gi of the i-th row so that the gate line Gi has the same potential as that of the H level signal. That is to say, the gate line Gi of the i-th row is selected by the first scan line driver circuit 41. As a result, the switching transistor 11 in the pixel 10 is turned on. A video signal is transmitted from the second latch 48 included in the signal line driver circuit 43 to the gate electrode of the driving transistor 12 so that the driving transistor 12 is turned on or off, and the two electrodes of the light emitting element 13 have different potentials or the same potentials. In other words, during the period T2, the writing operation in which the light emitting element 13 emits light or no light is performed. On the other hand, an L level signal is inputted to the selection circuit 57 included in the second scan line driver circuit 42, and the selection circuit 57 is brought into a floating state.

Thus, the gate line Gy is selected by the second scan line driver circuit 42 during the period T1 (the first subgate selection period), while selected by the first scan line driver circuit 41 during the period T2 (the second subgate selection period). That is to say, the gate line is controlled by the first scan line driver circuit 41 and the second scan line driver circuit 42 in a complementary manner. During one of the first subgate selection period and the second subgate selection period, the erasing operation is performed, and the writing operation is performed during the other.

Note that during the period in which the first scan line driver circuit 41 selects the gate line Gi of the i-th row, the second scan line driver circuit 42 does not operate (the selection circuit 57 is in a floating state), or transmits a row selection signal to gate lines of rows other than the i-th row. Similarly, during the period in which the second scan line driver circuit 42 transmits the row selection signal to the gate line Gi of the i-th row, the first scan line driver circuit 41 is in a floating state, or transmits the row selection signal to gate lines of rows other than the i-th row.

According to the invention performing the aforementioned operation, the light emitting element 13 can be forcibly turned off, which increases the duty ratio. Further, although the light emitting element 13 can be turned off forcibly, a TFT for discharging the charge of the capacitor 16 is not required to be provided, thereby a high aperture ratio is achieved. With the high aperture ratio, luminance of the light emitting element can be reduced with an increase in a light emitting area. That is to say, a driving voltage can be decreased to reduce power consumption.

Note that the invention is not limited to the aforementioned embodiment mode in which a gate selection period is divided into two. A gate selection period may be divided into three or more.

Embodiment Mode 12

The invention can also be applied to a display device driven with a constant current. Described in this embodiment mode is a configuration where the degree of changes with time is detected by using the monitor light emitting element 66. A video signal or a power source potential is corrected based on the detected result, thereby the change with time of the light emitting element is compensated.

In this embodiment mode, a first monitor light emitting element and a second monitor light emitting element are provided. A constant current is supplied from a first constant current source to the first monitor light emitting element while a constant current is supplied from a second constant current source to the second monitor light emitting element. By supplying different current values between the first current source and the second current source, the total amount of current supplied to the first and second monitor light emitting elements can be made different. As a result, the first monitor light emitting element and the second monitor light emitting element change differently with time.

The first and second monitor light emitting elements are connected to an arithmetic circuit. The arithmetic circuit calculates a potential difference between the first monitor light emitting element and the second monitor light emitting element. The voltage value calculated by the arithmetic circuit is supplied to a video signal generating circuit. The video signal generating circuit corrects a video signal supplied to each pixel based on the voltage value supplied from the arithmetic circuit. With such a configuration, changes with time of the light emitting element can be compensated. A circuit such as a buffer amplifier circuit for preventing changes in potential is preferably provided between each monitor light emitting element and the arithmetic circuit. In this embodiment mode, for example, a pixel using a current mirror circuit or the like can be used as a pixel driven by a constant current.

Embodiment Mode 13

The invention can be applied to a passive matrix display device. A passive matrix display device has a pixel portion formed over a substrate and a controller for controlling, a column signal line driver circuit and a row signal line driver circuit provided in the periphery of the pixel portion. The pixel portion has column signal lines arranged in the column direction, row signal lines arranged in the row direction, and a plurality of light emitting elements arranged in matrix. A monitor circuit 64 can be provided over the same substrate as the pixel portion.

In the display device of this embodiment mode, image data inputted to the column signal line driver circuit and a voltage generated from a constant voltage source can be corrected in accordance with a change with temperature and time by the monitor circuit 64. A display device can be provided with reduced effect caused by the change with temperature and time.

Embodiment Mode 14

An electronic device which is provided with a pixel portion including a light emitting element includes: a television set (simply referred to as a TV or a television receiver), a camera such as a digital camera and a digital video camera, a mobile phone set (simply referred to as a cellular phone set or a cellular phone), a portable information terminal such as a PDA, a portable game machine, a monitor for a computer, a computer, an audio reproducing device such as a car audio set, an image reproducing device provided with a recording medium such as a home game machine, and the like. Specific examples thereof are described with reference to FIGS. 16A to 16F.

Figure 16A:
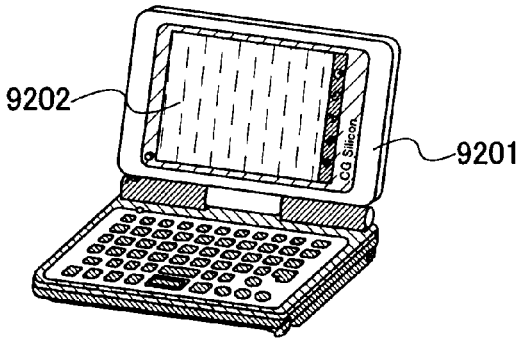
FIGS. 16A to 16F are views showing electronic devices of the invention.

A portable information terminal shown in FIG. 16A includes a main body 9201, a display portion 9202, and the like. The display device of the invention can be applied to the display portion 9202. That is to say, according to the invention in which the power source potential applied to the light emitting element is corrected by the monitor light emitting element, it is possible to provide a portable information terminal in which the effect of variations in a current value of the light emitting element due to a change of ambient temperature and a change with time is reduced.

Figure 16B:
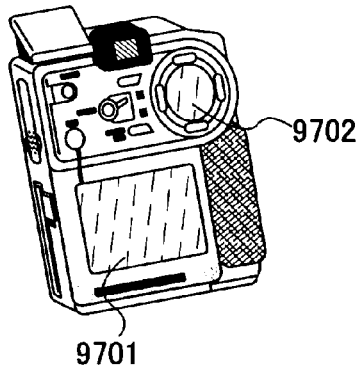

A digital video camera shown in FIG. 16B includes a display portion 9701, a display portion 9702, and the like. The display device of the invention can be applied to the display portion 9701. According to the invention in which the power source potential applied to the light emitting element is corrected by the monitor light emitting element, it is possible to provide a digital video camera in which the effect of variations in a current value of the light emitting element due to a change of ambient temperature and a change with time is reduced.

Figure 16C:
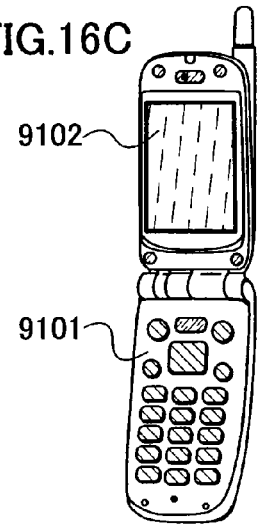

A cellular phone shown in FIG. 16C includes a main body 9101, a display portion 9102, and the like. The display device of the invention can be applied to the display portion 9102. According to the invention in which the power source potential applied to the light emitting element is corrected by the monitor light emitting element, it is possible to provide a cellular phone in which the effect of variations in a current value of the light emitting element due to a change of ambient temperature and a change with time is reduced.

Figure 16D:
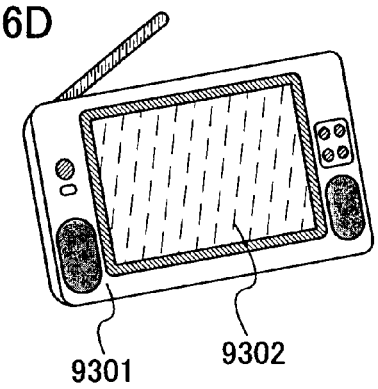

A portable television set shown in FIG. 16D includes a main body 9301, a display portion 9302, and the like. The display device of the invention can be applied to the display portion 9302. According to the invention in which the power source potential applied to the light emitting element is corrected by the monitor light emitting element, it is possible to provide a portable television set in which the effect of variations in a current value of the light emitting element due to a change of ambient temperature and a change with time is reduced. The display device of the invention can be applied to various types of television sets such as a small-sized television incorporated in a portable terminal such as a cellular phone, a medium-sized television which is portable, and a large-sized television (for example, 40 inches in size or more).

Figure 16E:
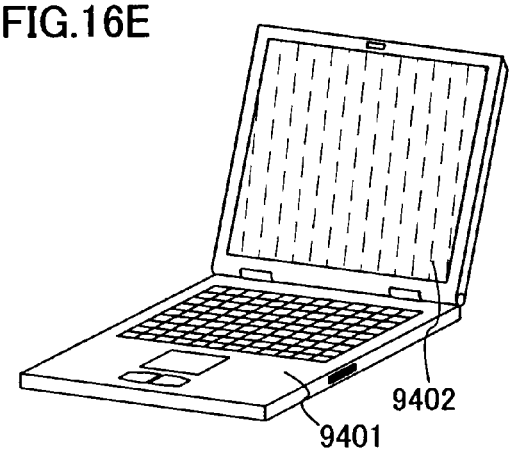

A portable computer shown in FIG. 16E includes a main body 9401, a display portion 9402 and the like. The display device of the invention can be applied to the display portion 9402. According to the invention in which the power source potential applied to the light emitting element is corrected by the monitor light emitting element, it is possible to provide a portable computer in which the effect of variations in a current value of the light emitting element due to a change of ambient temperature and a change with time is reduced.

Figure 16F:
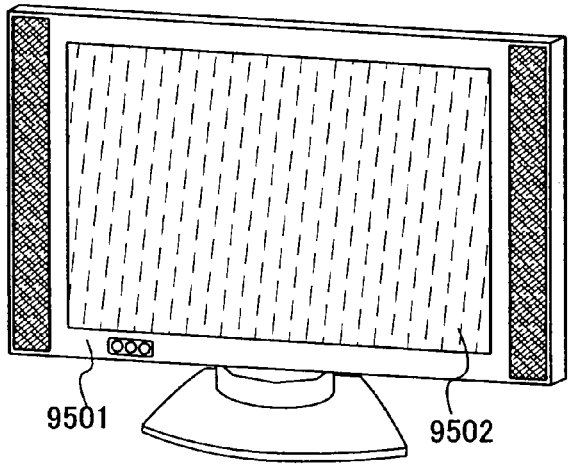

A television set shown in FIG. 16F includes a main body 9501, a display portion 9502, and the like. The display device of the invention can be applied to the display portion 9502. According to the invention in which the power source potential applied to the light emitting element is corrected by the monitor light emitting element, it is possible to provide a television set in which the effect of variations in a current value of the light emitting element due to a change of ambient temperature and a change with time is reduced.

This application is based on Japanese Patent Application serial no. 2005-194600 filed in Japan Patent Office on 4th, Jul., 2005, the entire contents of which are hereby incorporated by reference.

What is claimed is:

1. A display device comprising:

a pixel portion in which light emitting elements are arranged in matrix, the pixel portion including a pixel comprising a plurality of subpixels;

a monitor portion in which monitor light emitting elements are provided outside the pixel portion, the monitor portion including a monitor pixel comprising a plurality of subpixels;

a first line for detecting a potential of the monitor light emitting elements;

a switch in the monitor portion for blocking a current supply to a shorted monitor light emitting element through the first line when one or more of a plurality of the monitor light emitting elements is shorted;

a circuit for changing a potential applied to the light emitting elements of each of the subpixels in the pixel in the pixel portion in accordance with a potential change of the monitor light emitting elements of each of the subpixels in the monitor pixel in the monitor portion;

a constant current source for supplying a constant current to the monitor light emitting elements through the first line; and a second line electrically connecting the circuit to the light emitting elements in the pixel portion, wherein the switch is connected to the monitor light emitting elements, wherein the circuit is electrically connected to the monitor light emitting elements in the monitor portion through the first line, wherein the circuit is electrically connected to the light emitting elements in the pixel portion through the second line, wherein a potential of the monitor light emitting elements is inputted to an input terminal of the circuit through the first line, and wherein a potential is supplied to the light emitting elements in the pixel portion from an output terminal of the circuit through the second line.

2. A display device comprising:

a pixel comprising at least two subpixels, each of the subpixels including a light emitting element;

a monitor pixel comprising at least two subpixels, each of the subpixels including a monitor light emitting element;

a first line for detecting a potential of the monitor light emitting element;

a switch in a monitor portion for blocking a current supply to a shorted monitor light emitting element through the first line when the monitor light emitting element is shorted;

a second line electrically connected to the light emitting element; and a circuit for changing a potential applied to the light emitting element of each of the subpixels in the pixel in accordance with a potential change of the monitor light emitting element of each of the subpixels in the monitor pixel, the circuit being electrically connected to the first line and the second line, wherein the switch is connected to the monitor light emitting element, wherein the subpixels in one pixel are the same in color, wherein the subpixels in one monitor pixel are the same in color, wherein a potential of the monitor light emitting element is inputted to an input terminal of the circuit through the first line, and wherein a potential is supplied to the light emitting element in a pixel portion from an output terminal of the circuit through the second line.

3. The display device according to claim 2, wherein each of the subpixels in the pixel and the monitor pixel comprises a selecting transistor, a driving transistor connected to the light emitting element, and a capacitor for holding a voltage, and wherein the selecting transistor and the driving transistor are formed of amorphous silicon.

4. The display device according to claim 3, wherein a precharge circuit for applying a negative voltage to a gate electrode of the driving transistor is provided.

5. The display device according to claim 4, wherein a potential applied to the gate electrode of the driving transistor by the precharge circuit is equal to or higher than a potential on a low potential side of a voltage applied to the light emitting element of each of the subpixels and equal to or lower than a potential obtained by adding a threshold voltage value of the driving transistor of each of the subpixels to a source electrode potential of the driving transistor of each of the subpixels.

6. The display device according to claim 2, wherein the circuit is an operational amplifier circuit.

7. The display device according to claim 2, wherein the circuit is a buffer amplifier circuit.

8. A display device comprising:

a pixel comprising at least two subpixels, each of the subpixels including at least one light emitting element of the same light emission color;

a monitor pixel comprising at least two subpixels, each of the subpixels including at least one monitor light emitting element of the same light emission color;

a first line for detecting a potential of the monitor light emitting element;

a switch in a monitor portion for blocking a current supply to a shorted monitor light emitting element through the first line when one or more of a plurality of the monitor light emitting elements is shorted;

a second line electrically connected to the light emitting element; and a circuit for changing a potential applied to the light emitting element of each of the subpixels in the pixel in accordance with a potential change of the monitor light emitting element of each of the subpixels in the monitor pixel, the circuit being electrically connected to the first line and the second line, wherein the switch is connected to the monitor light emitting element, wherein the monitor light emitting element of each of the subpixels in the monitor pixel is manufactured at the same time as the light emitting element of each of the subpixels in the pixel, wherein the monitor light emitting element of each of the subpixels in the monitor pixel is connected to different constant current sources in each subpixel, wherein a potential of the monitor light emitting element is inputted to an input terminal of the circuit through the first line, and wherein a potential is supplied to the light emitting element in a pixel portion from an output terminal of the circuit through the second line.

9. The display device according to claim 8, wherein each of the subpixels in the pixel and the monitor pixel comprises a selecting transistor, a driving transistor connected to the light emitting element, and a capacitor for holding a voltage, and wherein the selecting transistor and the driving transistor are formed of amorphous silicon.

10. The display device according to claim 9, wherein a precharge circuit for applying a negative voltage to a gate electrode of the driving transistor is provided.

11. The display device according to claim 10, wherein a potential applied to the gate electrode of the driving transistor by the precharge circuit is equal to or higher than a potential on a low potential side of a voltage applied to the light emitting element of each of the subpixels and equal to or lower than a potential obtained by adding a threshold voltage value of the driving transistor of each of the subpixels to a source electrode potential of the driving transistor of each of the subpixels.

12. The display device according to claim 8, wherein the circuit is an operational amplifier circuit.

13. The display device according to claim 8, wherein the circuit is a buffer amplifier circuit.

14. A display device comprising:

a pixel portion in which pixels are arranged in matrix, each of the pixels comprising a first subpixel in which a first light emitting element is connected to a first driving transistor; and a second subpixel in which at least two second light emitting elements are connected in parallel and connected to a second driving transistor;

a monitor pixel comprising a third subpixel in which a third monitor light emitting element is connected to a third driving transistor and a fourth subpixel in which at least two fourth monitor light emitting elements are connected in parallel and connected to a fourth driving transistor;

a first line for detecting a potential of the monitor light emitting elements;

a switch in a monitor portion for blocking a current supply to a shorted monitor light emitting element through the first line when one or more of a plurality of the monitor light emitting elements is shorted;

a second line electrically connected to the light emitting elements; and a circuit for changing a potential applied to the first light emitting element and the second light emitting elements in each of the pixels in accordance with a potential change of the third monitor light emitting element and the fourth monitor light emitting elements in the monitor pixel, the circuit being electrically connected to the first line and the second line, wherein the first light emitting element and the third monitor light emitting element have equivalent characteristics, and the second light emitting elements and the fourth monitor light emitting elements have equivalent characteristics, wherein in the monitor pixel, the third monitor light emitting element and the fourth monitor light emitting elements are connected to different constant current sources, wherein the first, the second, the third and the fourth subpixels are the same in color, wherein a potential of the monitor light emitting element is inputted to an input terminal of the circuit through the first line, and wherein a potential is supplied to the light emitting element in the pixel portion from an output terminal of the circuit through the second line.

15. The display device according to claim 14, wherein the circuit is an operational amplifier circuit.

16. The display device according to claim 14, wherein the circuit is a buffer amplifier circuit.

* * * * *